US010015608B2

(12) United States Patent
Crawley et al.

(10) Patent No.: US 10,015,608 B2
(45) Date of Patent: Jul. 3, 2018

(54) METHODS AND APPARATUS RELATED TO PROTECTION OF A SPEAKER

(71) Applicant: FAIRCHILD SEMICONDUCTOR CORPORATION, Sunnyvale, CA (US)

(72) Inventors: Philip Crawley, Oceanside, CA (US); William D. Llewellyn, San Jose, CA (US); Majid Shushtarian, Pleasanton, CA (US); Earl D. Schreyer, Carlsbad, CA (US)

(73) Assignee: FAIRCHILD SEMICONDUCTOR CORPORATION, Phoenix, AZ (US)

( * ) Notice: Subject to any disclaimer, the term of this patent is extended or adjusted under 35 U.S.C. 154(b) by 0 days.

(21) Appl. No.: 15/642,940

(22) Filed: Jul. 6, 2017

(65) Prior Publication Data

US 2017/0303057 A1 Oct. 19, 2017

Related U.S. Application Data

(63) Continuation of application No. 14/074,314, filed on Nov. 7, 2013.

(60) Provisional application No. 61/723,643, filed on Nov. 7, 2012.

(51) Int. Cl.
*H04R 29/00* (2006.01)

(52) U.S. Cl.
CPC ..... *H04R 29/001* (2013.01)

(58) Field of Classification Search
CPC ..... H04R 3/007; H04R 29/001; H04R 3/002; H04R 3/04; H04R 1/2811; H04R 1/2819; H04R 2430/03; H04R 2430/01; H04R 3/08; H04R 1/2842; H03G 5/165; H03G 3/22; H03G 3/3042; H03G 3/32; H03G 7/002; G10L 21/0272; G10L 25/51; G10L 25/93; G10L 15/02; G10L 19/0017; G10L 19/008; G10L 19/167; G10L 19/20; G10L 21/0208; G10L 25/18; H04M 9/001; H04M 9/10; H04S 2400/11
USPC ..... 381/55–59, 96, 98, 396, 102, 103, 106, 381/111, 116, 117; 330/10, 298; 181/144
See application file for complete search history.

(56) References Cited

U.S. PATENT DOCUMENTS

| | | | |
|---|---|---|---|
| 3,769,965 | A | 11/1973 | Raddi et al. |
| 5,548,650 | A | 8/1996 | Clark |
| 6,580,318 | B2 | 6/2003 | Taylor |
| 6,671,232 | B1 | 12/2003 | Stupp |
| 6,931,135 | B1 | 8/2005 | Kohut |
| 7,154,329 | B2 | 12/2006 | Douglas |

(Continued)

OTHER PUBLICATIONS

Maxim Integrated "MAX98089 Low-Power, Stereo Audio Codec with FlexSound Technology," Mar. 2012, 131 pages.

*Primary Examiner* — Lao Lun-See
(74) *Attorney, Agent, or Firm* — Brake Hughes Bellermann LLP

(57) ABSTRACT

In one general aspect, a method can include calculating, at a calibration temperature of a speaker, a calibration parameter through a coil of the speaker in response to a first test signal, and can include sending a second test signal through the coil of the speaker. The method can also include measuring a parameter through the coil of the speaker based on the second test signal, and calculating a temperature change of the coil of the speaker based on the parameter and based on the calibration parameter at the calibration temperature.

20 Claims, 39 Drawing Sheets

(56) References Cited

U.S. PATENT DOCUMENTS

| | | | | |
|---|---|---|---|---|
| 7,157,968 | B2 * | 1/2007 | Shin | H03F 1/52 330/251 |
| 7,300,435 | B2 | 11/2007 | Wham et al. | |
| 7,339,173 | B2 | 3/2008 | Stein et al. | |
| 7,372,966 | B2 | 5/2008 | Bright | |
| 7,436,967 | B2 | 10/2008 | Neunaber | |
| 7,791,028 | B2 | 9/2010 | Baltz et al. | |
| 7,813,514 | B2 | 10/2010 | Asada | |
| 7,908,893 | B2 | 3/2011 | Thorn et al. | |
| 8,983,080 | B2 | 3/2015 | Luo et al. | |
| 9,185,493 | B2 | 11/2015 | Lubberhuizen et al. | |
| 9,363,599 | B2 * | 6/2016 | Su | H04R 3/007 |
| 9,729,986 | B2 * | 8/2017 | Crawley | H04R 29/001 |
| 9,837,971 | B2 * | 12/2017 | Luo | H03F 1/52 |
| 2005/0253648 | A1 | 11/2005 | Shin | |
| 2006/0215855 | A1 | 9/2006 | Rauenzahn | |
| 2007/0070560 | A1 | 3/2007 | Hikawa et al. | |
| 2011/0193578 | A1 | 8/2011 | Gautama | |
| 2011/0228945 | A1 * | 9/2011 | Mihelich | H04R 3/002 381/59 |
| 2012/0020488 | A1 | 1/2012 | Huijser et al. | |
| 2013/0083928 | A1 | 4/2013 | Williams et al. | |
| 2014/0341394 | A1 * | 11/2014 | Croft, III | H04R 1/2811 381/102 |

* cited by examiner

| VL<1:0> | Level (Vpk) |
|---|---|
| 11 | -2 dB |
| 10 | -4 dB |
| 01 | -6 dB |
| 00 | -8 dB |

FIG. 21B

| RR<1:0> | ms/step |
|---|---|
| 11 | 200 ms |
| 10 | 100 ms |
| 01 | 60 ms |
| 00 | 30 ms |

FIG. 21C

| Fc_L<1:0> | Fs -3dB | R |
|---|---|---|
| 11 | 400 Hz | 3979 |
| 10 | 300 Hz | 5305 |
| 01 | 200 Hz | 7958 |
| 00 | 100 Hz | 15.9K |

FIG. 21D

| Fc_H<1:0> | Fs -3dB | R |
|---|---|---|
| 11 | 1000 Hz | 1592 |
| 10 | 800 Hz | 1989 |
| 01 | 600 Hz | 2653 |
| 00 | 400 Hz | 3979 |

FIG. 21E

| VL<1:0> | Level (Vpk) |
|---|---|
| 11 | -2 dB |
| 10 | -4 dB |
| 01 | -6 dB |
| 00 | -8 dB |

FIG. 30B

| RR<1:0> | μs/step |
|---|---|
| 11 | 10 μs |
| 10 | 30 μs |
| 01 | 60 μs |
| 00 | 100 μs |

FIG. 30C

| Fc<1:0> | Fc -3dB |
|---|---|
| 11 | 1600 Hz |
| 10 | 1400 Hz |
| 01 | 1200 Hz |
| 00 | 1000 Hz |

FIG. 30D

METHODS AND APPARATUS RELATED TO PROTECTION OF A SPEAKER

RELATED APPLICATION

This application is a Continuation application of U.S. Non-Provisional application Ser. No. 14/074,314, filed Nov. 7, 2013, which claims priority to and the benefit of U.S. Provisional Application No. 61/723,643, entitled, "Methods and Apparatus Related to Protection of a Speaker," filed Nov. 7, 2012, both of which are incorporated herein by reference in their entireties.

TECHNICAL FIELD

This description relates to thermal detection and protection of a speaker.

BACKGROUND

Various types of components, such as electronic components, electromechanical components, and so forth can generate heat (e.g., self-heating) when in operation. The generation of heat during operation can, in some instances, cause can irreversible damage to the components. In some known systems, measuring a temperature of a component susceptible to heat damage can be difficult to perform directly. In some systems, measuring a temperature of a component can be expensive and/or impossible.

As an example, a speaker can be configured to convert electrical energy into acoustic energy and thermal energy. Specifically, a speaker voice coil can interact with magnetic circuitry to cause movement of a diaphragm, which produces sounds, when current is applied to the leads of the speaker voice coil. Applying current (e.g., excessive current) to the voice coil can cause the temperature of components of speaker to rise due to, for example, inefficiencies in the speaker. Heating of the speaker can result in melting of components, sound distortion, thermal compression of an audio signal, thermal fatigue/degradation, mechanical failure, irreversible changes to the magnetic properties of some components of the speaker, and/or so forth. The heating of the speaker can be exacerbated when speaker is driven to generate sounds at a relatively high volume. As another example, mechanical failure can occur when excessive power causes a speaker voice coil to move far enough that it strikes another portion of the speaker or causes separation of portions of the speaker voice coil from a diaphragm of the speaker. In some instances, excessive power applied to the speaker can cause misalignment of portions of the speaker, tearing of the diaphragm, and/or so forth. These types of events that can cause mechanical damage can be referred to as excess-excursion or over-excursion events.

Known modeling and/or measurements techniques may not be sufficient to protect a speaker from thermally-related damage, especially when some characteristics of the speaker are not known, well-quantified, or directly measurable. For example, variations in processes used to produce a speaker can result in relatively inaccurate and/or uncalibrated protection techniques. Accordingly, measuring the temperature of the speaker can be difficult, and consequently, protecting the speaker from thermally-related damage may not be performed in a desirable fashion. In addition, known modeling, detection, prevention, and/or measurements techniques may not be sufficient to protect a speaker from mechanical damage, such as that described above, in response to excessive power. Some known techniques, even if they may provide a desirable level of protection, may be relatively inefficient and/or too expensive to implement in some applications. Thus, a need exists for systems, methods, and apparatus to address the shortfalls of present technology and to provide other new and innovative features.

SUMMARY

In one general aspect, a method can include calculating, at a calibration temperature of a speaker, a calibration parameter through a coil of the speaker in response to a first test signal, and can include sending a second test signal through the coil of the speaker. The method can also include measuring a parameter through the coil of the speaker based on the second test signal, and calculating a temperature change of the coil of the speaker based on the parameter and based on the calibration parameter at the calibration temperature.

In one general aspect, a method can include receiving an indicator of an amplitude of an audio signal associated with a speaker, and determining that the amplitude exceeds a threshold amplitude value. The method can also include modifying, for a time period, a time constant of an input filter from a first value to a second value in response to the determining. The method can also include modifying the time constant from the second value to a third value in response to the time period expiring.

In one general aspect, a method can include deriving a side chain audio signal from a main audio signal associated with a speaker and receiving an indicator of an amplitude of the side chain audio signal. The method can include determining that the amplitude of the side chain audio signal exceeds a threshold amplitude value, and modifying, for a time period, a level of the main audio signal and a level of the side chain audio signal in response to the determination. The method can also include modifying the level of the main audio signal and the level of the side chain audio signal in response to the time period expiring.

In one general aspect, a method can include calculating an error value in response to an audio signal associated with a speaker, and determining that the error value exceeds a threshold value. The method can also include modifying, for time period, a level of the audio signal in response to the determination, and modifying the level of the audio signal in response to the time period expiring.

The details of one or more implementations are set forth in the accompanying drawings and the description below. Other features will be apparent from the description and drawings, and from the claims.

BRIEF DESCRIPTION OF THE DRAWINGS

FIGS. 21B through 21E are tables associated with the detection and protection system shown in FIG. 21A.

FIGS. 30B through 30D are tables associated with the detection and protection system shown in FIG. 30A.

DETAILED DESCRIPTION

Figure 1:
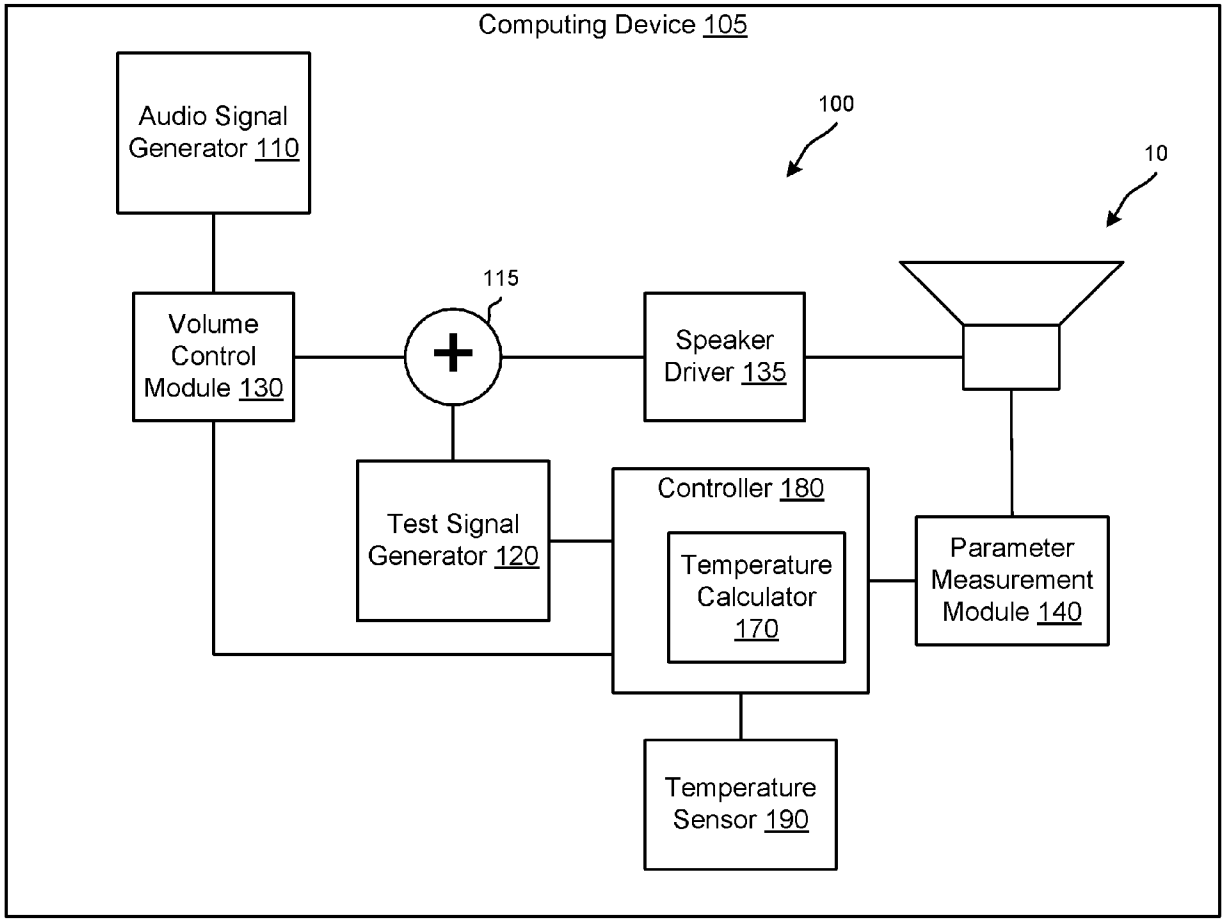
FIG. 1 is a diagram that illustrates a detection and protection system configured to detect thermal changes related to a speaker.

FIG. 1 is a diagram that illustrates a detection and protection system 100 configured to detect thermal changes related to a speaker 10. The detection and protection system 100 is also configured to protect the speaker 10 in response to thermal changes to the speaker 10 (or a portion thereof). For example, the detection and protection system 100 can be configured to calculate a temperature of the speaker 10 and can be configured to attenuate an audio signal driving the speaker 10 based on the calculated temperature so that the speaker 10 may not be damaged in an undesirable fashion due to overheating. In some embodiments, the speaker 10 can be a micro-speaker.

In some embodiments, the speaker 10 can be associated with (e.g., included in) a computing device 105 such as, for example, a mobile phone, a smartphone, a music player (e.g., an MP3 player, a stereo), a videogame player, a projector, a tablet device, laptop computer, a television, a headset, and/or so forth. The speaker 10 can be configured to produce sound (e.g., music, vocal tones) in response to audio signals produced by an audio signal generator 110 of the computing device 105. Specifically, a speaker driver 135 can be configured to receive the audio signals produced by the audio signal generator 110 and can be configured to trigger the speaker 10 to produce sound based on the audio signals. In some embodiments, the audio signal generator 110 can be configured to produce audio signals associated with a music player (e.g., an MP3 player), a telephone, a videogame, and/or so forth. Audio signals produced by the audio signal generator 110 can be increased (e.g., scaled up, increased gain) or decreased (e.g., attenuated) using a volume control module 130. In some embodiments, the speaker driver 135 can define at least a portion of a class D amplifier, a class A and/or B amplifier, and/or so forth.

During calibration (also can be referred to as a calibration time period), the detection and protection system 100 is configured to measure a value of a parameter (e.g., a current, a resistance, etc.) related to the speaker 10 at a calibration temperature (also can be referred to as a baseline temperature) of the speaker 10 thereby calibrating the parameter at the calibration temperature of the speaker 10. The value of the parameter measured at the calibration temperature can be referred to as a calibration value of the parameter, as a calibration parameter value, or as a baseline parameter value. Calibration associated with the parameter at the calibration temperature of the speaker 10 can be performed, at least in part by, a temperature calculator 170 included in a controller 180 of the detection and protection system 100.

As shown in FIG. 1, the calibration temperature can be measured by a temperature sensor 190. In some embodiments, the temperature sensor 190 can be, for example, a digital temperature sensor, a diode temperature sensor, a thermocouple, the monolithic temperature sensor, a silicon bandgap temperature sensor, and/or so forth. In some embodiments, the temperature sensor 190 can be an on-chip temperature sensor that can be integrated with at least some of the components of the detection and protection system 100. In some embodiments, a calibration temperature measured by the temperature sensor 190 can be stored (e.g., stored in a memory and/or a register) by the temperature calculator 170 for later use by the temperature calculator 170 during normal operation.

In some embodiments, the temperature sensor 190 can be configured to remotely measure (e.g., not directly measure, decoupled from) the calibration temperature. In other words, the temperature sensor 190, rather than being directly coupled to the speaker 10 to measure temperature, can be in relatively close proximity to (but is remote, separated, and/or decoupled from) the speaker 10. The calibration temperature can be measured by the temperature sensor 190 during calibration when the speaker 10 is in thermal equilibrium (or substantially in thermal equilibrium) with the temperature sensor 190 so that the calibration temperature is representative of an actual temperature of the speaker 10 during calibration. In some embodiments, the calibration temperature can be measured by the temperature sensor 190 during calibration while the speaker 10 is in a relatively low self-heating condition (e.g., relatively low-power state) or in a known condition where temperature of the speaker 10 may be substantially stable (e.g., may not be varying).

During normal operation (after calibration has been completed), changes to the temperature of the speaker 10 can be calculated (e.g., derived, estimated) by a temperature calculator 170 based on changes to values of a parameter with respect to the calibration parameter values previously obtained during calibration. Changes to the temperature of the speaker 10 can be caused by use of the speaker 10 in response to audio signals (e.g., audio signals from music) produced by the audio signal generator 110 of the computing device 105. Changes to the temperature of the speaker 10 can be determined based on changes to values of the parameter with respect to the calibration value of the parameter as the speaker 10 produces sound triggered by the audio signal generator 110. In some embodiments, the parameter related to the speaker 10 can be, for example, a current through a coil (e.g., a voice coil) of the speaker 10, an impedance of at least a portion of the speaker 10, a voltage across at least a portion of the speaker 10, and/or a so forth.

During calibration, in some embodiments, a calibration value of a parameter measured at a calibration temperature for the speaker 10 can be used by the temperature calculator 170 to define at least a part of a temperature relationship. The temperature relationship can later be used by the temperature calculator 170 during normal operation to calculate (e.g., project, determine) a temperature (e.g., a temperature increase) of the speaker 10 based on later measurements of the parameter. In some embodiments, if the parameter is related to, for example, a current through a coil (e.g., a copper coil) of the speaker 10, the temperature relationship can be based at least in part on, for example, temperature coefficient (e.g., a copper temperature coefficient) of the coil. In some embodiments, the temperature relationship can be a linear relationship, a nonlinear relationship, a stepwise relationship, and/or so forth. By using the calibration and temperature relationship techniques described herein, a temperature of the speaker 10 can be calculated even without accurately measuring certain properties of the speaker 10 (such as a nominal resistance of a coil of the speaker 10).

In some embodiments, a temperature of the speaker 10 can be calculated during normal operation based on a temperature relationship because the temperature of the speaker 10 may be relatively difficult to directly measure using, for example, a temperature sensor coupled to the speaker 10. In some embodiments, calculation of the temperature based on a temperature relationship can be used to calculate an estimated temperature with respect to the calibration temperature.

As shown in FIG. 1, the detection and protection system includes a volume control module 130 coupled to a controller 180. The volume control module 130 can be configured to increase or decrease (e.g., attenuate) an audio signal produced by an audio signal generator 110 to, for example, protect the speaker 10 from thermally-related damage based on a temperature calculated by the temperature calculator 170 (based on a temperature relationship).

Specifically, if a temperature of the speaker 10, as calculated based on the temperature relationship and in response to audio signals produced by the audio signal generator 110 during normal operation, exceeds a threshold temperature, the controller 180 can be configured to trigger the volume control module 130 to attenuate the audio signals produced by the audio signal generator 110. Conversely if a temperature of the speaker 10, as calculated based on the temperature relationship and in response to audio signals produced by the audio signal generator 110 during normal operation, falls below a threshold temperature, the controller 180 can be configured to trigger the volume control module 130 to increase (e.g., increased using a gain value) the audio signals produced by the audio signal generator 110.

Calibration (e.g., a calibration time period) can occur after (e.g., shortly after) initial start-up of the computing device 105 (e.g., an audio system of the computing device 105) that is using the speaker 10. In such embodiments, the speaker 10 can be relatively cold (or any thermally stable state) and can have a relatively constant temperature based on, for example, an ambient environment around the speaker 10. In some embodiments, a calibration can be triggered each time the computing device 105 is started or is changed from a standby state to an operational state. In some embodiments, calibration can be triggered the first time the computing device 105 is initiated. In some embodiments, calibration can be triggered by a controller 180 of the detection and protection system 100. For example, calibration can be triggered before normal operation when audio signals are generated by the audio signal generator 110. In some embodiments, calibration can be triggered (and completed) before audio signals are generated by the audio signal generator 110 for more than threshold period of time.

As shown in FIG. 1, one or more parameters of the speaker 10 can be measured, during calibration and/or during normal operation, using a parameter measurement module 140. The parameter measurement module 140 can be configured to measure a parameter based on a test signal (also can be referred to as a test tone) generated by a test signal generator 120. In some embodiments, the test signal can be a relatively low frequency signal that, for example, may not be discernible by (audible to) a human ear. In some embodiments, the test signal can have a frequency less than or equal to 10 Hertz (Hz) (e.g., 4 Hz, 2 Hz). In some embodiments, the test signal can have a frequency greater than 10 Hz (e.g., 15 Hz, 30 Hz). In some embodiments, the parameter measurement module 140 can include various types of filtering modules (e.g., analog filtering modules, digital filtering modules), analog-to-digital (A/D) converters, digital-to-analog (D/A) converters, and/or so forth. More details related to implementations of the parameter measurement module are described below.

During normal operation, an audio signal produced by the audio signal generator 110 can be combined using a combination circuit 115 with a test signal produced by the test signal generator 120. The combination of the audio signal the test signal can be used by the speaker driver 135 to drive the speaker 10 to produce sound. The parameter measurement module 140, during normal operation, can be configured to filter (e.g., filter at least a portion of, separate) the test signal from the audio signal so that a value of a parameter can be measured and used to calculate a temperature of the speaker 10. Accordingly, the value of the parameter caused by (substantially caused by) the test signal (rather than the audio signal) can be measured and used to calculate the temperature of the speaker 10. The value of the parameter caused by the test signal can be used to calculate the temperature of the speaker 10, because the calibration value of the parameter is based on the same test signal (as a baseline). More details related to components of the parameter measurement module 140 are described below.

Although described in connection with a speaker 10, in some embodiments, the detection and protection system 100 shown in FIG. 1 can be adapted to calculate a temperature of any type of component. A temperature of a component that is monitored using a detection and protection system can be referred to as a monitored component or as a monitored load. In some embodiments, the monitored component can be, for example, a metal oxide semiconductor field effect transistor (MOSFET) device, a light emitting diode (LED), a micro-electromechanical machine (MEM) device (e.g., an accelerometer), and/or so forth.

Specifically, the detection and protection system 100 and shown in FIG. 1 can be adapted to calculate a temperature of any type of monitored component where the temperature of the monitored component may not be directly measured in a desirable fashion (e.g., in an efficient fashion) and/or where the monitored component has a known or characterized temperature coefficient. Although most of the description included herein is related to a speaker (or portions thereof), the concepts can be associated with any type of monitored component. Additional monitored components used in conjunction with a detection and protection system are discussed in connection, for example, with FIGS. 15 and 16.

In some implementations, a sub-audio tone is used to measure resistance and a resistance value is used to measure voice coil temperature of the speaker. In some implementations, a temperature calibration is used at startup (e.g., a cold speaker) to correlate a resistance value to a temperature. This calibration can eliminate a dependency on the absolute value of the speaker resistance. In some implementations, a set threshold for a maximum temperature is based on the temperature coefficient of the voice coil.

In some implementations, a voice coil temperature estimation and protection is obtained using only a current measurement and an initial temperature calibration. In some implementations, the architecture requires no information of the speaker characteristics other than maximum voice coil temperature before the speaker is damaged. In some implementations, a measurement can use sub-audio tone and filtering to remove audio signal from the current measurement estimation. In some implementations, temperature calibration is obtained via an on-chip temp sensor and making an initial measurement of the speaker current (when there is no audio signal present).

In some implementations, a temperature sensor is used on an integrated circuit (IC) together with a resistance measurement scheme to calculate the temperature of the voice coil. In some implementations, the system is composed of a programmable gain/attenuation stage used to either increase or decrease the gain depending on the speaker temperature. In some implementations, a test tone is added after the attenuation stage and is used for testing the speaker impedance. In some implementations, the speaker driver has a current sense which is sampled by an ADC to measure the test tone current. In some implementations, the test tone can be isolated by either analog or digital filtering techniques (or both). In some implementations, the power of the signal is estimated using RMS algorithm. In some implementations, a first calibration measure is taken with no audio signal present, and correlated with an on-chip temperature reading.

Figure 2:
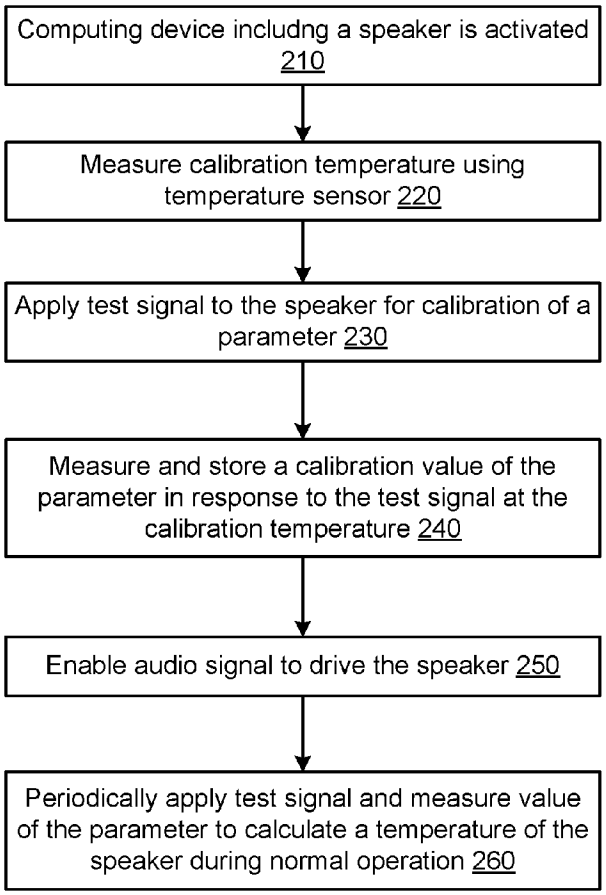
FIG. 2 is a diagram that illustrates a method of operation of a detection and protection system within a computing device.

FIG. 2 is a diagram that illustrates a method of operation of a detection and protection system within a computing device. In some embodiments, the detection and protection system can be similar to the detection and protection system 100 shown in FIG. 1. In this embodiment, blocks 210 through 240 are associated with calibration, and blocks 250 and 260 are associated with normal operation of the computing device.

As shown in FIG. 2, a computing device including a speaker is activated (block 210). In some embodiments, the computing device can be turned on, changed from a standby state to an on state, and/or so forth. In some embodiments, the speaker can be, for example, a micro-speaker. In some embodiments, the computing device can be, for example, a smart phone, a music player, and/or so forth.

A calibration temperature is measured using a temperature sensor (block 220). In some embodiments, the calibration temperature can be measured by the temperature sensor 190 shown in FIG. 1. In some embodiments, the calibration temperature can be at an ambient temperature of the computing device (and the speaker (e.g., a voice coil of the speaker) of the computing device). In some embodiments, the calibration temperature can be a temperature of a surrounding of the speaker that is in relatively close proximity to the speaker of the computing device. In some embodiments, the temperature sensor can be in a location with respect to the speaker so that the temperature sensor can measure the calibration temperature of the speaker with a relatively high certainty (or within a specified threshold value). In some embodiments, the calibration temperature can be measured before an audio signal into the speaker is enabled.

A test signal is applied to the speaker for calibration of a parameter (block 230). In some embodiments, the test signal can be produced by the test signal generator 120 shown in FIG. 1, and can be triggered by the controller 180 shown in FIG. 1. In some embodiments, the test signal can be a relatively low frequency test signal.

A calibration value of the parameter is measured and stored in response to the test signal at the calibration temperature (block 240). In some embodiments, the calibration value can be measured using the parameter measurement module 140 shown in FIG. 1. In some embodiments, the parameter can be, for example, a root-mean-square (RMS) current, an impedance, and/or so forth.

In some embodiments, the calibration value of the parameter can be adjusted for heating that can be caused by the test signal through at least a portion of the speaker. In some embodiments, heating caused by the test signal can be referred to as self-heating.

In some embodiments, the calibration value of the parameter measured at the calibration temperature using the test signal can be used to define a temperature relationship. The temperature relationship can be later used, during normal operation, to calculate a temperature of the speaker as the speaker is driven in response to one or more audio signals.

As shown in FIG. 2, an audio signal to drive the speaker is enabled (block 250). In some embodiments, the audio signal can be triggered by, for example, a music player of the computing device. In some embodiments, normal operation of the computing device can commence when the audio signal to drive the speaker is enabled.

After the audio signal to drive the speaker is enabled, the test signal is periodically applied and values of the parameter to calculate a temperature of the speaker during normal operation (block 260). The temperature of the speaker can be periodically calculated by the temperature calculator 170 shown in FIG. 1 in response to an instruction from the controller 180 shown in FIG. 1. In some embodiments, the temperature of the speaker can be calculated based on a temperature relationship. In some embodiments, an increase in a temperature of the speaker can be calculated based on a value of the parameter, and the increase in temperature can be added to the calibration temperature to calculate an absolute temperature of the speaker. In some embodiments, the test signal can be combined with an audio signal during normal operation to drive the speaker. Accordingly, values of the parameter can be measured during normal operation by filtering (e.g., separating) the test signal from the audio signal. In some embodiments, the filtering can be performed by analog and/or digital filtering techniques.

In some embodiments, a temperature of the speaker can be measured during normal operation on a continuous basis. In some embodiments, a temperature of the speaker can be measured during normal operation (based on a measured value of the parameter in response to the test signal) based on a predefined interval. For example, the temperature of the speaker can be measured during a predefined time period (which can be referred to as a measurement time period) (e.g., a 1 second time period, a 6 second time period) at a predefined time interval (e.g., every 2 minutes, every 60 seconds). In some embodiments, the temperature of the speaker can be measured during normal operation on a random basis. In some embodiments, the temperature of the speaker can be measured based on a gain level applied (e.g., applied by the volume control module 130 shown in FIG. 1) to one or more audio signals produced by an audio signal generator (e.g., the audio signal generator 110 shown in FIG. 1).

Figure 3:
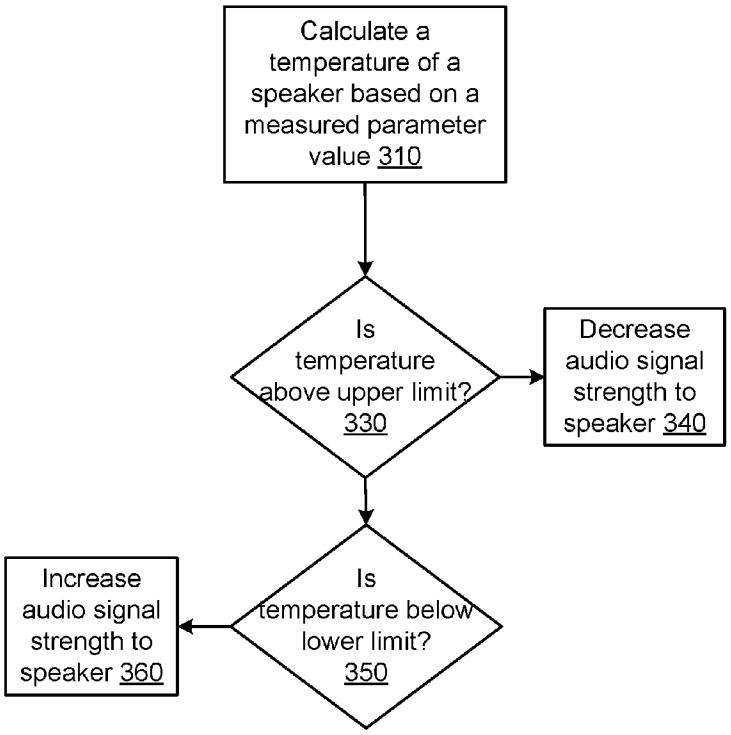
FIG. 3 is a flowchart that illustrates a method for audio signal adjustment in response to a temperature of a speaker.

As described above, an audio signal to the speaker can be increased or decreased based on the temperature of the speaker that is measured during normal operation based on a measured value of the parameter value in response to a test signal. FIG. 3 is a flowchart that illustrates audio signal adjustment based on speaker temperature.

FIG. 3 is a flowchart that illustrates a method for audio signal adjustment in response to a temperature of a speaker. In some embodiments, at least some portions of the method shown in FIG. 3 can be performed by the components of the detection and protection system 100 shown in FIG. 1.

As shown in FIG. 3, a temperature of a speaker is calculated based on a measured parameter value (block 310). In some embodiments, the temperature can be measured during normal operation after calibration of the parameter value at a calibration temperature has been determined. In some embodiments, a temperature increase can be calculated, based on the measured parameter value, and then added to the calibration temperature to calculate the temperature of the speaker.

As shown in FIG. 3, if the temperature is above an upper limit (block 330), an audio signal strength (e.g., amplitude) to the speaker is decreased (block 340). In some embodiments, the upper limit can be referred to as an upper temperature threshold limit. In some embodiments, the audio signal strength can be decreased in response to multiple different upper limits.

As shown in FIG. 3, if the temperature is below a lower limit (block 350), an audio signal strength (e.g., amplitude) to the speaker is increased (block 360). In some embodiments, the lower limit can be referred to as a lower temperature threshold limit. In some embodiments, the audio signal strength can be increased in response to multiple different lower limits.

Figure 4:
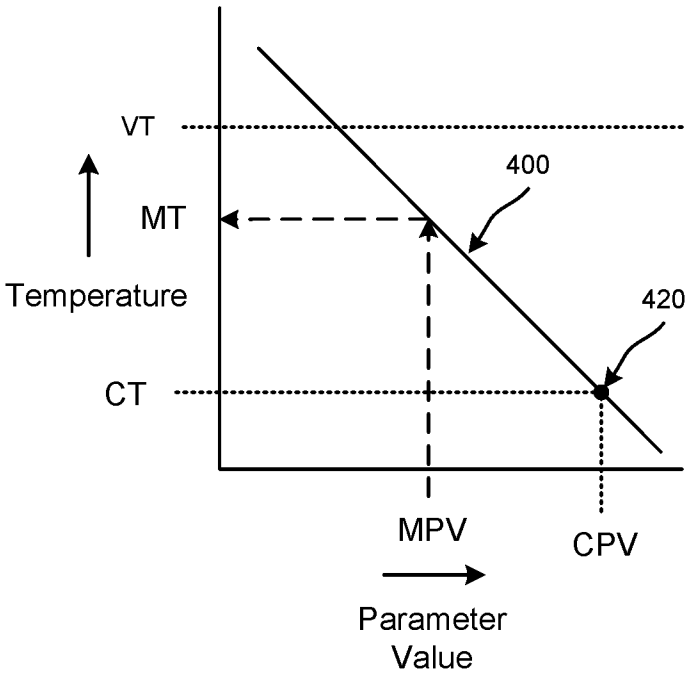
FIG. 4 is a graph that illustrates a relationship that can be used to calculate a temperature of a speaker during normal operation.

FIG. 4 is a graph that illustrates a relationship 400 that can be used to calculate a temperature of a speaker during normal operation. In this graph, temperature is shown on the y-axis, and a parameter value is shown on the x-axis. In some embodiments, the parameter value can be, for example, a value of a current through a coil of the speaker, an impedance measurement associated with the speaker, and so forth.

As shown in FIG. 4, the relationship 400 is through calibration point 420. The calibration point 420 is based on a calibration temperature CT (e.g., a calibration temperature measured by the temperature sensor 190 shown in FIG. 1) and a calibration value of the parameter CPV (e.g., a calibration of the parameter measured by the parameter measurement module 140 based on a test signal produced by the test signal generator 120 shown in FIG. 1).

As shown in FIG. 4, a temperature MT can be calculated (during normal operation) based on a measured parameter value MPV using the relationship 400. In some embodiments, the measured parameter value MPV can be measured in response to a test signal, which can be combined with an audio signal. In this embodiment, because the measured temperature value is less than a threshold temperature VT, attenuation of the audio signal may not be performed. In some embodiments, the threshold temperature VT can be based on a temperature at which damage to the speaker may occur.

Figure 5:
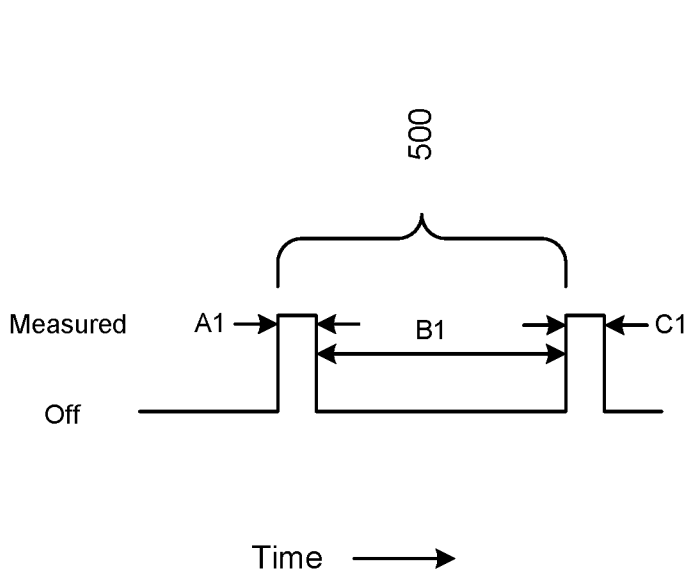
FIG. 5 is a graph that illustrates a measurement cycle related to measurement of a temperature of a speaker, according to an embodiment.

FIG. 5 is a graph that illustrates a measurement cycle 500 related to measurement of a temperature of a speaker, according to an embodiment. In some embodiments, the measurement cycle 500 shown in FIG. 5 can be triggered after calibration of a parameter used for measuring the temperature of the speaker has been performed. In this embodiment, a temperature measurement of the speaker is performed during a measurement time period A1 at the beginning of the measurement cycle 500. As shown in FIG. 5, a measurement time period C1, which is associated with a measurement cycle separate from the measurement cycle 500, is triggered after a time interval B1 (e.g., a non-measurement time period). In some embodiments, a power consumption due to calculation of the temperature can be decreased by measuring the temperature periodically rather than continuously.

Figure 6:
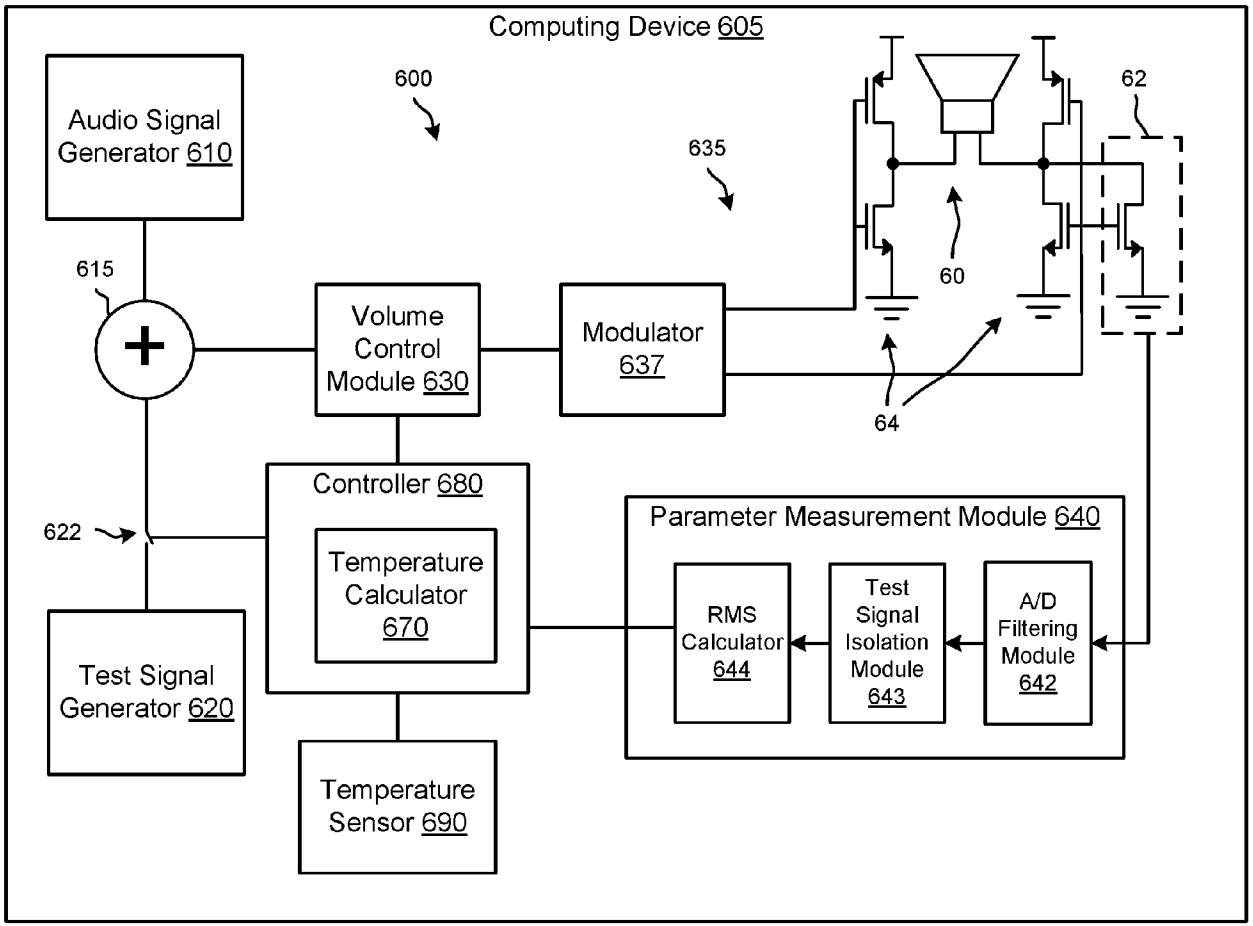
FIG. 6 is a block diagram that illustrates a detection and protection system, according to an embodiment.

FIG. 6 is a block diagram that illustrates a detection and protection system 600, according to an embodiment. As shown in FIG. 6, a speaker driver 635 includes output stages 64 coupled to a modulator 637. The output stages 64 include metal oxide semiconductor field effect transistor (MOSFET) devices. The modulator 637 is coupled, via a combination circuit 615, to a volume control module 630 configured to receive an audio signal produced by an audio signal generator 610 and/or to a test signal produced by a test signal generator 620. In this embodiment, one of the output stages 64 is coupled to a current sense MOSFET device 62 (which can be configured to mirror current flow through one or more of the output stage is 64) that can be used by the parameter measurement module 640 to measure (e.g., detect) a current of the speaker 60 (e.g., into a coil of the speaker 60). In some embodiments, multiple current sense MOSFET devices 62 can be used by the parameter measurement module 640 to measure a current of the speaker 60.

During calibration, the test signal generator 620 can be configured to produce a test signal that is received at the speaker 60 via the speaker driver 635. The controller 680 can be configured to control sending of the test signal to the speaker 60 via a switch 622 coupled to the test signal generator 620. The parameter measurement module 640 can be configured to measure a calibration current through the speaker 60 at a calibration temperature, which is measured by a temperature sensor 690. The calibration current and the calibration temperature can be used in a temperature relationship to calculate a temperature of the speaker 60 during normal operation.

If calculating a temperature of the coil of the speaker 60, the temperature relationship can have the following form:

$$\Delta T=(I_{Calibration}/I_{Measured})-1)/\alpha,$$

where $\alpha$ is the temperature coefficient (e.g., copper temperature coefficient) of a coil of the speaker 60. $I_{calibration}$ can be a current through the coil of the speaker 60 at a calibration temperature and $I_{measured}$ can be a current through the coil of the speaker 60 during normal operation. $\Delta T$ can be added to the calibration temperature to calculate an absolute temperature of the coil of the speaker 60. This temperature relationship can be derived from the following relationship:

$$R=R_{Nominal@calibrationT}*(1+\Delta T\alpha),$$

where $R_{Nominal@calibrationT}$ is the resistance of the coil of the speaker 60 at the calibration temperature.

As shown in FIG. 6, the parameter measurement module 640 includes an analog-to-digital (A/D) filtering module 642 that can be configured to convert a current measured via the current sense MOSFET device from an analog signal to a digital signal. The test signal isolation module 643 can be configured to filter a test signal encoded within the digital signal from an audio signal also encoded within the digital signal. The RMS calculator 644 can be configured to calculate (e.g., estimate) a root mean square (RMS) current (or power) associated with the test signal. The RMS current can be used by the temperature calculator 670 to calculate a temperature associated with the speaker 60.

Referring back to FIG. 1, in some embodiments, one or more of the components included in the detection and protection system 100 can be synchronously clocked. In other words, several of the components included in the detection of protection system 100 (such as the components shown in FIG. 6) can be configured to operate based on a clock signal produced by a single oscillator. For example, one or more components of the parameter measurement module 140 can be configured to operate based on a clock signal (or derivative thereof) that is also used by the test signal generator 120 to produce a test signal. Because the test signal generator 120 can be configured to produce a test signal based on the same clock signal (or derivative thereof) as that used by the parameter measured module 140, the parameter measurement module 140 can be configured to more efficiently measure values of parameters triggered by the test signal than if the test signal generator 120 and the parameter measurement module 140 were configured to operate based on different clock signals. More details related to synchronous clocking within a detection of protection system are described in connection FIG. 7.

Figure 7:
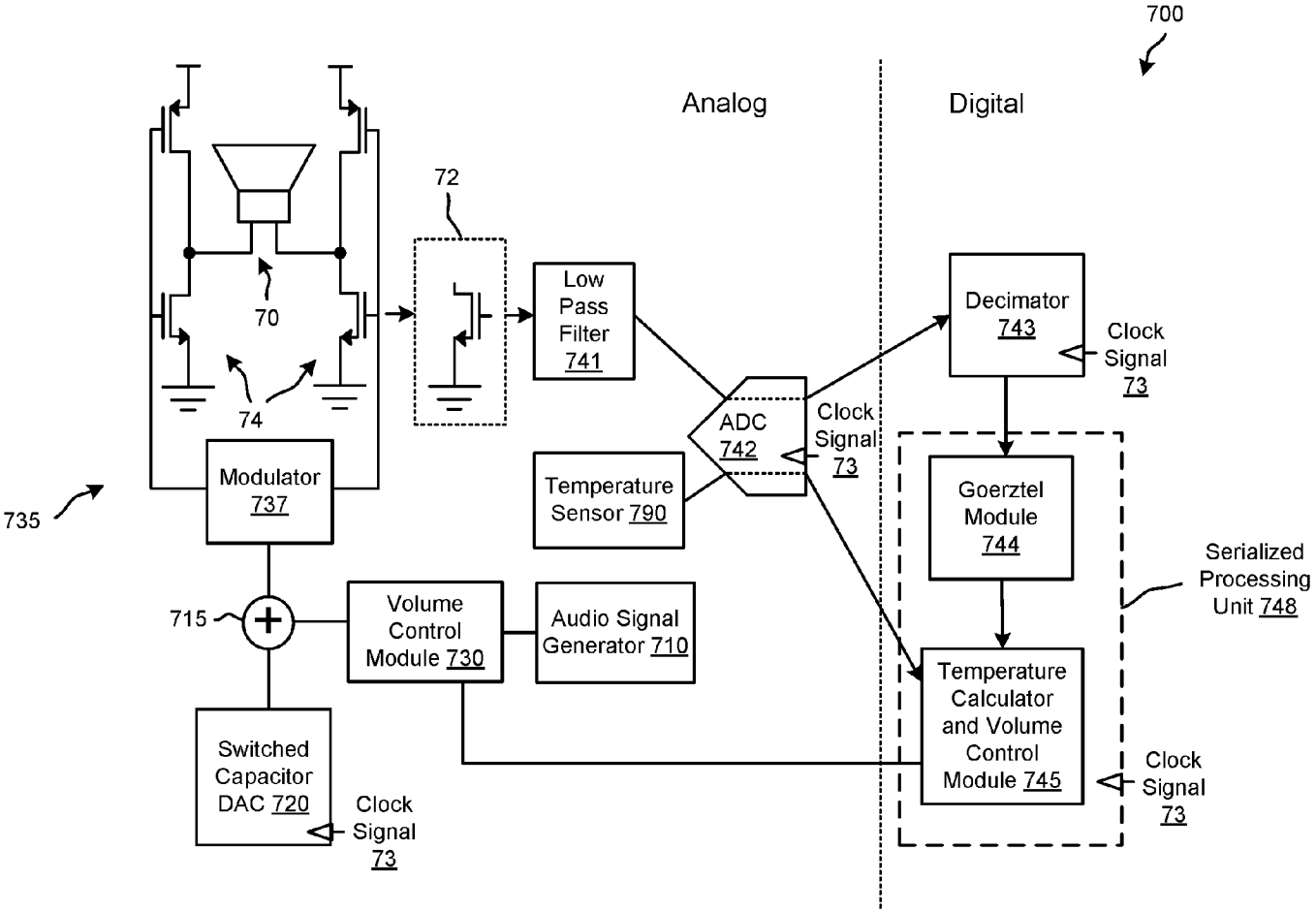
FIG. 7 is a block diagram that illustrates another detection and protection system, according to an embodiment.

FIG. 7 is a block diagram that illustrates another detection and protection system 700, according to an embodiment. As shown in FIG. 7, the detection and protection system 700 includes a combination of analog and digital components. At least some of the analog components are illustrated on an analog side of the detection of protection system 700, and digital components of the detection and protection system 700 are shown on the digital side. In some embodiments, the digital components of the detection and protection system 700 can be configured to perform processing based on binary values including several bits (e.g., 4-bit values, 8-bit values, 16-bit values).

As shown in FIG. 7, a speaker driver 735 includes output stages 74 coupled to a modulator 737. The output stages 74 include metal oxide semiconductor field effect transistor (MOSFET) devices. The modulator 737 is coupled, via a combination circuit 715, to a volume control module 730 configured to receive an audio signal produced by an audio signal generator 710 and/or to a test signal produced by a switched capacitor DAC 720. In this embodiment, one of the output stages 74 is coupled to a current sense MOSFET device 72 that can be used to measure (e.g., detect) a current of the speaker 70 (e.g., into a coil of the speaker 70). In some embodiments, multiple current sense MOSFET devices 72 can be used to measure a current of the speaker 70.

During calibration, the switched capacitor DAC 720 can be configured to produce a test signal that is received at the speaker 70 via the speaker driver 735. The controller 780 can be configured to control sending of the test signal to the speaker 70 via a switch 722 coupled to the switched capacitor DAC 720. A calibration current through the speaker 70 can be measured at a calibration temperature, which can be measured by a temperature sensor 790. The calibration current and the calibration temperature can be used in a temperature relationship to calculate a temperature of the speaker 70 during normal operation.

Several components included in the detection and protection system 700 shown in FIG. 7 can be configured to collectively measure a parameter, such as a current, associated with the speaker 70 and can be configured to calculate a temperature of the speaker 70. At least some of the components that can be used to measure a parameter and calculate a temperature can include a low-pass filter 741, and A/D converter (ADC) 742, a decimator 743, a Goerztel module 744, a temperature calculator and volume control module 745, and so forth. In some embodiments, the temperature calculator and volume control module 745 can include multiple sub-modules (not shown) such as a startup calibration module configured to handle processing of values (e.g., temperature values, parameter values) related to calibration, a parameter tracking module configured to handle processing of parameter values related to normal operation, and/or so forth.

In this embodiment, the ADC 742 is a multiplexed ADC configured to define different processing paths during calibration and during normal operation. The processing path used during calibration can be referred to as a calibration path (or as a calibration processing path) and the processing path used during normal operation can be referred to as a normal operation path (or as a normal operation processing path).

The ADC 742 is configured to define a calibration path that includes a temperature sensor 790 and the temperature calculator and volume control module 745. Specifically, the ADC 742 is configured to receive a calibration temperature from a temperature sensor 790 during calibration (e.g., during the calibration time period). The ADC 742 is configured to send the calibration temperature to a temperature calculator and volume control module 746. Based on the calibration temperature, the temperature calculator and volume control module 746 can be configured to define a temperature relationship that can be used during normal operation to calculate a temperature associated with the speaker 70.

During normal operation, the ADC 742 is configured to define a normal operation path that includes the low-pass filter 741, the decimeter 743, the Goertzel module 744, and the temperature calculator and volume control module 746. Specifically, the ADC 742 is configured to receive a value of a parameter from the low-pass filter 741, and is configured to send the value of the parameter to a decimator 743. In some embodiments, the decimator 743 can be a cascaded integrated comb (CIC) filter (e.g., a second order CIC) configured to perform at least some test signal isolation (from an audio signal produced by the audio signal generator 710). In some embodiments, a different type of filter such as type of finite impulse response filter can be used in conjunction with, or in place of, the decimator 743. After being processed by the decimator 743, the value of the parameter is process by the Goerztel module 744, which is a narrowband filtering module, and then by the temperature calculator and volume control module 746. In some embodiments, a different type of narrow band filtering module can be used in conjunction with, or place of the Goertzel module 744.

As described above, the ADC 742 is multiplexed to define different processing paths during calibration and during normal operation. Because the ADC 742 is used during multiple modes of operation (which can be used during different or mutually exclusive time periods), the detection and protection system 700 can be produced using less circuitry space (e.g., less semiconductor die area) than if two separate ADC components (which can be configured operate in parallel) were respectively implemented in the calibration path and the normal operation path. The ADC 742 can be configured so that processing can be compatibly performed even though the calibration temperature measured by the temperature sensor 790 may be different parameter than a parameter received via the low-pass filter 741. In some embodiments, the temperature sensor 790 and the low-pass filter 741 can be configured to define voltages that can be compatibly processed by the ADC 742. As a specific example, the temperature sensor 790 can be configured to produce a voltage representing a temperature that can be processed by the ADC 742, and the low-pass filter 741, if measuring a current, can be configured to produce a voltage representing the current that can be processed by the ADC 742. An example implementation of the ADC 742 is shown in FIG. 8.

In some implementations, use of synchronous clocks can ensure narrowband filtering is possible at the receiver. In some implementations, use of a multiplex SAR can enable both temperature and current measurement reducing die size. In some implementations, use of Goertzel algorithm in conjunction with a CIC decimation perform an efficient narrow band filter. In some implementations, serialized processing operations enable low-cost hardware implementation (e.g. only one multiplier is needed). In some implementations, a temperature measurement scheme that uses synchronous tone generation and detection method can enable compact design with efficiency use of Geortzel algorithm to achieve a narrow band tone receiver. In some implementations, a highly oversampled system enable serial processing of entire algorithm, reducing hardware costs to a very small amount. The oversampled nature of the system enables serialized processing of current signal, reducing hardware costs through reuse (multiplier, adders and barrel shifters. In some implementations, a multiplex SAR converter for temperature measurement scheme can be implemented, whereby the same ADC is used for reading the temperature sensor and the current in the load. In some implementations, use of a sampled data triangle waveform can be implemented to produce a sub-audio test tone for temperature measurement system.

Figure 8:
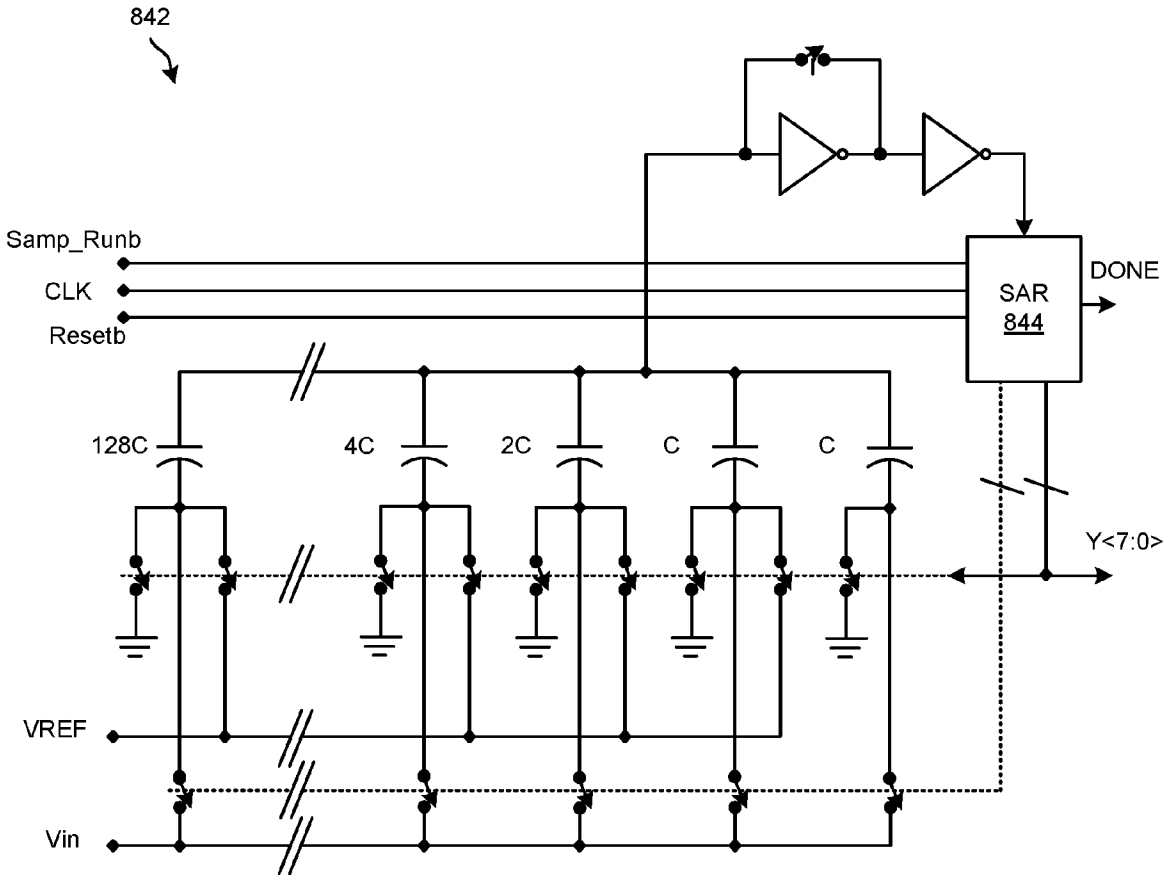
FIG. 8 is a diagram that illustrates an example of an analog-to-digital converter (ADC) that can be used in a detection and protection system.

FIG. 8 is a diagram that illustrates an example of an analog-to-digital converter (ADC) 842 that can be used in a detection and protection system (e.g., the detection and protection system 700 shown in FIG. 7). As shown in FIG. 8, the ADC 842 can be a multiplexed ADC that can include a successive approximation register (SAR) 844, and can be an 8-bit processing unit configured to produce an 8-bit output value Y. The ADC 142 can be configured to receive a clock signal CLK and a reference voltage VREF.

Referring back to FIG. 7, the low-pass filter 741 can be configured to separate at least some portions of an audio signal produced by the audio signal generator 710 from a test signal produced by the switched capacitor DAC 720. In other words, the low-pass filter 741 can be configured to remove at least some portions of the audio signal (which can be a relatively high-frequency compared with a test signal) produced by the audio signal generator 710. In some embodiments, the low-pass filter 741 can be configured to remove at least some portions of the audio signal so that the ADC 742 can operate more efficiently, or can be simplified more, then if the audio signal were not filtered by the low-pass filter 741. An example implementation of the low-pass filter 741 is shown in FIG. 9.

In some implementations, the SAR ADC can be multiplexed between the current measurement and integrate temperature sensor. In some implementations, a multiplex ADC can be used in conjunction with temperature sensor and data path for temperature measurement system.

Figure 9:
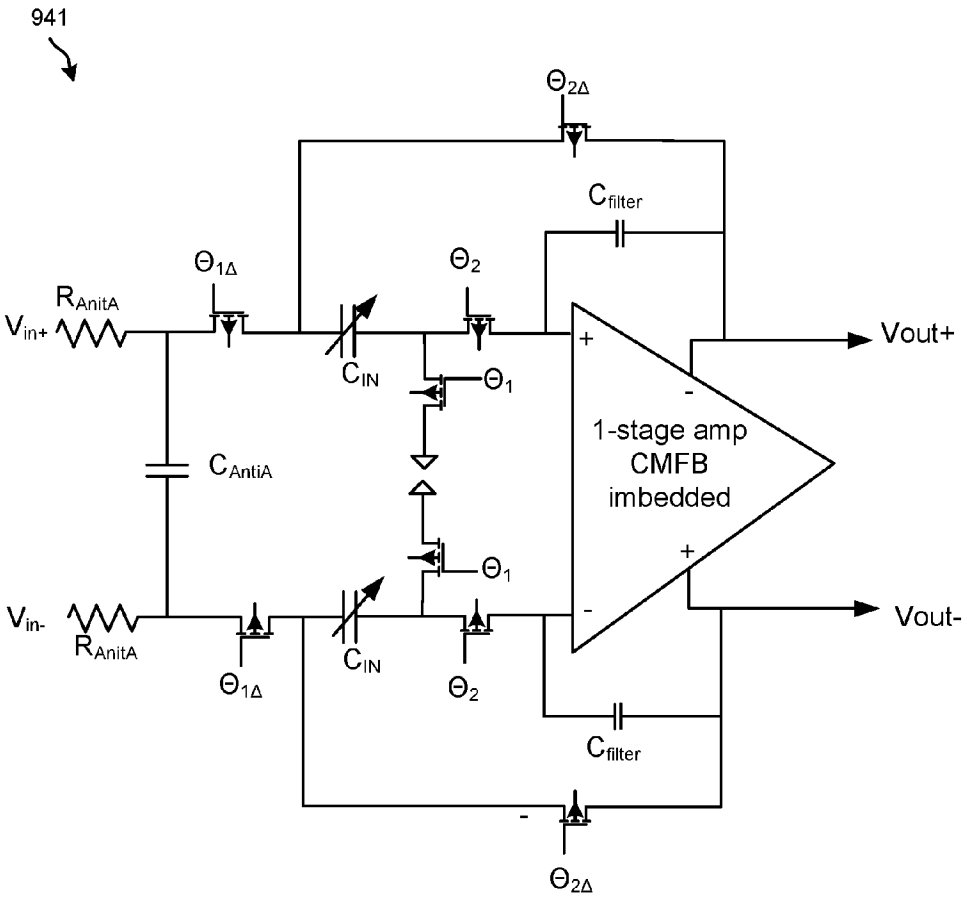
FIG. 9 is a diagram that illustrates an example of a low-pass filter that can be used in a detection and protection system.

FIG. 9 is a diagram that illustrates an example of a low-pass filter 941 that can be used in a detection and protection system (e.g., the detection and protection system 700 shown in FIG. 7). As shown in FIG. 9, the low-pass filter 941 can be a resistor-capacitor (RC)/switched-capacitor (SC) low-pass filter. In some embodiments, the low-pass filter 941 can be a programmable low-pass filter. In some embodiments, the low-pass filter 941 can be configured to attenuate the signal into a class D amplifier (or other class of amplifier) to reduce (e.g., minimize, substantially reduce) noise that can interfere with an audio signal produced by an audio signal generator (e.g., audio signal generator 710 shown in FIG. 7).

In some implementations, an RC filter and an SC filter are used to remove audio signal. This can reduce the requirements of an ADC. In some implementations, filtering can be used in conjunction with temperature measurement system to remove audio signal. In some implementations, a filter can be programmable. In some implementations, a signal can be attenuated into Class D to minimize noise that might interfere with the audio signal. In some implementations, an output can be routed to SAR ADC through a multiplexer.

Referring back to FIG. 7, the switched capacitor DAC 720 can be a digitally-controlled DAC that is configured to produce a test signal that has a triangular (e.g., sawtooth) waveform. In other words, the switch capacitor DAC 720 can be configured to produce a test signal that has a triangular waveform rather than a sinusoidal waveform. In some embodiments, the switch capacitor DAC 720 can be configured to produce a sampled-data triangle waveform. An example implementation of the switched capacitor DAC 720 is shown in FIG. 10.

Figure 10:
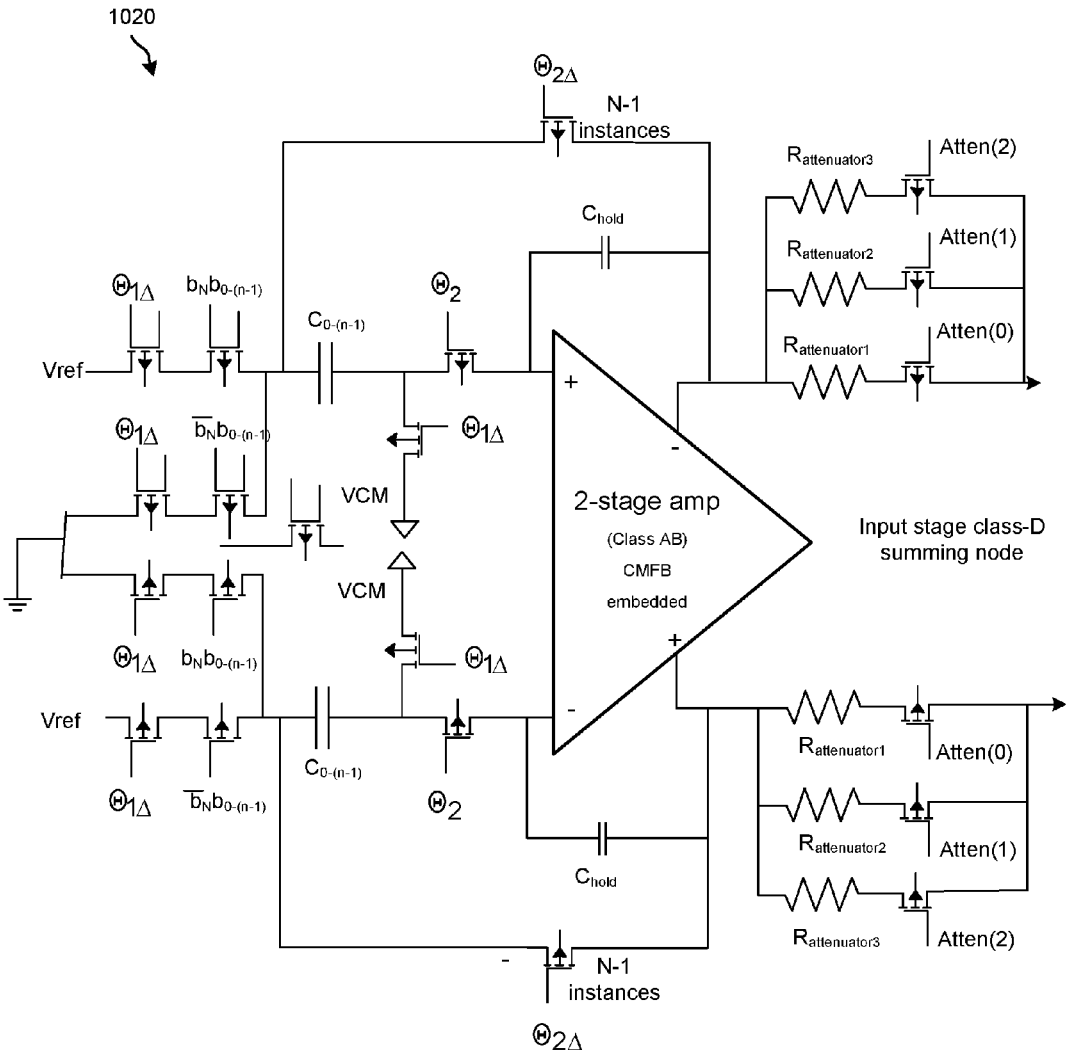
FIG. 10 is a diagram that illustrates an example of a switched capacitor digital-to-analog converter (DAC) that can be used in a detection and protection system.

FIG. 10 is a diagram that illustrates an example of a switched capacitor DAC 1020 that can be used in a detection and protection system (e.g., the detection and protection system 700 shown in FIG. 7). As shown in FIG. 10, the switched capacitor DAC 1020 has a single-sampled capacitor architecture. The architecture of the switched capacitor DAC 1020 can have relatively low thermal sampled noise (so that op-amp noise may not be sampled). In some embodiments, the switched capacitor DAC 1020 can be configured so that a gain of the switch capacitor DAC 1020 is stable (e.g., does not change, is relatively constant) with respect to changes in temperature. In some embodiments, the switched capacitor DAC 1020 can be configured to produce a sub-audio a test signal (e.g., a 2 Hz test signal, a 4 Hz test signal, a 10 Hz test signal).

In some implementations, a tone generator can be a Switched Capacitor (SC) DAC. In some implementations, a DAC is controlled by digital to produce a sampled-data triangle wave. In some implementations, a signal is attenuated into Class D to minimize noise that might interfere with the audio signal. In some implementations, SC tone generation can be used in conjunction with temperature measurement system. In some implementations, a single sampled-capacitor architecture can be used which reduces thermal sampled noise (op-amp noise is not sampled). In some implementations, a DAC can be controlled by digital to produce a sampled-data triangle wave.

Referring back to FIG. 7, the Goertzel module 744 and the temperature calculator and volume control module 745 define at least a portion of a serialized processing unit 748. Because the processing performed by the Goertzel module 744 and the temperature calculator and volume control module 745 define a serialized processing unit 748, at least some portions of the serialized processing unit 748 can be efficiently used. For example, a single multiplier (not shown) included in the serialized processing unit 748 can be used by the Goertzel module 744 and by the temperature calculator and volume control module 745. In some embodiments, adders, barrel shifters, and/or so forth can be used (and reused) by various components included in the serialized processing unit 748. In some embodiments, serialization performed by the serialized processing unit 748 can be enabled by oversampling performed by the detection and protection system 700. In some embodiments, additional modules (such as the decimator 743) can be included in or some modules can be excluded from the serialized processing unit 748.

In some embodiments, several of the components included in the detection and protection system 700 can be configured to operate based on a common reference voltage. For example, in some embodiments, the switch capacitor DAC 720 and the ADC 742 can be configured to operate based on a common reference voltage. Because the components included in the detection of protection system 700 can be configured operate based on a common reference voltage, the components included in the detection and protection system 700 can be configured to operate in a consistent and stable fashion even with shifts in, for example, temperature, the reference voltage (e.g., shifts in the reference voltage due to temperature, etc.).

In some embodiments, the volume control module 730 can be configured to trigger an increase or decrease in an audio signal produced by the audio signal generator 710. In some embodiments, the volume control module 730 can be configured to trigger an increase or decrease in response to a signal (e.g., an instruction) from the temperature calculator and volume control module 725. In some embodiments, changes to the audio signal can be performed in discrete increments (e.g., 0.1 dB steps, 0.5 dB steps, 1 dB steps) within a predefined range (e.g., 0 dB to −32 dB, 20 dB to −20 dB) triggered by, for example, a 6-bit control signal.

As shown in FIG. 7, a common clock signal 73 is used to synchronously trigger processing performed by various components of the detection and protection system 700. Specifically, as shown in FIG. 7, the switched capacitor DAC 720, the ADC 742, the decimator 743, and the serialized processing unit 748 are configured to operate based on the clock signal 73. Because several components of the detection and protection system 700 are configured to synchronously operate based on the clock signal 73, the decimator 743 and the Goertzel module 744 are configured to perform narrowband filtering more efficiently than if the components included in the detection and protection system 700 operated asynchronously (or on different clock signals).

In some embodiments, if the components of the detection and protection system 700 are asynchronous (operate on different clock signals rather than synchronously on the clock signal 73) narrowband filtering performed by the decimator 743 and/or the Goertzel module 744 may not be performed at all, or may not be performed in a desirable fashion. Specifically, filtering may be performed using band-pass filtering modules rather than narrowband filtering modules when the components of the detection and protection system 700 are configured to operate asynchronously.

In some embodiments, at least some of the components of the detection of protection system 700 can be configured to multiply or divide down the clock signal 73. For example, if the clock signal 73 is a 2 MHz clock signal, the ADC 742 can be configured to operate based on 156 kHz, which is divided down from the 2 MHz clock signal. Similarly, the decimator 743 can be configured to operate based on approximately a 73 Hz clock signal, which can be divided down from a 2 MHz clock signal.

Figure 11:
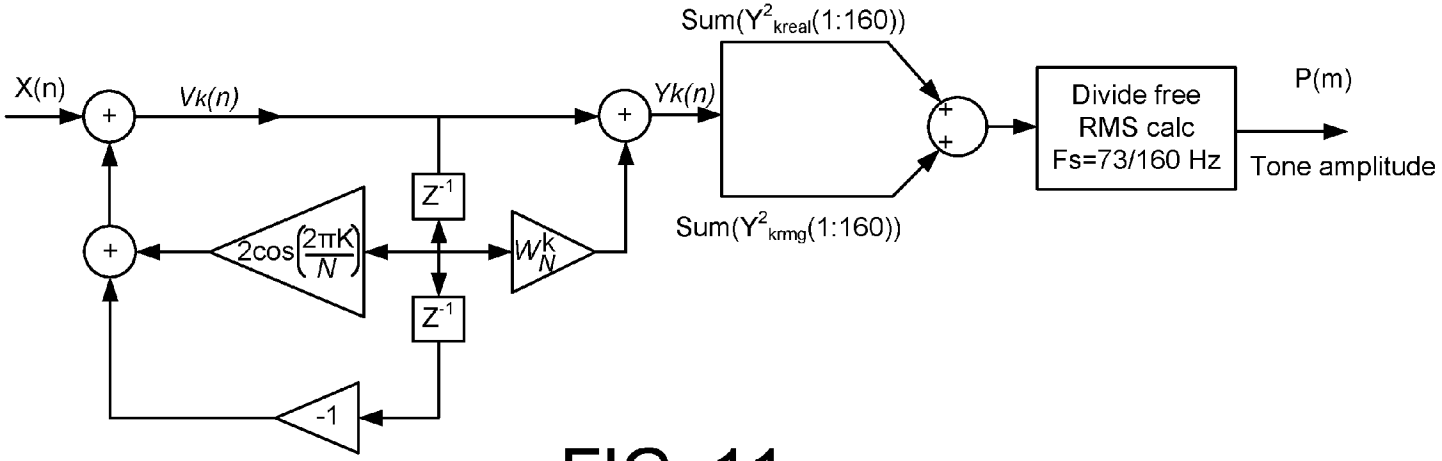
FIG. 11 is a diagram that illustrates an example of signal processing performed by a Goertzel algorithm.

FIG. 11 is a diagram that illustrates an example of signal processing performed by a Goertzel algorithm (e.g., the Goertzel module 744 shown in FIG. 7). In some embodiments, the Geortzel algorithm can be a serially performed computation within the Goertzel module 744 shown in FIG. 7. In some embodiments, multiplication performed based on this Goertzel algorithm can be performed using a single 8-bit multiplier. The Goertzel algorithm can be configured to implement a Discrete Fourier Transform (DFT) as a recursive difference equation. In some embodiments, the difference equation can be established by expressing the DFT as the convolution of an N-point input x(n) with an impulse response of $h(n)=W_N^{-kn}u(n)$, where $$W_N^{-kn} = e^{\frac{-i2\pi k}{N}}$$

and u(n) is the unit step sequence. The z-transform of the impulse response can be expressed as:

$$H(z) = \frac{1 - W_{Nz}^{k} - s}{1 - 2\cos\left(\frac{2\pi k}{N}\right)z^{-1} + z^{-2}}.$$

Figure 12:
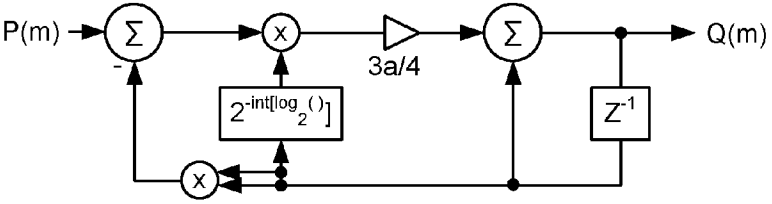
FIG. 12 is a diagram that illustrates a root-mean-square (RMS) algorithm, according to an embodiment.

In some embodiments, the RMS calculation shown in FIG. 11 (or incorporated into other components described herein) can be performed using an RMS algorithm such as that shown in FIG. 12. FIG. 12 is a diagram that illustrates an RMS algorithm that is configured to be performed without a division operation. In this embodiment, the RMS calculation can be performed using multiplication, addition, and bit shifting. Also in this embodiment, the RMS algorithm can be iteratively performed and can be performed within the serialized processing unit 748 shown in FIG. 7.

In some implementations, a Geortzel algorithm can be a serial computation. Serial computation of RMS can be a divide free implementation. In some implementations, a Geortzel algorithm can be used for temperature measurement system. In some implementations, an RMS algorithm can implement only multiplication, addition and bit shifting. In some implementations, an iterative algorithm can be computed serially.

Figure 13:
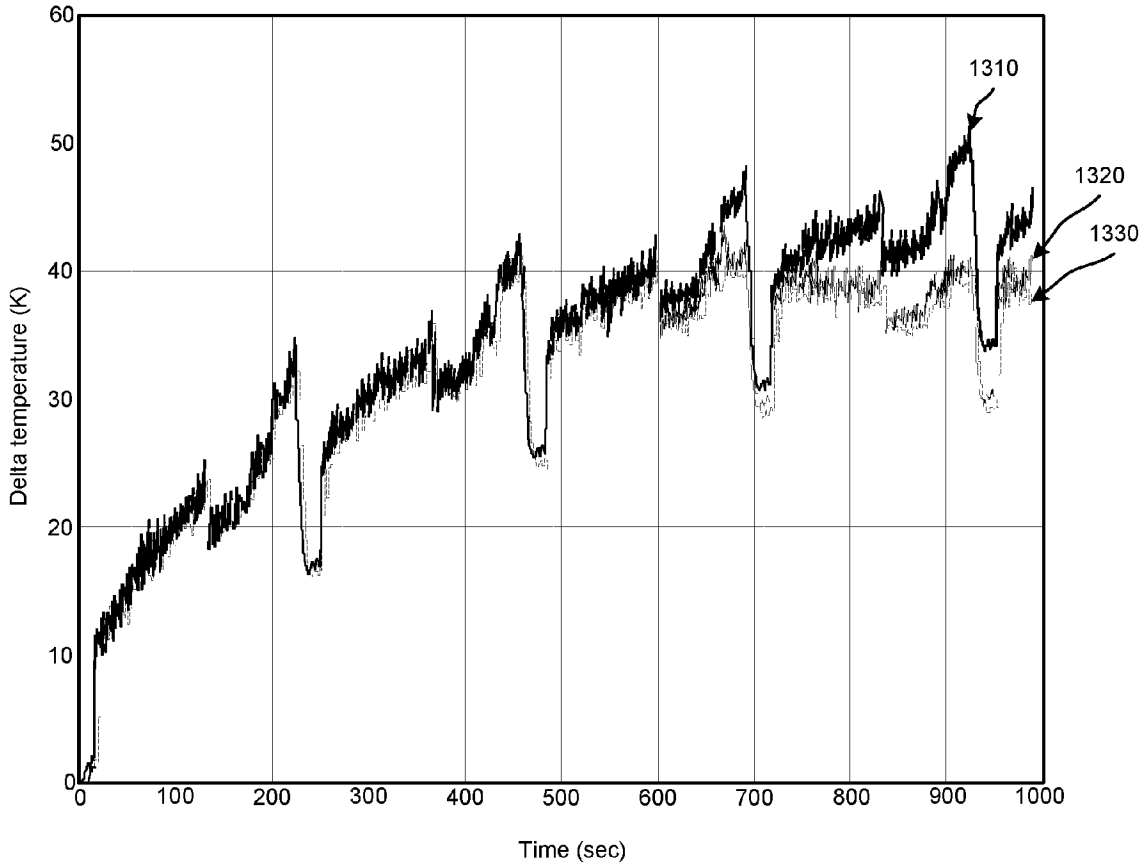
FIG. 13 is a graph that illustrates operation of a detection and protection system, according to an embodiment.

FIG. 13 is a graph that illustrates operation of a detection and protection system, according to an embodiment. FIG. 13 illustrates a temperature change of a monitored component such as a speaker (shown as delta temperature) in Kelvin (K) along a y-axis versus time in seconds along an x-axis.

Curve 1310 in FIG. 13 illustrates a delta temperature increase of the monitored component without detection and protection performed by the detection and protection system. The delta temperature increase of the monitored load as illustrated by the curve 1310 exceeds a delta temperature of 50 K.

As shown in FIG. 13, curve 1320 illustrates the delta temperature increase of the monitored component, under the same conditions used to produce curve 1310, with detection and protection performed by the detection and protection system with a threshold temperature set at a 40 K temperature rise. As shown in FIG. 13, the delta temperature increase of the monitored component is maintained approximately below 40 K. Curve 1330, which approximately tracks with curve 1320, illustrates an estimated delta temperature as calculated using an algorithm.

Figure 14:
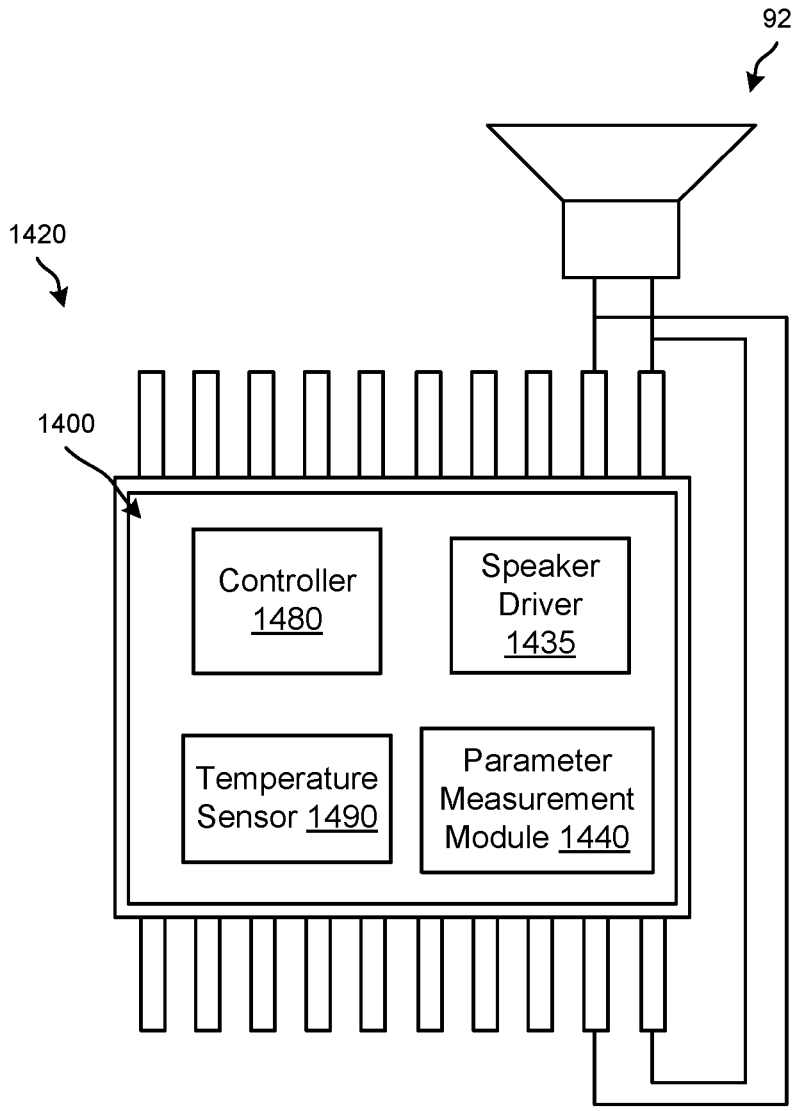
FIG. 14 is a diagram that illustrates at least some portions of a detection and protection system included in an integrated circuit.

FIG. 14 is a diagram that illustrates at least some portions of a detection and protection system 1400 included in an integrated circuit 1420. As shown in FIG. 14, the integrated circuit 1420 is packaged into a module that is coupled to a speaker 92. In some embodiments, the integrated circuit 1420 and the speaker 92 can be included in a computing device or not shown). In this embodiment, the detection and protection system 1400 includes a speaker driver 1435, a parameter measurement module 1440, a controller 1480, and a temperature sensor 1490. Although not shown in FIG. 14, in some embodiments, at least some portions of an audio signal generator, a combination circuit, a test signal generator, and/or so forth can be included in the detection and protection system 1400 integrated into the integrated circuit 1420. Although not shown, in some embodiments, at least some portions of the connection of protection system 1400 may be included in an integrated circuit separate from the integrated circuit 1420.

In some implementations, an application of this technology would be for speaker protection and compensation from thermal effects. In some implementations, during startup, temperature is measured with a known signal driving into a speaker (e.g. sub-audio tone). A baseline DC resistance is measured and subsequently a resistance is tracked during normal audio playing.

Figure 15:
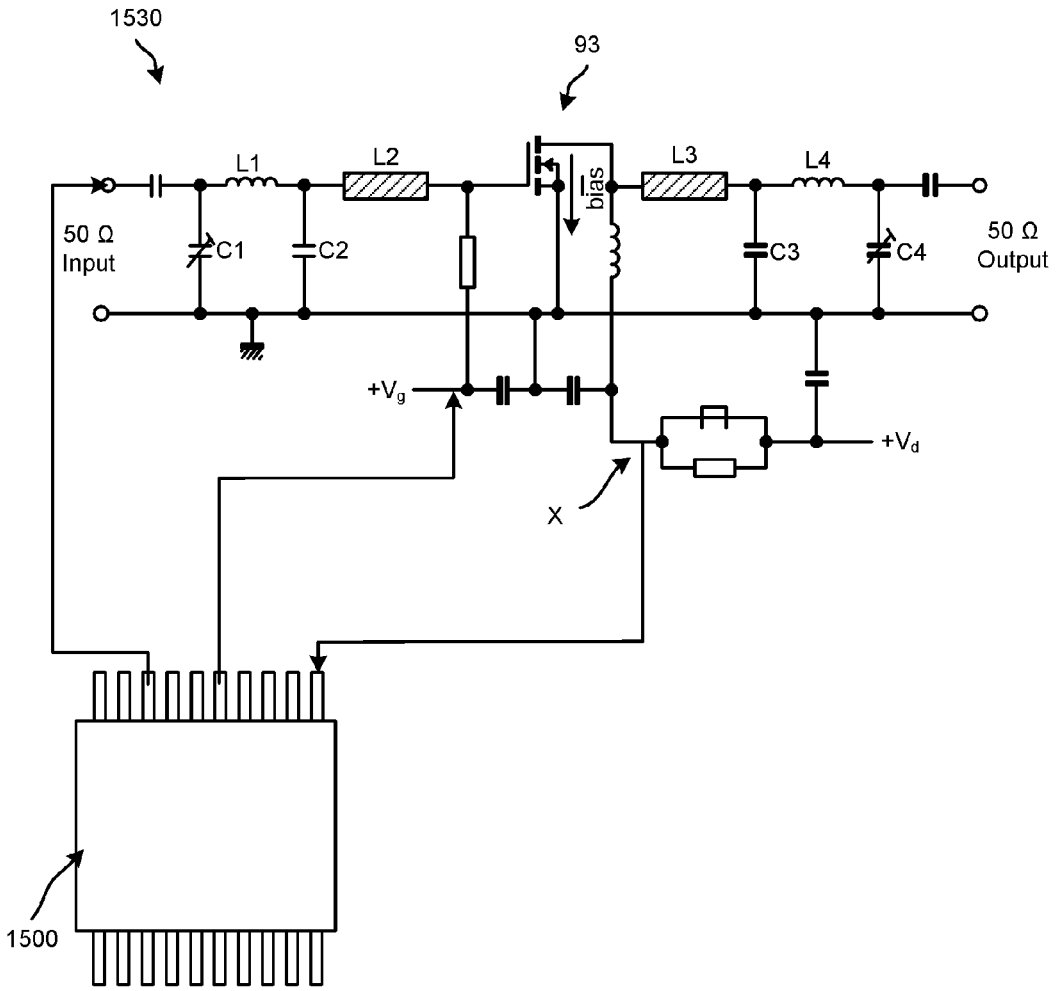
FIG. 15 is a diagram that illustrates a detection and protection system coupled to a radio frequency (RF) power transistor system.

FIG. 15 is a diagram that illustrates a detection and protection system 1500 coupled to (e.g., monitoring) a radio frequency (RF) power amplifier 1530. In this embodiment, the components of the detection and protection system 1500 are not explicitly illustrated. In this embodiment, the monitored component within the RF power amplifier 1530 can be transistor 93. Accordingly, the detection and protection system 1500 can be configured to calculate a temperature of a transistor 93 based on a voltage at node X during normal operation based on calibration of a parameter with respect to the transistor 93 during a calibration time period (using a temperature sensor). A temperature relationship (which can be used during normal operation to calculate a temperature) related to the transistor 93 can be based on a temperature coefficient of the transistor 93. In some embodiments, the calibration of the parameter can be performed using remote temperature sensing while the transistor 93 is in either a low-power or known condition. In some embodiments, amplifier, pre-drive stages, and/or so forth, associated with the RF power amplifier 1530 can be integrated with the detection and protection system 1500. In this embodiment, adjustment of a gate voltage related to the transistor 93 can be performed based on a temperature calculated by the detection and protection system 1500 during normal operation.

In some implementations, at startup temperature and current can be measured with nominal bias configuration. The bias can be adjusted base on desired current at temperature. In some implementations, on an on-going basis current can be measured and temperature can be calculated. The bias can be adjusted to correct for temperature coefficient.

In some implementations, a IC temperature sensor circuit is used to detect temperature of remote device for the purposes of calibration. In some implementations, a component parameter (e.g. resistance) temperature coefficients enables use of a measurement of that parameter to create a thermal sensor, similar in function to a thermal couple. In some implementations, measurement of parameter value during an initial calibration cycle where the component and temperature sensor device are in a either a low power or known condition to enable calibration of the absolute parameter value. In some implementations, calibrated measurement of the parameter of the component will provide a temperature estimation, because absolute parameters value has been removed from the equation. In some implementations, information about the temperature of the component enable features such as thermal protection and calibration of temperature dependencies of the component (e.g. remove temperature dependent gain variation). In some implementations, close proximity is defined by the component located in a position where it is in thermal equilibrium with the temperature sensor (when system is put into a either known condition or low self-heating condition). In some implementations, resistance can be a common parameter measure, but any parameter that has a known thermal coefficient and can be measured can also be used.

Figure 16:
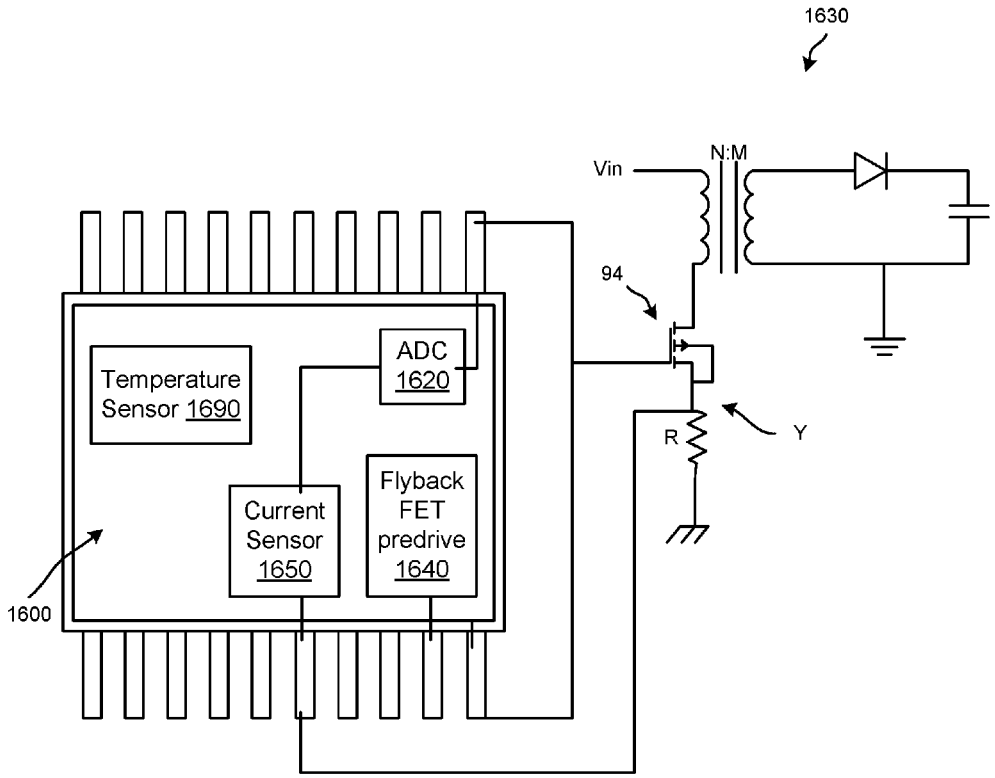
FIG. 16 is a diagram that illustrates a detection and protection system coupled to a flyback controller.

FIG. 16 is a diagram that illustrates a detection and protection system 1600 coupled to (e.g., monitoring) a flyback controller 1630. In this embodiment, only some of the components of the detection and protection system 1600 (e.g., temperature sensor 1690, current sensor 1650, ADC 1620) are illustrated. In this embodiment, the monitored component can be transistor 94. Accordingly, the detection and protection system 1600 can be configured to calculate a temperature of a transistor 94 based on a voltage at node Y across resistor R during normal operation based on calibration of a parameter with respect to the transistor 94 during a calibration time period (using the temperature sensor 1690). In some embodiments, the calibration of the parameter can be performed using remote temperature sensing while the transistor 94 is in either a low-power or known condition. In this embodiment, a flyback FET predrive 1640 associated with the flyback controller 1630 is integrated with the detection of protection system 1600.

In this embodiment, initialization of switching of the flyback controller 1630 can be controlled to measure a threshold voltage of the transistor 94. The calibration temperature can be measured during the initialization of the switching. During normal operation the ADC 1620 can be configured to sample the gate drive voltage and can be configured to measure the threshold voltage of the transistor 94. A temperature relationship, which can be used during normal operation to calculate a temperature, related to the transistor 94 can be based on a temperature coefficient of the transistor 94.

In example implementation of this technology is in a flyback converter power FETs. In some implementations, during power up, switching is controlled in order to make a measurement of the threshold voltage of the FET. Temperature can be calibrated at that time. In some implementations, during normal operation an ADC can sample the gate drive voltage and measure the threshold voltage. The threshold voltage can have a relatively well-defined temperature coefficient.

In one general aspect an apparatus can include a temperature sensor configured to measure a calibration temperature of a speaker coil, and a test signal generator configured to generate a first test signal through the speaker coil. The apparatus can include a current detector configured to measure a calibration current at the calibration temperature of the speaker coil based on the first test signal through the speaker coil, and an audio signal generator configured to generate an audio signal. The apparatus can also include a controller configured to trigger sending of a second test signal from the test signal generator through the speaker coil in combination with the audio signal where the current detector is configured to calculate a temperature change of the speaker coil during normal operation using a temperature relationship based on the calibration current at the calibration temperature and a temperature coefficient of the speaker coil.

In some embodiments, the first test signal is a first portion of a test signal produced starting at a first time and the second test signal is a second portion of the test signal produced starting at a second time. In some embodiments, the first test signal and the second test signal are produced using the same oscillator.

In another general aspect, a method can include calculating, at a calibration temperature of a speaker, a calibration parameter through a coil of the speaker in response to a first test signal, and sending a second test signal through the coil of the speaker. The method can also include measuring a parameter through the coil of the speaker based on the second test signal, and calculating a temperature change of the coil of the speaker based on the parameter and based on the calibration parameter at the calibration temperature.

In some embodiments, the first test signal has a frequency that is the same as a frequency of the second test signal. In some embodiments, the first test signal has a triangle waveform. In some embodiments, the first test signal has a frequency of approximately 4 Hz. In some embodiments, the calculating includes calculating based on a temperature relationship.

In some embodiments, the calculating includes adding the temperature change of the coil of the speaker to the calibration temperature. In some embodiments, the calculating includes calculating based on a serialized process. In some embodiments, the measuring is performed during a portion of a measurement cycle. In some embodiments, the measuring is performed via a current sense MOSFET device. In some embodiments, the parameter is at least one of a current, a resistance, or a voltage.

Figure 17:
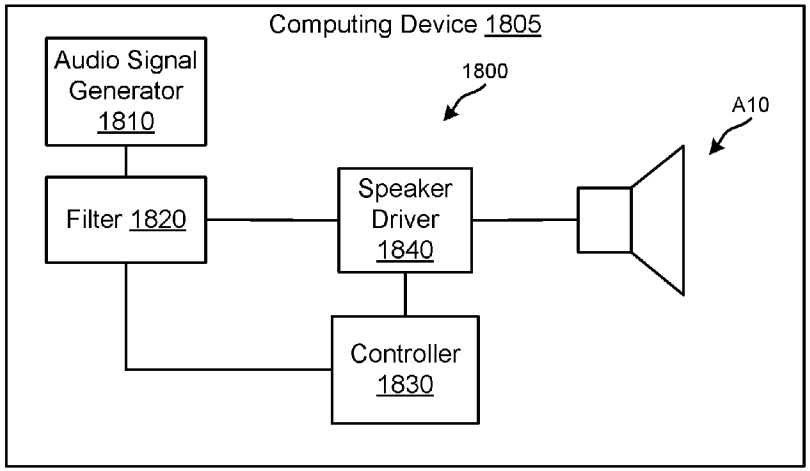
FIG. 17 is a diagram that illustrates a detection and protection system configured to detect and prevent mechanical damage to a speaker.

FIG. 17 is a diagram that illustrates a detection and protection system 1800 configured to detect and prevent mechanical damage to a speaker A10 (or a portion thereof). For example, the detection and protection system 1800 can be configured to detect a displacement of the speaker A10 and can be configured to change (e.g., attenuate, increase a gain of) a level (e.g., an audio level, a decibel (dB) level, a gain level, an attenuation level) of an audio signal driving the speaker A10 based on the detected displacement so that the speaker A10 may not be damaged in an undesirable fashion due to, for example, mechanical contact (which can be referred to as excursions) between components included in the speaker A10.

In some embodiments, the speaker A10 can be associated with (e.g., included in) a computing device 1805 such as, for example, a mobile phone, a smartphone, a music player (e.g., an MP3 player, a stereo), a videogame player, a projector, a tablet device, laptop computer, a television, a headset, and/or so forth. The speaker A10 can be configured to produce sound (e.g., music, vocal tones) in response to audio signals produced by an audio signal generator 1810 of the computing device 1805. Specifically, a speaker driver 1840 can be configured to receive the audio signals produced by the audio signal generator 1810 and can be configured to trigger the speaker A10 to produce sound based on the audio signals. In some embodiments, the audio signal generator 1810 can be configured to produce audio signals associated with a music player (e.g., an MP3 player), a telephone, a videogame, and/or so forth. In some embodiments, the speaker driver 1840 can define at least a portion of a class D amplifier, a class A and/or B amplifier, and/or so forth. In some embodiments, the speaker A10 can be a micro-speaker.

In the detection and protection system 1800 shown in FIG. 17, the speaker driver 1840, a controller 1830, and a filter 1820 define a feedback loop. Specifically, the controller 1830 is coupled to the speaker driver 1840, and is configured to detect an amplitude of an audio signal (produced by the audio signal generator 1810) being supplied (e.g., provided) from the speaker driver 1840 to the speaker A10. The amplitude of the audio signal can be correlated to mechanical displacement of the speaker A10. When the amplitude of the audio signal exceeds (or falls below) a threshold amplitude value (also can be referred to as a threshold amplitude limit), the controller 1830 can be configured to modify the filter 1820 so that the audio signal provided from the audio signal generator 1810 to the speaker driver 1840 can be modified (e.g., attenuated, increase). In some instances, when the audio signal produced by the audio signal generator 1810 is attenuated, mechanical damage caused in response to the audio signal (e.g., the attenuated audio signal) by can be avoided (e.g., substantially avoided, prevented).

In some embodiments, the controller 1830 can be configured to change (e.g., increase, decrease) a level (e.g., an attenuation, a gain) of a specified range of frequencies of one or more audio signals (which can be referred to as targeted audio signals). For example, the detection and protection system 1800 can be configured so that audio signals related to, for example, bass resonant frequencies, which can cause relatively large sound pressure level and displacement of the components of the speaker A10 (relative to high frequencies (e.g., treble frequencies)), can be attenuated. In other words, one or more threshold amplitude values (e.g., upper threshold amplitude values or limits, lower threshold amplitude values or limits) can be defined to trigger attenuation by the filter 1820 of targeted amplitudes detected by the controller 1830. In some embodiments, the detection and protection system 1800 can be configured so that an audio signal produced by the audio signal generator 1810 can be increased (e.g., magnified) in response to satisfying a condition related to a threshold amplitude value.

In some embodiments, an audio signal produced by the audio signal generator 1810 can be attenuated in response to the controller 1830 by modifying a resistor-capacitor (RC) time constant of the filter 1820. For example, if the filter 1820 is a high-pass filter, an RC time constant of the filter 1820 can be decreased in response to the controller 1830 so that a range of low-end frequencies eliminated by (e.g., filtered by) the filter 1820 may be increased. As another example, if the filter 1820 is a high-pass filter, an RC time constant of the filter 1820 can be increased in response to the controller 1830 so that a range of low-end frequencies eliminated by (e.g., filtered by) the filter 1820 may be decreased.

In some embodiments, a timing with which the controller 1830 triggers a change (e.g., an increase, a decrease) of a level of one or more audio signals produced by the audio signal generator 1810 can vary. For example, the controller 1830 can be configured to trigger the filter 1820 to change a level of an audio signal produced by the audio signal generator 1810 only after an amplitude of the audio signal exceeds a threshold amplitude value for more than a specified time period. As another example, controller 1830 can be configured to immediately trigger the filter 1820 to attenuate (e.g., attack) an audio signal produced by the audio signal generator 1810. The controller 1830 can be configured to maintain (e.g., hold) the attenuated audio signal for a specified period of time (which can be referred to as a hold time). After the hold time has expired, the controller 1830 can be configured to restore (e.g., no longer attenuate, attenuate to a lesser extent) the audio signal. In some embodiments, the audio signal can be restored to an unattenuated level or a lesser attenuated level. In some embodiments, the controller 1830 can be configured to maintain the attenuated audio signal for the hold time (even though the attenuated audio signal has dropped below a threshold amplitude value) so that the audio signal is not prematurely released to a lesser attenuated (or prior unattenuated) level or to prevent adjustment in an undesirable fashion in response to temporary drops in audio signal level.

In some embodiments, the controller 1830 can be configured to trigger a specified magnitude of change (e.g., an increase, a decrease) to one or more audio signals. For example, the controller 1830 can be configured to trigger the filter 1820 to attenuate (or increase attenuation of) an audio signal produced by the audio signal generator 1810 a specified magnitude, or increase (or scale-up) a level of an audio signal produced by the audio signal generator 1810 a specified magnitude.

In some embodiments, the controller 1830 can be configured to change (e.g., increase, decrease) a level of one or more audio signals at a specified rate. For example, the controller 1830 can be configured to trigger the filter 1820 to immediately attenuate or increase a level of an audio signal produced by the audio signal generator 1810. As another example, the controller 1830 can be configured to trigger the filter 1820 to slowly attenuate an audio signal at a specified rate in a continuous fashion, in discrete intervals, in non-linear fashion, and/or so forth. In some embodiments, the controller 1830 can be configured to change (e.g., increase, decrease) a level of one or more audio signals dynamically vary, at different rates between cycles, and/or so forth.

In some embodiments, the filter 1820 can be an analog filter, a digital filter, an active filter, and/or so forth. In some embodiments, the controller 1830 can be an analog controller, a digital controller, and/or so forth. In some embodiments, the controller 1830 can be a digital signal processing (DSP) unit, an application specific integrated circuit (ASIC), a central processing unit, and/or so forth. In some embodiments, the filter 1820, the controller 1830, and/or the speaker driver 1840 can be integrated into a single integrated circuit, a single discrete component, and/or a single semiconductor die. The filter 1820 (or portions thereof) and controller 1830 (or portions thereof) can be processed in a single semiconductor die that can be integrated into a discrete component separate from the speaker driver 1840.

Figure 18:
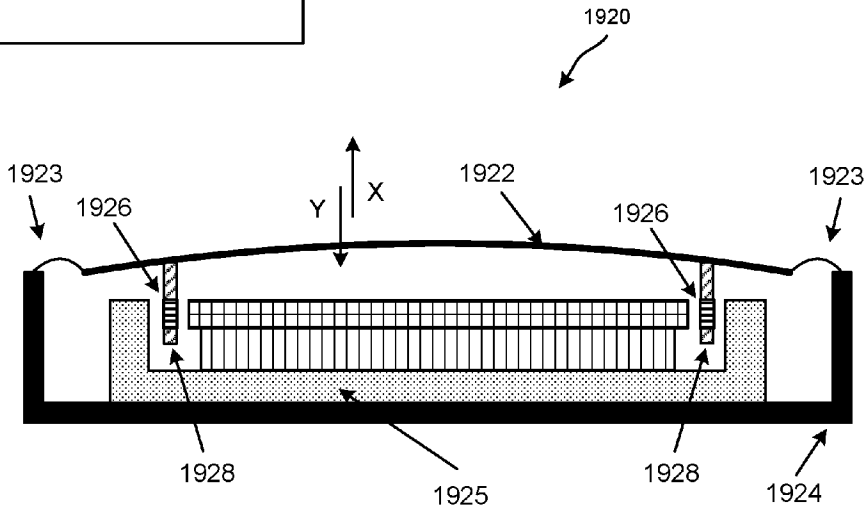
FIG. 18 is a diagram that illustrates a cross-sectional view of a speaker that can be protected using the detection and protection system shown in FIG. 17.

FIG. 18 is a diagram that illustrates a cross-sectional view of a speaker 1920 that can be protected using the detection and protection system 1800 shown in FIG. 17. As shown in FIG. 18, the speaker 1920 includes a diaphragm 1922 coupled via suspension members 1923 to a frame 1924. When current is applied to a voice coil 1926 of the speaker 1920 (in response to an audio signal), the voice coil 1926 can interact with magnetic circuitry 1925 to cause movement of the diaphragm 1922 in the X direction and the Y direction to produce sound. When a relatively large amount of current is applied to the voice coil 1926, the speaker 1920 can be mechanically damaged when the voice coil 1926 moves a relatively significant amount in the Y direction until a bottom portion 1928 of the voice coil 1926 contacts the magnetic circuitry 1925 (or frame 1924 in some embodiments). This type of movement, which can cause mechanical damage, can be referred to as an excursion.

Figure 19:
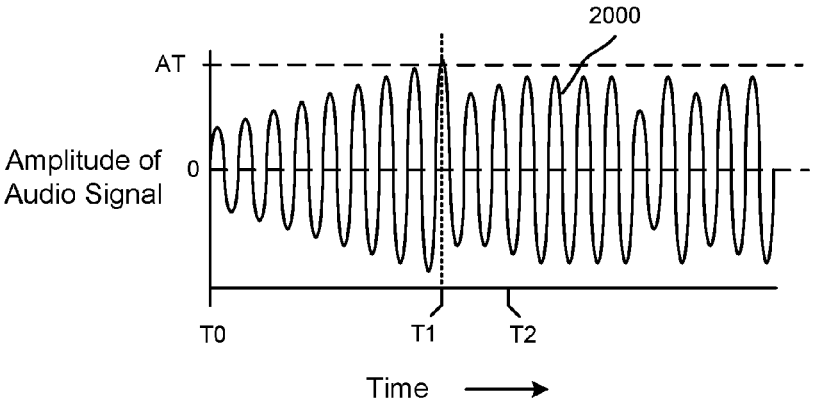
FIG. 19 is a diagram that illustrates an amplitude of an audio signal associated with a speaker.

FIG. 19 is a diagram that illustrates an amplitude of an audio signal 2000 associated with a speaker. As shown in FIG. 19, time is increasing to the right. The amplitude of the audio signal 2000 can be an amplitude measured by, for example, the controller 1830 shown in FIG. 17. In some embodiments, the amplitude can be measured at, or via, speaker driver such as the speaker driver 1840 shown in FIG. 17. In some embodiments, the amplitude can be represented as a voltage.

As shown in FIG. 19, the amplitude of the audio signal 2000 increases from time T0 until time T1. At time T1, the amplitude of the audio signal 2000 exceeds a threshold amplitude value AT illustrated by a dashed line. In response to the amplitude of the audio signal 2000 crossing the threshold amplitude value AT, the amplitude of the audio signal 2000 is attenuated. In this embodiment, the amplitude of the audio signal 2000 is attenuated via an RC time constant associated with a filter.

Although not shown, the threshold amplitude value AT can be an upper threshold amplitude value AT, and the audio signal can be subjected to a lower threshold amplitude value that can be opposite (e.g., symmetric about zero to, opposite in sign but the same in magnitude to) the upper threshold amplitude value AT. In some embodiments, the audio signal can be subjected to a lower threshold amplitude value that is not opposite to (e.g., is asymmetric about zero to, opposite in sign and different in magnitude to) the upper threshold amplitude value AT.

Figure 20:
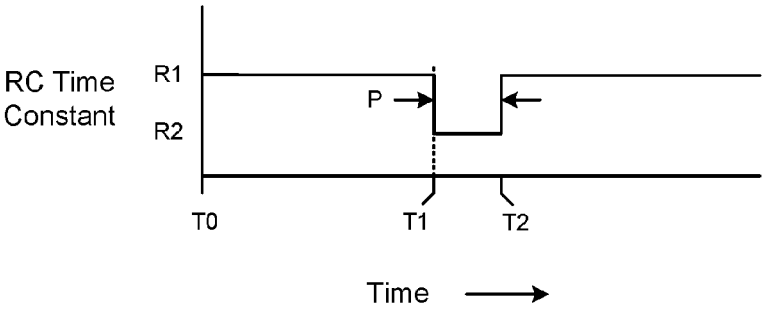
FIG. 20 is a diagram that illustrates a resistor-capacitor (RC) time constant of a filter through which the audio signal shown in FIG. 20A is provided to the speaker.

FIG. 20 is a diagram that illustrates an RC time constant of a filter through which the audio signal 2000 shown in FIG. 19 is provided to the speaker. As shown in FIG. 20, the RC time constant is immediately (e.g., abruptly, stepwise) decreased at approximately time T1 from value R1 to value R2 in response to the amplitude of the audio signal 2000 exceeding the threshold amplitude value AT shown in FIG. 19.

In this embodiment, the RC time constant is held at value R2 for a time period P (i.e., a hold time period) between times T1 and T2. At time T2, the RC time constant is increased (e.g., immediately increased, abruptly increased in a stepwise fashion) from value R2 to value R1. In response to the increase in the RC time constant, the amplitude of the audio signal 2000 is increased at approximately time T2 as shown in FIG. 19. In some embodiments, the values R1 and R2 can be related to different levels of attenuation. In some embodiments, the value R1 or the value R2 can be a non-attenuating time constant.

Figure 21A:
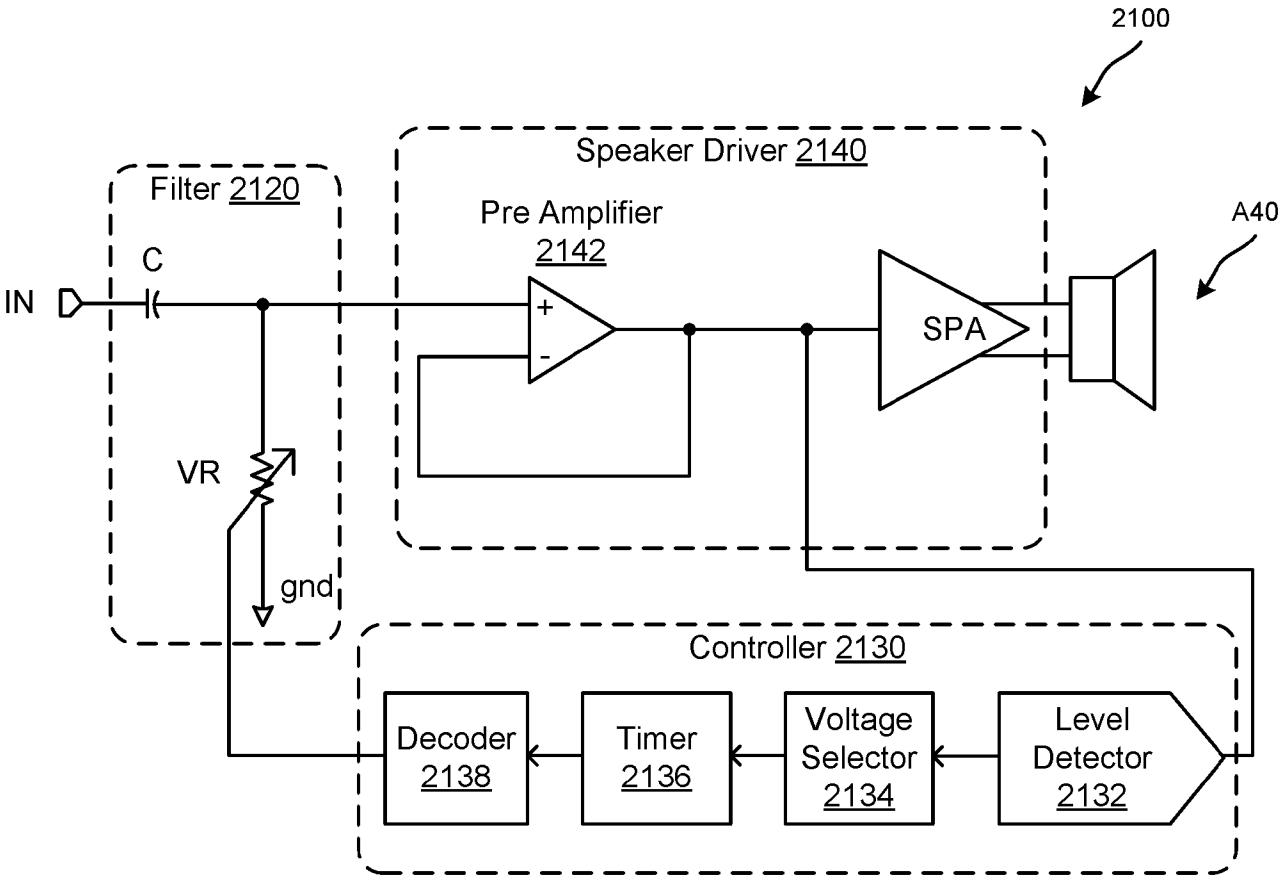
FIG. 21A is a diagram that illustrates a detection and protection system, according to an embodiment.

FIG. 21A is a diagram that illustrates a detection and protection system 2100, according to an embodiment. As shown in FIG. 21A, a speaker driver 2140 includes a preamplifier 2142 coupled to a speaker amplifier SPA. Also as shown in FIG. 21A, a filter 2120 is a high-pass filter including a capacitor C and a variable resistor VR. In this embodiment, the filter 2120 is an analog high-pass filter. An input node IN is configured to receive an audio signal produced by an audio signal generator (not shown).

As shown in FIG. 21A, a controller 2130 includes a level detector 2132, a voltage selector 2134 (also can be referred to as a voltage level selector), a timer 2136, and a decoder 2138. The level detector 2132 is coupled to a node between the preamplifier 2142 and speaker amplifier SPA so that the level detector 2132 can detect a voltage of an audio signal produced by the preamplifier 2122 and sent to the amplifier SPA.

The controller 2130 can be configured to modify an RC time constant of the filter 2120 by modifying a resistance of the variable resistor VR. For example, the controller 2130 can be configured to trigger one or more switches that cause the resistance of the variable resistor VR to increase or decrease. In this embodiment, the controller 2130 is a digital controller.

In this embodiment, the capacitor C can be, for example, an external capacitor (rather than an internal capacitor). For example, the capacitor can be off-chip (rather than on-chip), while the variable resistor VR can be on-chip with at least some portions of the controller 2130. Accordingly, at least a first portion of the filter 2120 can be included in, for example, a discrete component separate from a discrete component including a second portion of the filter 2120 and at least a portion of the controller 2130. In the some embodiments, the capacitor can be a relatively large off-chip capacitor.

The voltage selector 2134 is configured to select a threshold voltage value or limit (which can be correlated with a threshold amplitude value). For example, the voltage selector 2134 can be configured to trigger attenuation of an audio signal at a specified threshold voltage value. In some embodiments, the voltage selector 2134 can be configured using, for example, a digital input value (e.g., a 2-bit input value, an 8-bit input value). In some embodiments, the digital input value into the voltage selector 2134 can be referred to as a voltage limit value. In some embodiments, the voltage detector 2134 can be based on a parameter value different than a voltage value, such as a current value, a value without units, a magnitude value, and/or so forth. An example of voltage limit values that can be used to define a threshold voltage value or limit enforced by the voltage selector 2134 is shown in FIG. 21B.

As shown in FIG. 21B, a voltage limit value VL of "10" can be configured to trigger a threshold voltage value of −2 decibel (dB) from a peak voltage level (Vpk). In some embodiments, the peak voltage level can be, for example, 50 mV, 500 mV, 2 volts, 10 V, and so forth. In some embodiments, the peak voltage level can be referenced to a rating of a speaker A40 or a total harmonic distortion (THD) limiter level. More details related to threshold voltage limits and/or threshold amplitude values are discussed in connection with, for example, FIGS. 23A through 23C.

After an audio signal has been, for example, attenuated (e.g., attenuated at a specified rate (which can be referred to as an attenuation rate or as an attack rate)), the timer 2136 can be configured to trigger and/or release an attenuation or increase of the audio signal at a specified rate. For example, the timer 2136 can be configured to release an attenuation of an audio signal a specified amount over a specified period of time. In some embodiments, the timer 2136 can be configured using, for example, a digital input value (e.g., a 2-bit input value, an 8-bit input value). In some embodiments, the digital input value into the timer 2136 can be referred to as a rate value. An example of rate values that can be used to selectively trigger a rate (e.g., release rate value, increase rate value) by the timer 2136 is shown in FIG. 21C.

As shown in FIG. 21C, a rate value RR of "10" can be configured to trigger (e.g., trigger an increase or release) of a level of an attenuated signal at a rate of 100 ms per step. In some embodiments, the step size can be, for example, a specified frequency step or range (e.g., a frequency step of approximately 33 Hz), a specified RC time constant increment, and/or so forth. Although not shown, in some embodiments, the timer 2136 can also be configured to trigger a specified hold time period. More details related to release rates, attenuation rates, hold times, and so forth are discussed in connection with, for example, FIGS. 23A through 23C.

The decoder 2138 is configured to select a low (or minimum) frequency cut-off value of the filter 2120 and a high (or maximum) cutoff frequency value of the filter 2120. For example, the decoder 2138 can be configured to trigger implementation (e.g., via the variable resistor VR) of the low frequency cut off value specified for the filter 2120 until a threshold voltage value or limit specified using the voltage selector 2134 is exceeded. In response to the threshold voltage value or limit being exceeded, the decoder 2138 can be configured to change the cutoff frequency of the filter 2120 to the high cutoff frequency value.

In some embodiments, the decoder 2138 can be configured using, for example, digital input values (e.g., 2-bit input values, 8-bit input values). In some embodiments, digital input values into the decoder 2138 can be referred to as cutoff frequency bit values. An example of cutoff frequency bit values that can be used by the decoder 2138 to define a low (or minimum) frequency cut-off value and/or a high (or maximum) cutoff frequency value are shown in FIGS. 21D and 21E, respectively.

As shown in FIG. 21D, a low cutoff frequency bit value Fc_L of "01" can be configured to trigger a low-cutoff frequency value of 200 Hz in the filter 2120 by adjusting the variable resistor VR to a resistance of 7958 ohms. As shown in FIG. 21E, a high cutoff frequency bit value of Fc_H of "01" can be configured to trigger a high cutoff frequency value of 600 Hz in the filter 2120 by adjusting the variable resistor VR to a resistance of 2653 ohms. More details related to a low cutoff frequency value and a high cutoff frequency value are discussed in connection with, for example, FIGS. 23A through 23C.

In some implementations, two frequency response curves with two different −3 dB points can be selected from a predefined set. One can be for a lower amplitude signal, and another can be for when larger amplitudes are detected. In some implementations, a circuit can slide between the two depending on a level detect, also selected from a predefined set. FIGS. 21B through 21E can represent such a parameter set.

Figure 22:
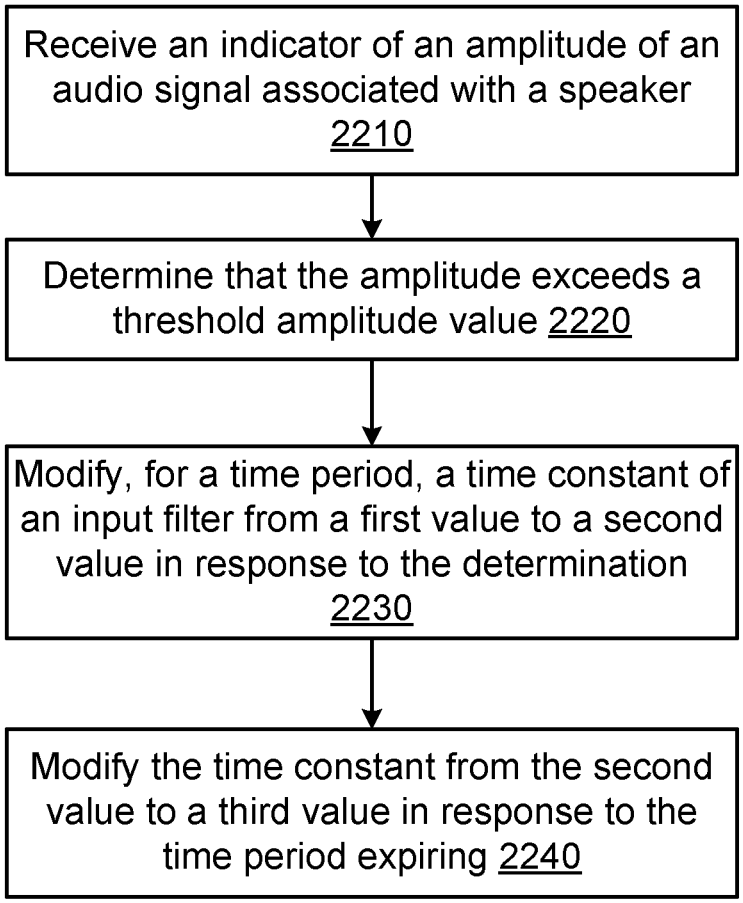
FIG. 22 is a flowchart that illustrates a method for modifying audio signal to a speaker via a filter.

FIG. 22 is a flowchart that illustrates a method for modifying audio signal to a speaker via a filter. In some embodiments, at least some portions of the method shown in FIG. 22 can be performed by, for example, the components of the detection and protection system 1800 shown in FIG. 17 and/or the components of the detection and protection system 2100 shown in FIG. 21A.

As shown in FIG. 22, an indicator of an amplitude of an audio signal associated with a speaker is received (block 2210). In some embodiments, the indicator of the amplitude can be received by the controller 1830 shown in FIG. 17. In some embodiments, the controller can be a digital controller. In some embodiments, the indicator of the amplitude can be, for example, a voltage. In some embodiments, the audio signal can be produced by the audio signal generator 1810 shown in FIG. 17.

The amplitude is determined to exceed a threshold amplitude value (block 2220). In some embodiments, the threshold amplitude value can be set at a level to avoid, for example, physical damage to the speaker. In some embodiments, the threshold amplitude value can be selectively defined by, for example, the voltage selector 2134 shown in FIG. 21A.

A time constant of an input filter is modified for a period of time from a first value to a second value in response to the determining (block 2230). In some embodiments, the time constant of the input filter can be modified by the controller 1830 shown in FIG. 17. In some embodiments, the input filter can be an analog input filter, and can be an analog high-pass input filter. In some embodiments, the period of time can be selectively defined by the timer 2136 shown in FIG. 21A. In some embodiments, the magnitude of the change from the first value to the second value can be selectively defined by the decoder 2138 shown in FIG. 21A.

The time constant is modified from the second value to a third value in response to the time period expiring (block 2240). In some embodiments, the duration of time period can, in some embodiments, be selectively defined by the timer 2136 shown in FIG. 21A. In some embodiments, the third value can be the same as the second value, or can be a step value during increasing of the time constant over time.

Figure 23A:
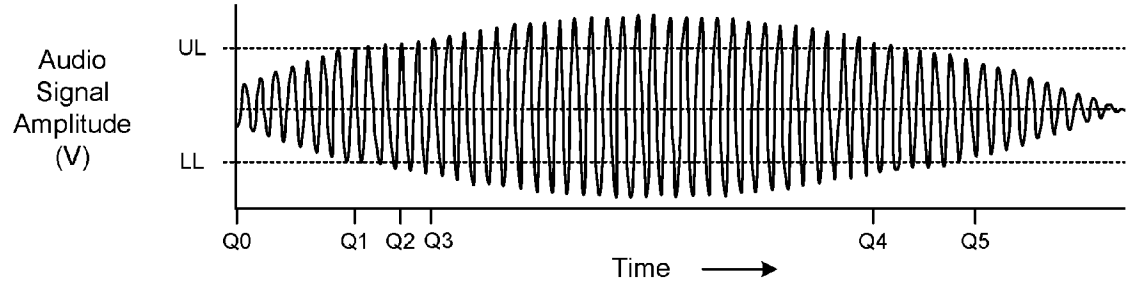
FIG. 23A through 23C are graphs that illustrate operation of a detection and protection system, according to an embodiment.
Figure 23B:
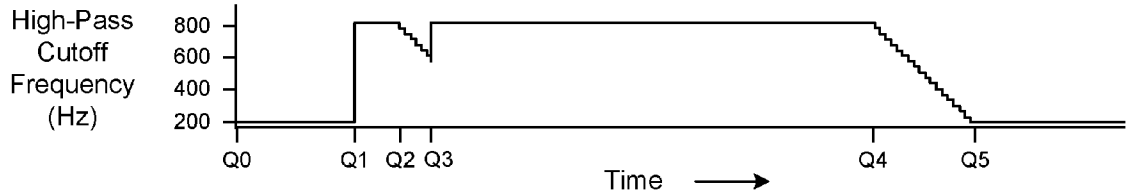
Figure 23C:
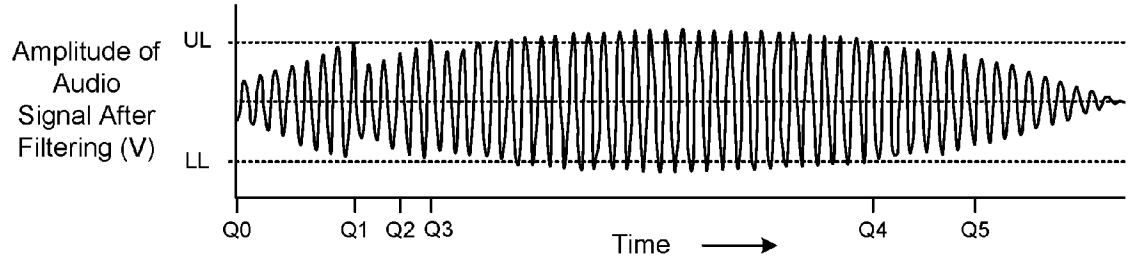

FIG. 23A through 23C are graphs that illustrate operation of a detection and protection system, according to an embodiment. In these graphs, time is increasing to the right. Specifically, FIG. 23A is a diagram that illustrates an amplitude of an audio signal produced by an audio signal generator. FIG. 23B is a diagram that illustrates a cutoff frequency of a high-pass filter triggered by a controller. FIG. 23C is a diagram that illustrates the amplitude of the audio signal after filtering. In some embodiments, the voltage scale of the amplitude of the audio signal after filtering shown in FIG. 23C can be different than (but can be proportional to) the voltage scale of the amplitude of the audio signal shown in FIG. 23A.

As shown in FIG. 23A, the amplitude of the audio signal gradually increases and then gradually decreases at approximately a constant frequency. Specifically, the amplitude of the audio signal increases gradually starting at approximately times Q0 until the amplitude of the audio signal reaches a maximum (or high point) between approximately times Q3 and Q4. After the amplitude of the audio signal reaches the maximum amplitude, the amplitude of the audio signal gradually decreases to approximately 0 after time Q5. In some embodiments, the audio signal can be produced by the audio signal generator 1810 shown in FIG. 17.

An upper amplitude limit UL (which can be referred to as an upper threshold amplitude limit or value) and a lower amplitude limit LL (which can be referred to as a lower threshold amplitude limit or value) are also shown in FIG. 23A. Because the upper amplitude limit UL is exceeded at approximately time Q1, a cutoff frequency of a high-pass filter is triggered to immediately increase as shown in FIG. 23B. Specifically, the cutoff frequency of the high-pass filter is triggered to immediately increase from 200 Hz (which can be a minimum or inherent cutoff frequency of the high-pass filter when in an unchanged (e.g., a non-attenuating, a relatively low attenuating) state) to 800 Hz (which can be a maximum cutoff frequency of the high-pass filter when in a changed (e.g., an attenuating, a relatively high attenuating) state). The increase in the amplitude of the audio signal beyond the upper amplitude limit UL at approximately time Q1 shown in FIG. 23A is mirrored (e.g., tracked) in the amplitude of the audio signal after filtering shown in FIG. 23C. In some embodiments, the cutoff frequency of the high-pass filter can be modified via modification of an RC time constant of the high-pass filter.

As shown in FIG. 23B, the cutoff frequency of the high-pass filter is held at 800 Hz between times Q1 and Q2 until the cutoff frequency of the high-pass filter gradually decreases at a specified rate (which can be referred to as a release rate) between times Q2 and Q3. In some embodiments, the hold time (e.g., hold time period) of the cutoff frequency of the high-pass filter can be a predefined hold time period. In this embodiment, after the hold time has expired, the cutoff frequency of the high-pass filter is configured to gradually decrease in a stepwise fashion at set cutoff frequency intervals per unit time (e.g., 25 Hz/ms, 100 Hz/second) between times Q2 and Q3 from approximately 800 Hz to approximately 600 Hz. In some embodiments, the rate of change of the cutoff frequency can vary (e.g., dynamically vary, can be varied between cycles) after a hold time period has expired.

As shown in FIG. 23C, in response to the increase in the cutoff frequency of the high-pass filter, the amplitude of the audio signal after filtering is attenuated (e.g., is decreased) after time Q1. The amplitude of the audio signal after filtering remains at the attenuated level between the upper amplitude limit UL and the lower amplitude limit LL. In this embodiment, because the audio signal amplitude shown in FIG. 23A continues to increase between times Q1 and Q3, and because the cutoff frequency of the high-pass filter is gradually decreased as shown in FIG. 23B, the amplitude of the audio signal after filtering gradually increases between times Q1 and Q3 as shown in FIG. 23C.

As shown in FIG. 23C, the amplitude of the audio signal after filtering increases beyond the upper amplitude limit UL (a second time) at approximately time Q3. Because the upper amplitude limit UL is exceeded at approximately time Q3, the cutoff frequency of the high-pass filter is triggered to immediately increase as shown in FIG. 23B at approximately time Q3. Specifically, the cutoff frequency of the high-pass filter is triggered to immediately increase from approximately 600 Hz to 800 Hz.

In this embodiment, because the maximum high-pass cutoff frequency is reached at approximately 800 Hz, the amplitude of the audio signal after filtering exceeds the upper amplitude limit UL and the lower amplitude limit LL. Because the amplitude of the audio signal after filtering continues to exceed the upper amplitude limit UL and the lower amplitude limit LL, the high-pass cutoff frequency is maintained at approximately 800 Hz between times Q3 and Q4. Although not shown, in some embodiments, the increase to approximately 800 Hz can cause the amplitude of the audio signal after filtering to remain approximately between the upper amplitude limit UL and the lower amplitude limit LL.

Although not shown in FIG. 23C, in some embodiment, the high-pass cutoff frequency can be triggered to start decreasing (e.g., decreasing at a release rate) only after a hold time period has expired. Specifically, the high-pass cutoff frequency can be triggered to start decreasing after the amplitude of the audio signal has fallen below the upper amplitude limit UL at time Q4 (shown in FIG. HC) and after a hold time has expired. In some embodiments, the audio signal after filtering can continue to be attenuated (e.g., can be attenuated at a constant/static level or based on a static attenuation profile) for a hold time (even though the attenuated audio signal has dropped below the upper amplitude limit UL) so that the high-pass cutoff frequency may not be temporarily changed if the drop below the upper amplitude limit UL is only temporary.

As shown in FIG. 23C, the amplitude of the audio signal after filtering decreases below the upper amplitude limit UL and increases beyond the lower amplitude limit LL at approximately time Q4. Accordingly, the high-pass cutoff frequency is gradually decreased between times Q4 and Q5. In this embodiment, the high-pass cutoff frequency is decreased at the same rate (or substantially the same rate (e.g., release rate)) as when the high-pass cutoff frequency was gradually decreased between times Q2 and Q3. In some embodiments, the rate at which the high-pass cutoff frequency is decreased can vary depending upon a duration and/or a level that a cutoff frequency of a high-pass filter is in a changed state (e.g., an attenuating state). For example, a rate of decrease of the high-pass cutoff frequency can depend on whether the high-pass cutoff frequency is maintained at a maximum level (or another level) for more than a threshold time period.

In some embodiments, the hold time period (e.g., the hold time period between times Q1 and Q2), the cutoff frequency, a rate of change in level of an audio signal, and/or so forth can vary based on the magnitude of an amplitude of an audio signal beyond a threshold amplitude value. For example, both hold time of a change and a cutoff frequency can be greater in cases where an amplitude of an audio signal exceeds a threshold amplitude value by a relatively large amount than in cases where the amplitude of the audio signal exceeds the threshold amplitude value by relatively small amount. Although not shown, in some embodiments, the cutoff frequency of a high-pass filter can be triggered to increase at a specified rate (rather than immediately) in response to the upper amplitude limit being exceeded at approximately times Q1 and Q3.

Figure 24:
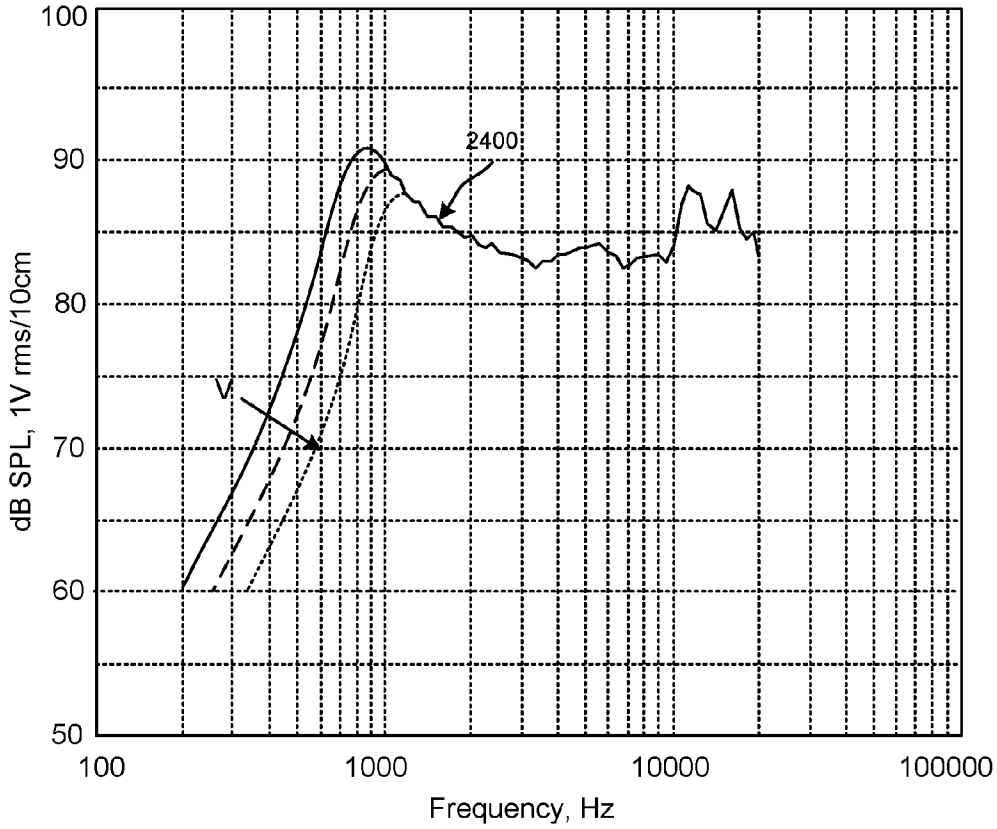
FIG. 24 is a graph that illustrates a pressure level response of a speaker based on an audio signal.

FIG. 24 is a graph that illustrates a pressure level response 2400 of a speaker based on an audio signal. Specifically, the speaker pressure level (SPL) is illustrated along the y-axis in decibels (dB) and a frequency of the audio signal into the speaker is illustrated along the x-axis along a logarithmic scale in Hz. In some embodiments, the pressure level response 2400 of the speaker based on the audio signal can be referred to as or can be representative of an attenuation profile.

FIG. 24 illustrates the effects of changing a high-pass cutoff frequency of a high-pass filter configured to filter out relatively low frequencies of the audio signal. Specifically, the pressure level response 2400 of the speaker at relatively low frequencies (e.g., at frequencies below approximately 1000 Hz) moves along direction V as the high-pass cutoff frequency of the high-pass filter is increased (e.g., increased in response to a decrease in a resistance of a variable resistor).

Figure 25:
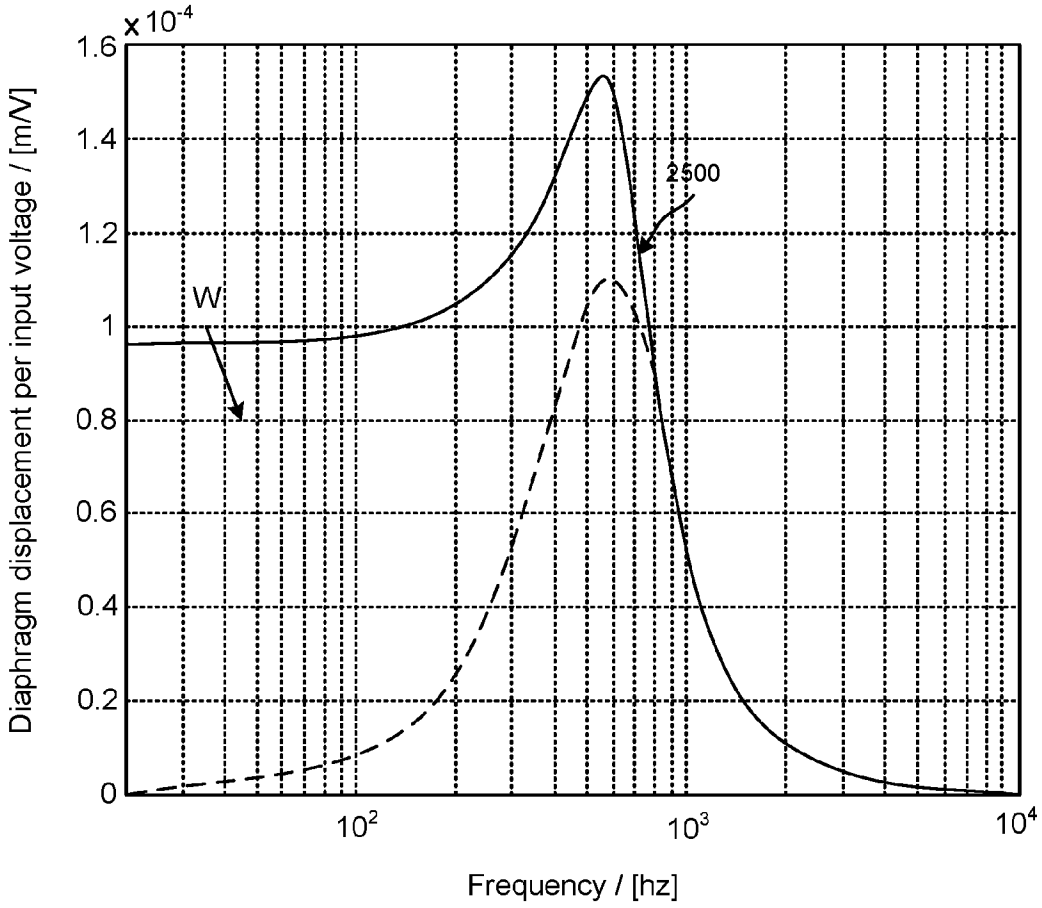
FIG. 25 is a graph that illustrates a diaphragm displacement of a speaker in response to an audio signal.

FIG. 25 is a graph that illustrates a diaphragm displacement 2500 of a speaker in response to an audio signal. Specifically, the diaphragm displacement per input voltage is illustrated along the y-axis and a frequency of the audio signal into the speaker is illustrated along the x-axis along a logarithmic scale in Hz. In some embodiments, the diaphragm displacement 2500 of the speaker in response to the audio signal can be referred to as or can be representative of an attenuation profile.

FIG. 25 illustrates the effects of changing a high-pass cutoff frequency of a high-pass filter configured to filter out relatively low frequencies of the audio signal. Specifically, the diaphragm displacement 2500 of the speaker at relatively low frequencies (e.g., at frequencies below approximately 1000 Hz) moves along direction W as the high-pass cutoff frequency of the high-pass filter is increased (e.g., increased in response to a decrease in a resistance of a variable resistor).

Figure 26:
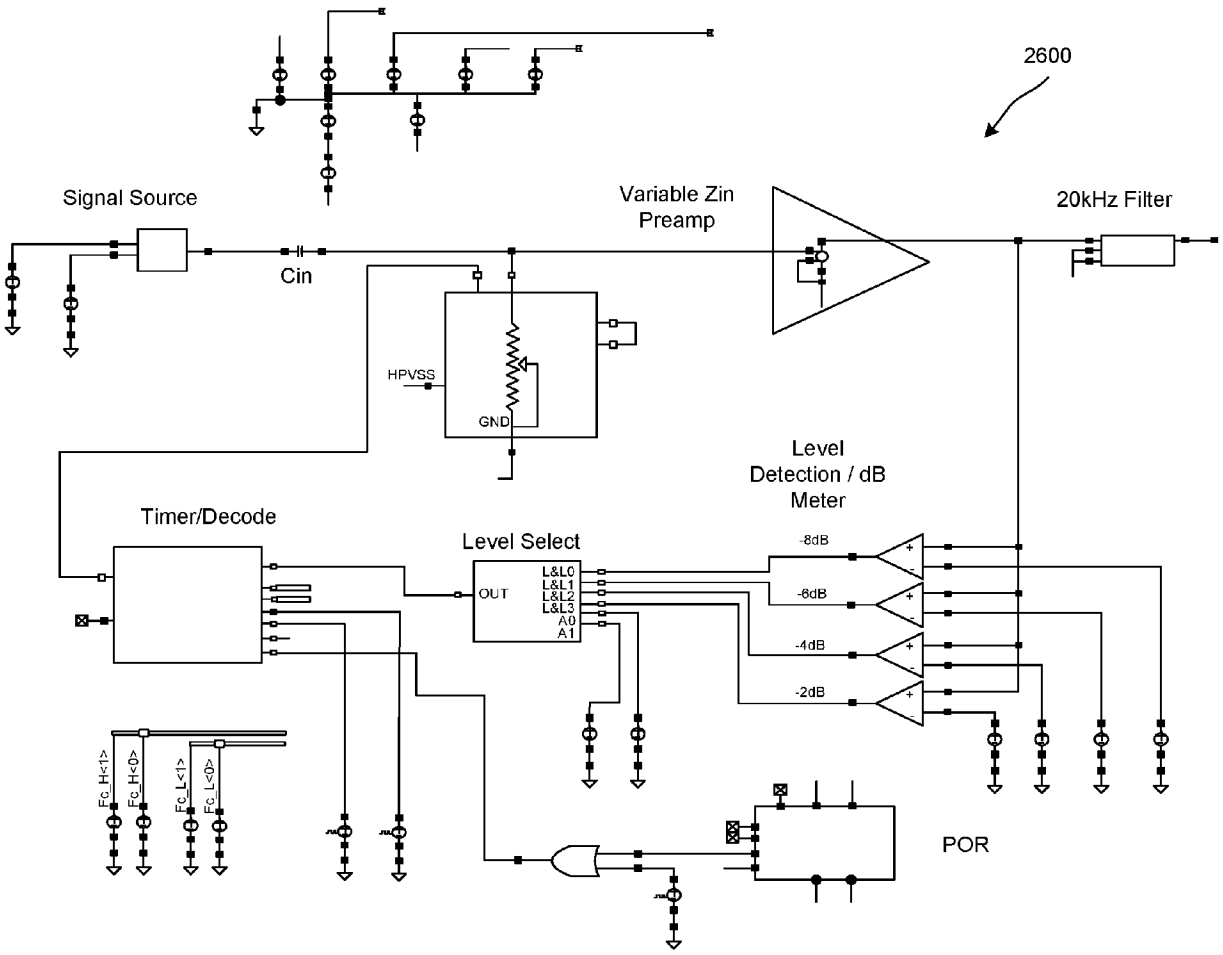
FIG. 26 is a diagram that illustrates another implementation of a detection and protection system, according to embodiment.

FIG. 26 is a diagram that illustrates another implementation of a detection and protection system 2600, according to embodiment. The detection and protection system 2600 includes an analog filter and a digital controller. The analog filter includes a variable resistor that can be coupled to a capacitor (which can be an external capacitor). The digital controller also includes, for example, a timer, a decoder, and so forth.

Figure 27:
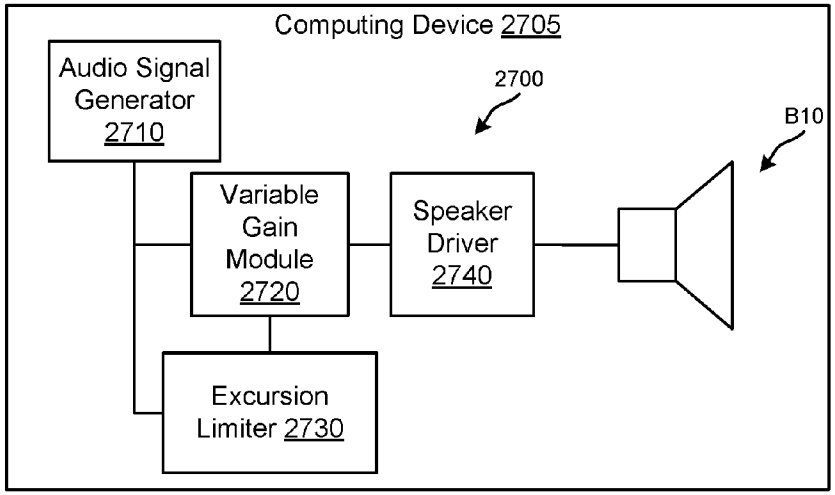
FIG. 27 is a diagram that illustrates a detection and protection system configured to detect and prevent mechanical damage to a speaker.

FIG. 27 is a diagram that illustrates a detection and protection system 2700 configured to detect and prevent mechanical damage to a speaker B10 (or a portion thereof). For example, the detection and protection system 2700 can be configured to detect a displacement of the speaker B10 and can be configured to change (e.g., modified, attenuate, increase gain of) a level (e.g., an audio level, a decibel (dB) level, a gain level, an attenuation level) of an audio signal driving the speaker B10 based on the detected displacement so that the speaker B10 may not be damaged in an undesirable fashion due to, for example, mechanical contact (which can be referred to as excursions) between components included in the speaker B10.

In some embodiments, the speaker B10 can be associated with (e.g., included in) a computing device 2705 such as, for example, a mobile phone, a smartphone, a music player (e.g., an MP3 player, a stereo), a videogame player, a projector, a tablet device, laptop computer, a television, a headset, and/or so forth. The speaker B10 can be configured to produce sound (e.g., music, vocal tones) in response to audio signals produced by an audio signal generator 2710 of the computing device 2705. Specifically, a speaker driver 2740 can be configured to receive the audio signals produced by the audio signal generator 2710 and can be configured to trigger the speaker B10 to produce sound based on the audio signals. In some embodiments, the audio signal generator 2710 can be configured to produce audio signals associated with a music player (e.g., an MP3 player), a telephone, a videogame, and/or so forth. In some embodiments, the speaker driver 2740 can define at least a portion of a class D amplifier, a class A and/or B amplifier, and/or so forth. In some embodiments, the speaker B10 can be a micro-speaker.

As shown in FIG. 27 the detection and protection system 2700 includes a variable gain module 2720 and an excursion limiter 2730. Specifically, the excursion limiter 2730 can be configured to perform side chain audio analysis on a side chain audio signal derived from a main audio signal to determine whether or not the main audio signal should be modified (e.g., attenuated, increased, decreased). Accordingly, the excursion limiter 2730 can be configured to detect an amplitude of a portion of a main audio signal, which can be correlated to mechanical displacement of the speaker B10, via a side chain audio signal. The main audio signal can be produced by the audio signal generator 2710 and can be provided to the speaker B10 via the variable gain module 2720. When the amplitude of the side chain audio signal exceeds (or falls below) a threshold amplitude value (also can be referred to as a threshold amplitude limit), the excursion limiter 2730 can be configured to trigger the variable gain module 2720 so that the main audio signal provided from the audio signal generator 2710 to the speaker driver 2740 can be modified (e.g., attenuated, increased). In some instances, when the main audio signal produced by the audio signal generator 2710 is attenuated, mechanical damage caused in response to the main audio signal (e.g., the attenuated audio signal) by can be avoided (e.g., substantially avoided, prevented).

Specifically, the excursion limiter 2730 can be configured so that a specified range (e.g., set) of frequencies of one or more main audio signals produced by the audio signal generator 2710 may be analyzed as side chain audio signals at the excursion limiter 2730. As discussed above, the analysis of the side chain audio signals, which are derived from the main audio signals, can then be used to modify (e.g., can trigger modification of) the main audio signals. Thus, the excursion limiter 2730 can be configured so that only a specified range of frequency of one or main audio signals produced by the audio signal generator 2710 may be analyzed and used by the excursion limiter 2730 to trigger modifying of (e.g., the attenuation of) the main audio signals. The specified range of frequencies of one or more main audio signals that are analyzed by the excursion limiter 2730 can be referred to as side chain frequencies.

Through analysis of side chain audio signals, the excursion limiter 2730 can be configured to change (e.g., modify, increase, decrease, attenuate) a level of a specified range of frequencies of one or more main audio signals (which can be referred to as targeted audio signals). In some embodiments, a level of non-target frequencies included in, or otherwise associated with, the main audio signals may also be collaterally changed.

For example, the detection and protection system 2700 can be configured so that main audio signals related to, for example, bass resonant frequencies, which can cause relatively large sound pressure level and displacement of the components of the speaker B10 (relative to high frequencies (e.g., treble frequencies)), can be attenuated within the main audio signals. In other words, one or more threshold amplitude values (e.g., upper threshold amplitude values or limits, lower threshold amplitude values or limits) can be defined to trigger attenuation by the variable gain module 2720 of targeted amplitudes detected by the excursion limiter 2730 (within side chain audio signals). In some embodiments, the detection and protection system 2700 can be configured so that a main audio signal produced by the audio signal generator 2710 can be increased (e.g., magnified) in response to satisfying a condition related to a threshold amplitude value (which can be represented as a parameter such as a voltage value, a current value, a level value, etc.).

Side chain audio signal analysis can be performed by various components of the excursion limiter 2730. For example, the excursion limiter 2730 can include a low-pass filter, a low shelving device, a frequency detector, and/or so forth, that can be configured to filter the main audio signals for a target range of frequencies of the main audio signal(s) to be used as side chain audio signals for analysis by the excursion limiter 2730. The main audio signals (which can include both high and low frequency audio signals) can then be modified based on the analysis of the side chain audio signals. In some embodiments, the side chain audio signals targeted for analysis by the excursion limiter 2730 can include relatively low-frequency portions of one or more of the main audio signals produced by the audio signal generator 2710.

In some embodiments, a timing with which the excursion limiter 2730 triggers a change (e.g., an increase, a decrease) via the variable gain module 2720 of a level (e.g., an attenuation level, a gain level) of one or more main audio signals produced by the audio signal generator 2710 based on side chain audio signal analysis can vary. For example, the excursion limiter 2730 can be configured to trigger the variable gain module 2720 to change a level of a main audio signal produced by the audio signal generator 2710 only after an amplitude of the main audio signal exceeds a threshold amplitude value for more than a specified time period (based on an analysis of a side chain audio signal). As another example, the excursion limiter 2730 can be configured to immediately trigger the variable gain module 2720 to attenuate (e.g., attack) a main audio signal produced by the audio signal generator 2710. The excursion limiter 2730 can be configured to maintain (e.g., hold) the attenuated main audio signal for a specified period of time (which can be referred to as a hold time). After the hold time has expired, the excursion limiter 2730 can be configured to restore (e.g., no longer attenuate, attenuate to a lesser extent) the main audio signal. In some embodiments, the main audio signal can be restored to an unattenuated level or a lesser attenuated level. In some embodiments, the excursion limiter 2730 can be configured to maintain the attenuated main audio signal for the hold time (even though the attenuated main audio signal has dropped below a threshold amplitude value) so that the main audio signal is not prematurely released to a lesser attenuated (or prior unattenuated) level or to prevent adjustment in an undesirable fashion in response to temporary drops in the main audio signal level. In some embodiments, a hold time may not be implemented.

In some embodiments, the excursion limiter 2730 can be configured to trigger a specified magnitude of change (e.g., an increase, a decrease) to a level (e.g., an attenuation level, a gain level) of one or more main audio signals based on side chain audio signal analysis. For example, the excursion limiter 2730 can be configured to trigger the variable gain module 2720 to attenuate (or increase attenuation of) a main audio signal produced by the audio signal generator 2710 a specified magnitude, or increase (or scale-up) a level of a main audio signal produced by the audio signal generator 2710 a specified magnitude (based on an analysis of a side chain audio signal).

In some embodiments, the excursion limiter 2730 can be configured to change (e.g., increase, decrease) a level of one or more main audio signals at a specified rate based on side chain audio signal analysis. For example, the excursion limiter 2730 can be configured to trigger the variable gain module 2720 to immediately attenuate or increase a level of a main audio signal produced by the audio signal generator 2710 (based on an analysis of a side chain audio signal). As another example, the excursion limiter 2730 can be configured to trigger the variable gain module 2720 to slowly attenuate a main audio signal at a specified rate in a continuous fashion, in discrete intervals, in non-linear fashion, and/or so forth (based on an analysis of a side chain audio signal). In some embodiments, the excursion limiter 2730 can be configured to change (e.g., increase, decrease) a level of one or more main audio signals dynamically vary, at different rates between cycles, and/or so forth (based on an analysis of a side chain audio signal).

In some embodiments, the variable gain module 2720 can be an analog variable gain module, a digital variable gain module, an active variable gain module, a variable gain module including a potentiometer, and/or so forth. In some embodiments, the excursion limiter 2730 can be an analog controller, a digital controller, and/or so forth. In some embodiments, the variable gain module 2720, the excursion limiter 2730, and/or the speaker driver 2740 can be a digital signal processing (DSP) unit, an application specific integrated circuit (ASIC), a central processing unit, and/or so forth.

In some embodiments, the variable gain module 2720 and the excursion limiter 2730 can be integrated into a single integrated circuit, a single discrete component, and/or a single semiconductor die. In some embodiments, the variable gain module 2720 (or portions thereof) and excursion limiter 2730 (or portions thereof) can be processed in a single semiconductor die that can be integrated into a discrete component separate from the speaker driver 2740. In some embodiments, the variable gain module 2720 (or portions thereof) and/or the excursion limiter 2730 (or portions thereof) can be integrated with the speaker driver 2740 (or portions thereof).

Figure 28:
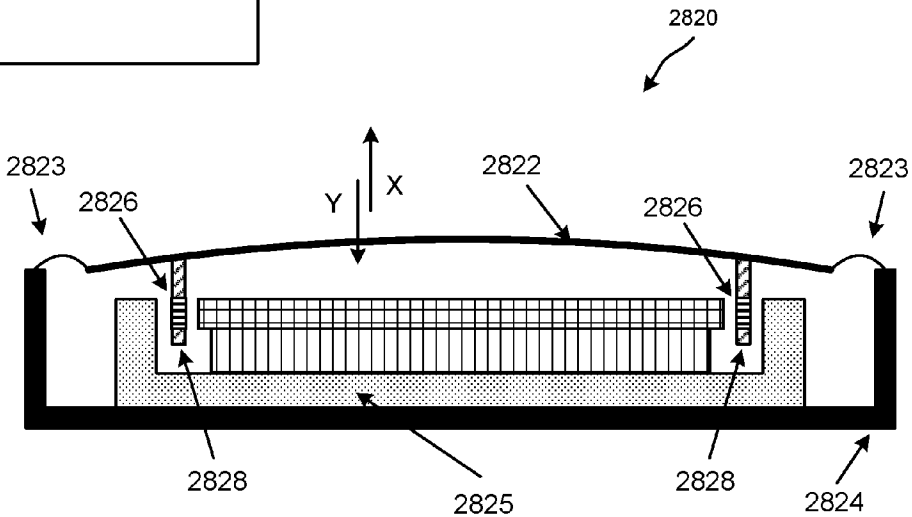
FIG. 28 is a diagram that illustrates a cross-sectional view of a speaker that can be protected using the detection and protection system shown in FIG. 27.

FIG. 28 is a diagram that illustrates a cross-sectional view of a speaker 2820 that can be protected using the detection and protection system 2700 shown in FIG. 27. As shown in FIG. 28, the speaker 2820 includes a diaphragm 2822 coupled via suspension members 2823 to a frame 2824. When current is applied to a voice coil 2826 of the speaker 2820 (in response to an audio signal), the voice coil 2826 can interact with magnetic circuitry 2825 to cause movement of the diaphragm 2822 in the X direction and the Y direction to produce sound. When a relatively large amount of current is applied to the voice coil 2826, the speaker 2820 can be mechanically damaged when the voice coil 2826 moves a relatively significant amount in the Y direction until a bottom portion 2828 of the voice coil 2826 contacts the magnetic circuitry 2825 (or frame 2824 in some embodiments). This type of movement, which can cause mechanical damage, can be referred to as an excursion.

Figure 29A:
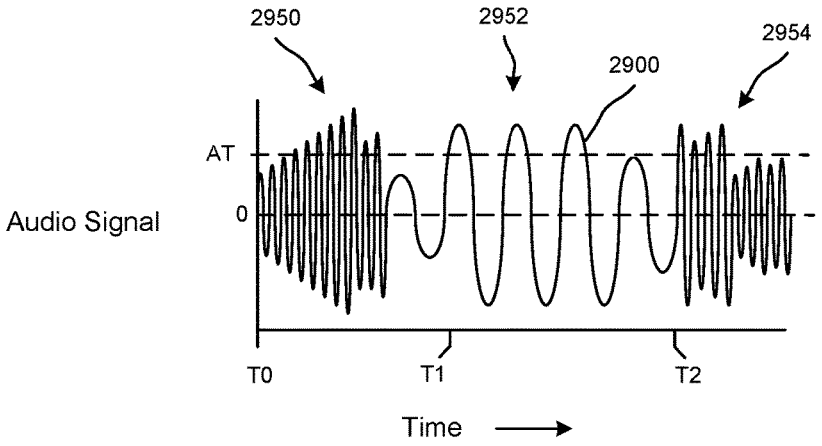
FIGS. 29A through 29C are graphs that collectively illustrate operation of a detection and protection system, according to an embodiment.
Figure 29B:
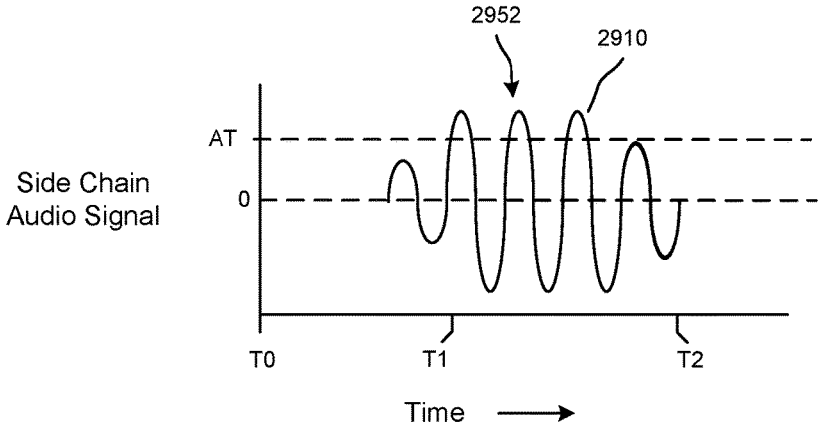
Figure 29C:
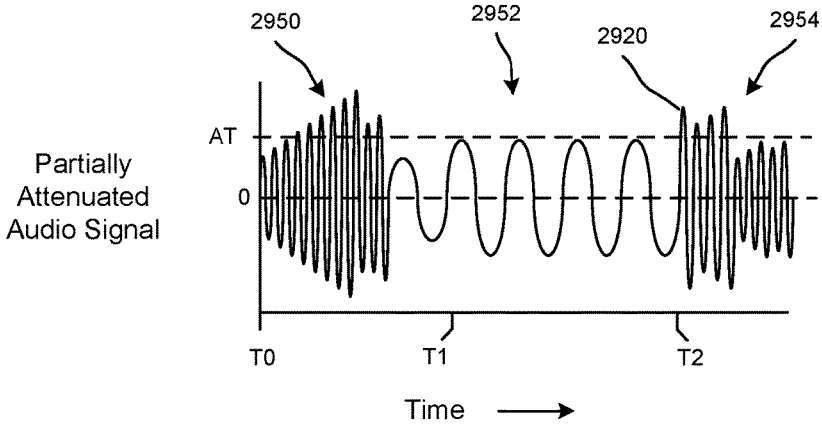

FIGS. 29A through 29C are graphs that collectively illustrate operation of a detection and protection system (e.g., the detection and protection system 2700 shown in FIG. 27), according to an embodiment. FIG. 29A is a diagram that illustrates a main audio signal 2900 associated with a speaker, and FIG. 29B is a diagram that illustrates a side chain audio signal 2910 derived from the main audio signal. FIG. 29C is a diagram that illustrates the main audio signal 2900 shown in FIG. 29A with some portions that are attenuated by the detection and protection system based on analysis of the side chain audio signal shown in FIG. 29B. The main audio signal with attenuated portions is illustrated as curve 2920 in FIG. 29C and is referred to as a partially attenuated audio signal 2920. As shown in FIGS. 29A through 29C, time is increasing to the right. The curves illustrated in FIGS. 29A through 29C are presented by way of example only and do not necessarily represent feedback loop non-idealities that can result in delays, phase shifts, and/or so forth.

In this embodiment, the detection and protection system is configured to attenuate portions of the main audio signal 2900 shown in FIG. 29A that is below a threshold frequency (e.g., below 1000 Hz, below 500 Hz, below 200 Hz) (not shown) and that also exceeds a threshold amplitude value AT illustrated by the dashed line. The portion of the main audio signal 2900 that are below the threshold frequency are illustrated as the side chain audio signal 2910 shown in FIG. 29B. As shown in FIG. 29B, only portion 2952 of the side chain audio signal 2910 (which corresponds portion 2952 of the main audio signal 2900 shown in FIG. 29A) exceeds the threshold amplitude value AT. Because only the portion 2952 (which is a relatively low frequency portion of the main audio signal 2900) of the side chain audio signal 2910 shown in FIG. 29B exceeds the threshold amplitude value AT, only the portion 2952 of the main audio signal 2900 shown in FIG. 29A between approximately times T1 and T2 is attenuated as represented by the attenuation of portion 2952 in the partially attenuated audio signal 2920 shown in FIG. 29C. The portions 2950, 2954 of the amplitude of the main audio signal 2900 before time T1 and after time T2, respectively, although exceeding the threshold amplitude value AT, are not attenuated by the detection and protection system because these portions 2950, 2954 are relatively high frequency portions having frequencies exceeding the threshold frequency. As illustrated in FIG. 29B, the relatively high frequency portions are excluded from the side chain audio signal 2910, and are therefore excluded from analysis that can trigger attenuation of the main audio signal 2900 shown in FIG. 29A.

Although not shown, the threshold amplitude value AT can be an upper threshold amplitude value AT, and the audio signal can be subjected to a lower threshold amplitude value that can be opposite (e.g., symmetric about zero to, opposite in sign but the same in magnitude to) the upper threshold amplitude value AT. In some embodiments, the audio signal can be subjected to a lower threshold amplitude value that is not opposite to (e.g., is asymmetric about zero to, opposite in sign and different in magnitude to) the upper threshold amplitude value AT.

Figure 30A:
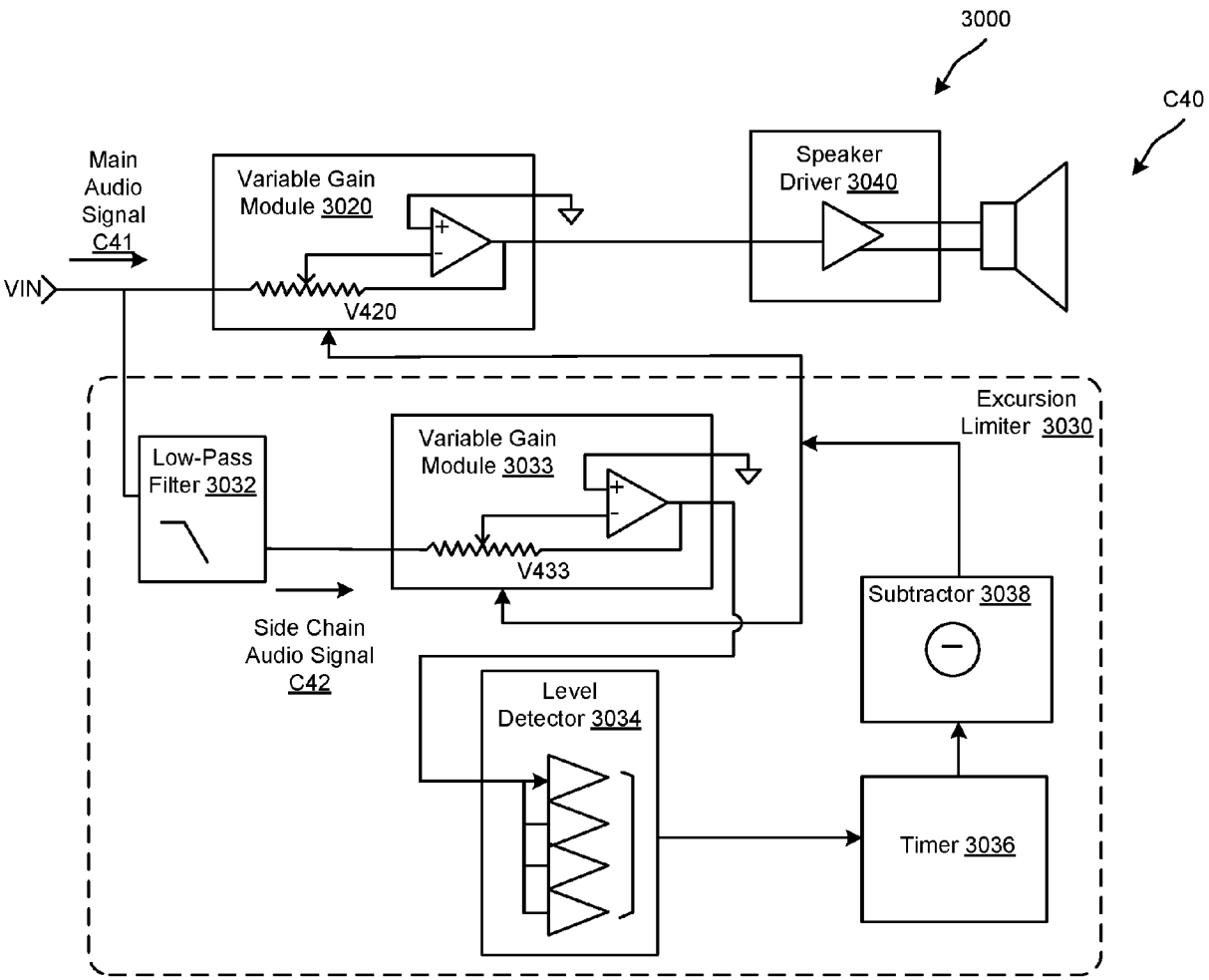
FIG. 30A is a diagram that illustrates a detection and protection system, according to an embodiment.

FIG. 30A is a diagram that illustrates a detection and protection system 3000, according to an embodiment. As shown in FIG. 30A, a speaker driver 3040 is coupled to a speaker C40. The speaker driver 3040 is configured to receive a main audio signal C41 produced by an audio signal generator (not shown) from an input node VIN via a variable gain module 3020.

The detection and protection system 3000 includes an excursion limiter 3030 configured to perform side chain analysis. Specifically, the detection and protection system 3000 is configured to derive a side chain audio signal C42 from the main audio signal C41 into the input node VIN. Based on an analysis of the side chain audio signal C42, the excursion limiter 3030 is configured to trigger the variable gain module 3020 to change a level of (e.g., attenuate, increase) the main audio signal C41. In some embodiments, a audio signal derived from the main audio signal C41 and provided into the low-pass filter 3032 can be referred to a as a side chain audio signal.

As shown in FIG. 30A, an excursion limiter 3030 includes a low-pass filter 3032, a variable gain module 3033, a level detector 3034, a timer 3036, and a subtractor 3038. The low-pass filter 3032 is configured to produce the side chain audio signal C42, which includes portions of (e.g., frequencies of) the main audio signal C41 targeted for analysis by the excursion limiter 3030. Accordingly, the low-pass filter 3032 is configured to filter (e.g., remove) frequencies of the main audio signal C41 that will not be analyzed by the excursion limiter 3030. The side chain audio signal C42 is sent to the variable gain module 3033 of the excursion limiter 3030. The components of the detection and protection system 3000 can be triggered using one or more clock signals (e.g., clock signals produced by one or more oscillators (not shown)).

The variable gain module 3033 is configured to mirror the variable gain module 3020 (and can be referred to as a mirroring variable gain module). Specifically, a signal (e.g., an instruction, a digital signal (e.g., a 5-bit signal)) sent from the subtractor 3038 of the excursion limiter 3030 to trigger a change (e.g., an attenuation, an increase) by the variable gain module 3020 in a level of the main audio signal C41 is also sent to the variable gain module 3033 to trigger a change in the side chain audio signal C42. Accordingly, a level of the side chain audio signal C42 is changed (e.g., is attenuated) by the variable gain module 3033 similar to (e.g., proportional to, the same as) a fashion in which a level of the main audio signal C41 is changed (e.g., is attenuated) by the variable gain module 3020. The variable gain module 3020 is configured to trigger a change in the main audio signal C41, for example, via a variable resistor V420. Similarly, the variable gain module 3033 is configured to trigger a change in the side chain audio signal C42, for example, via a variable resistor V433. In some embodiments, the subtractor 3038 can be configured to start with a baseline gain value (e.g., a start gain value, a default gain value).

The excursion limiter 3030 is configured to monitor changes to the main audio signal C41 that are triggered by the excursion limiter 3030 via the mirroring performed by the variable gain module 3033. The excursion limiter 3030 as shown in FIG. 30A is configured to derive (e.g., extract) the side chain audio signal C42 before changes triggered by the excursion limiter 3030 are implemented by the variable gain module 3020. Accordingly, without the mirroring, the excursion limiter 3030 may not otherwise be able to monitor (e.g., directly monitor) changes to the main audio signal 31 that are triggered by the excursion limiter 3030 via the mirroring in the variable gain module 3033. In some embodiments, rather than mirroring using the variable gain module 3033, the changes to the main audio signal 31 can be directly monitored at an output of the variable gain module 3033.

The level detector 3034 is configured to select a threshold voltage value or limit (which can be correlated with a threshold amplitude value) associated with the side chain audio signal C42. Specifically, the level detector 3034 can be configured to trigger attenuation of the main audio signal C41 (and the side chain audio signal C42) based on a specified threshold voltage value of the side chain audio signal C42. In some embodiments, the level detector 3034 can be configured using, for example, a digital input value (e.g., a 2-bit input value, an 8-bit input value). In some embodiments, the digital input value into the level detector 3034 can be referred to as a voltage limit value. In some embodiments, the level detector 3034 can be based on a parameter value different than a voltage value, such as a current value, a value without units, a magnitude value, and/or so forth. An example of voltage limit values that can be used to define a threshold voltage value or limit enforced by the level detector 3034 is shown in FIG. 30B.

As shown in FIG. 30B, a voltage limit value VL of "10" can be configured to trigger a threshold voltage value of −2 decibel (dB) from a peak voltage level (Vpk) of the side chain audio signal C42. In some embodiments, the peak voltage level can be, for example, 50 mV, 500 mV, 2 volts, 10 V, and so forth. In some embodiments, the peak voltage level can be referenced to a rating of a speaker C40 or a total harmonic distortion (THD) limiter level.

After the main audio signal C41 and the side chain audio signal C42 have been, for example, attenuated (e.g., attenuated at a specified rate (which can be referred to as an attenuation rate or as an attack rate)), the timer 3036 can be configured to trigger and/or release an attenuation or increase of the audio signal at a specified rate. For example, the timer 3036 can be configured to release or trigger an attenuation of the main audio signal C41 (and the side chain audio signal C42) a specified amount over a specified period of time. In some embodiments, the timer 3036 can be configured using, for example, a digital input value (e.g., a 2-bit input value, an 8-bit input value). In some embodiments, the digital input value into the timer 3036 can be referred to as release rate value or as an attack rate value. An example of rate values that can be used to selectively trigger a rate by the timer 3036 is shown in FIG. 30C.

As shown in FIG. 30C, a rate value RR of "10" can be configured to trigger a change of (e.g., trigger release of) an attenuated signal at a rate of 30 μs per step. In some embodiments, the step size can be, for example, a specified frequency step or range (e.g., a frequency step of approximately 33 Hz), represented by a count value, a specified resistor increment of the resistor V420 of the variable gain module 3020, and/or so forth. Although not shown, in some embodiments, the timer 3036 can also be configured to trigger a specified hold time period.

The low-pass filter 3032 is configured to receive and/or implement a low (or minimum) frequency cut-off value and/or a high (or maximum) cutoff frequency value (which can collectively define a range of frequency values) used to produce the side chain audio signal C42. In some embodiments, the low-pass filter 3032 can be configured using, for example, digital input values (e.g., 2-bit input values, 8-bit input values). In some embodiments, digital input values into the low-pass filter 3032 can be referred to as cutoff frequency bit values. An example of cutoff frequency bit values that can be used by the low-pass filter 3032 to define a low (or minimum) frequency cut-off value and/or a high (or maximum) cutoff frequency value is shown in FIG. 30D. As shown in FIG. 30D, a cutoff frequency bit value Fc of "01" can be configured to trigger a low-pass cutoff frequency value of 1400 Hz in the low-pass filter 3032 (e.g., by adjusting an resistor-capacitor (RC) time constant through variable resistor of the low-pass filter 3032).

The subtractor 3038 is configured to select an attenuation level of the variable gain module 3020 and the variable gain module 3033. For example, the subtractor 3038 can be configured to trigger implementation (e.g., via the resistor V420) of a level (e.g., an attenuation level, a gain level) specified for the variable gain module 3020 until a threshold voltage value or limit specified using the level detector 3034 is exceeded. In response to the threshold voltage value or limit being exceeded, the subtractor 3038 can be configured to change the level of the variable gain module 3020.

In some embodiments, the subtractor 3038 can be configured using, for example, digital input values (e.g., 2-bit input values, 8-bit input values). In some embodiments, digital input values into the subtractor 3038 can be referred to as subtractor bit values. In some embodiments, a maximum and/or minimum level (e.g., attenuation level, gain level) that can be specified by subtractor bit values.

In some embodiments, other types of modules can be used to produce the side chain audio signal C42. For example, in some embodiments, a low-end shelving booster can be used in place of, or in conjunction with, the low-pass filter 3032 shown in FIG. 30A. In some embodiments, target frequencies (e.g., relatively low frequencies) can be boosted (e.g., pre-emphasized) as the side chain audio signal C42. The boosted target frequencies can be analyzed by, for example, by the level detector 3034 before non-target frequencies. Accordingly, the excursion limiter 3030 can be configured to trigger or not trigger a change in a level of the main audio signal C41 frequencies based on targeted frequencies that are boosted by the low-end shelving booster.

Although not shown, in some embodiments, various components can be included in the excursion limiter 3030 to compensate for, for example, phase shifting in the side chain audio signal C42. In some embodiments, the side chain audio signal C42 can be based on the main audio signal C41 after the variable gain module 3020, rather than based on the main audio signal C41 before the variable gain module 3020. In such embodiments, various components can be included in the excursion limiter 3030 to compensate for, for example, phase shifting.

In some embodiments, an additional amplifier (e.g., with a fixed impedance and/or a fixed input capacitor) can be coupled to the input node VIN. The main audio signal C41 roll-off provided by the detection and protection system 3000 can be complemented by the additional amplifier. The additional amplifier can attenuate (or cause roll-off) of displacement of the speaker B10 (which could cause excursions) at relatively low frequencies (e.g., below 100 Hz, below 50 Hz, below 20 Hz).

In some implementations, a low pass filter −3 dB point is selected from a predefined set. In some implementations, this signal is sent off as a key input to a side chain limiter. In some implementations, a side chain limiter level is selected from a predefined set. In some implementations, attack and release times are selected from a predefined set. An example set is illustrated in FIGS. 30B through 30D.

Figure 31:
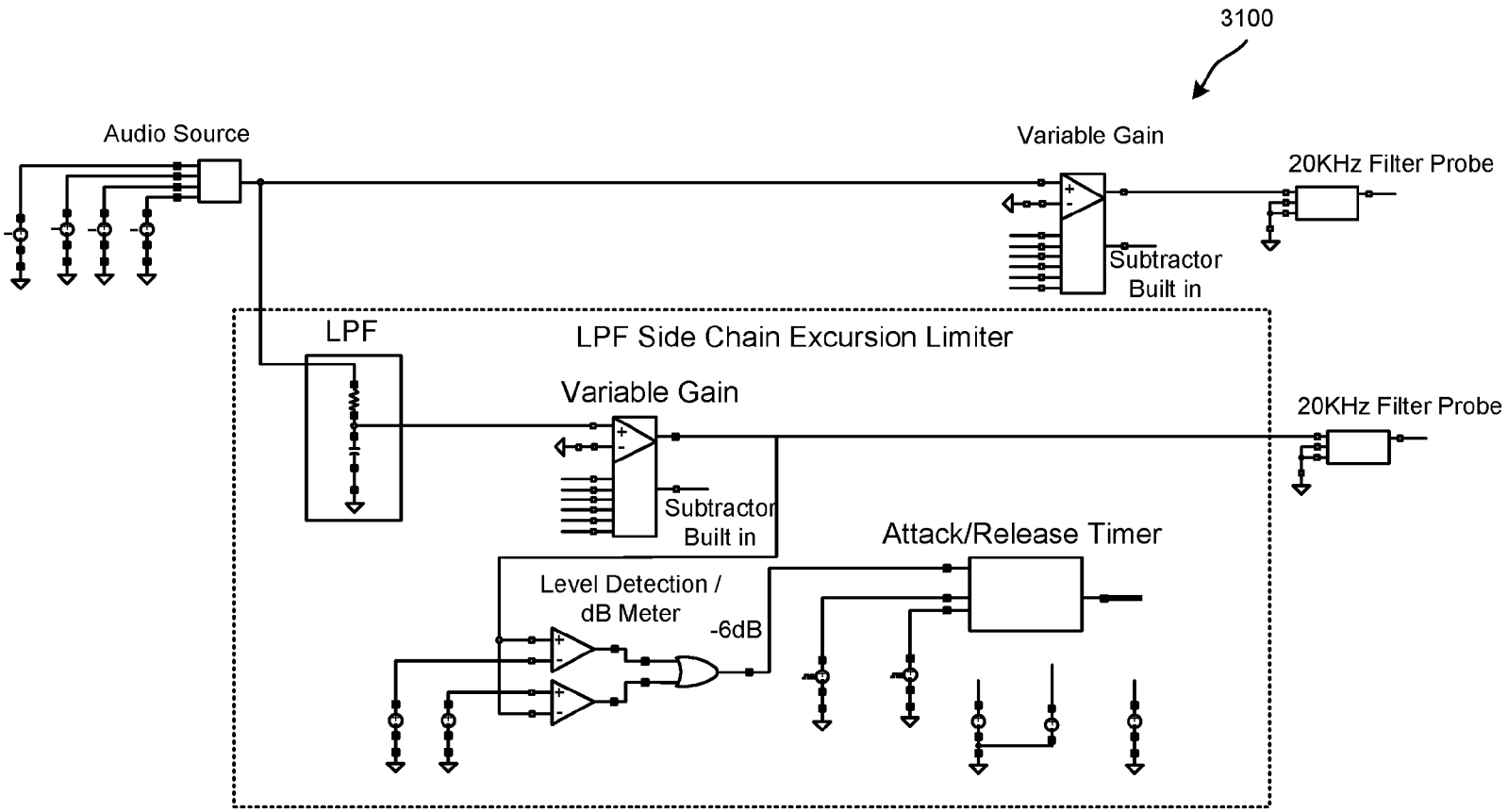
FIG. 31 is a diagram that illustrates an implementation of the detection and protection system shown in FIG. 30A.

FIG. 31 is a diagram that illustrates an implementation of the detection and protection system shown in FIG. 30A. The detection and protection system 3100 includes an excursion limiter 3130. The excursion limiter 3130 includes, for example, a timer, a level detector, and so forth.

Figure 32:
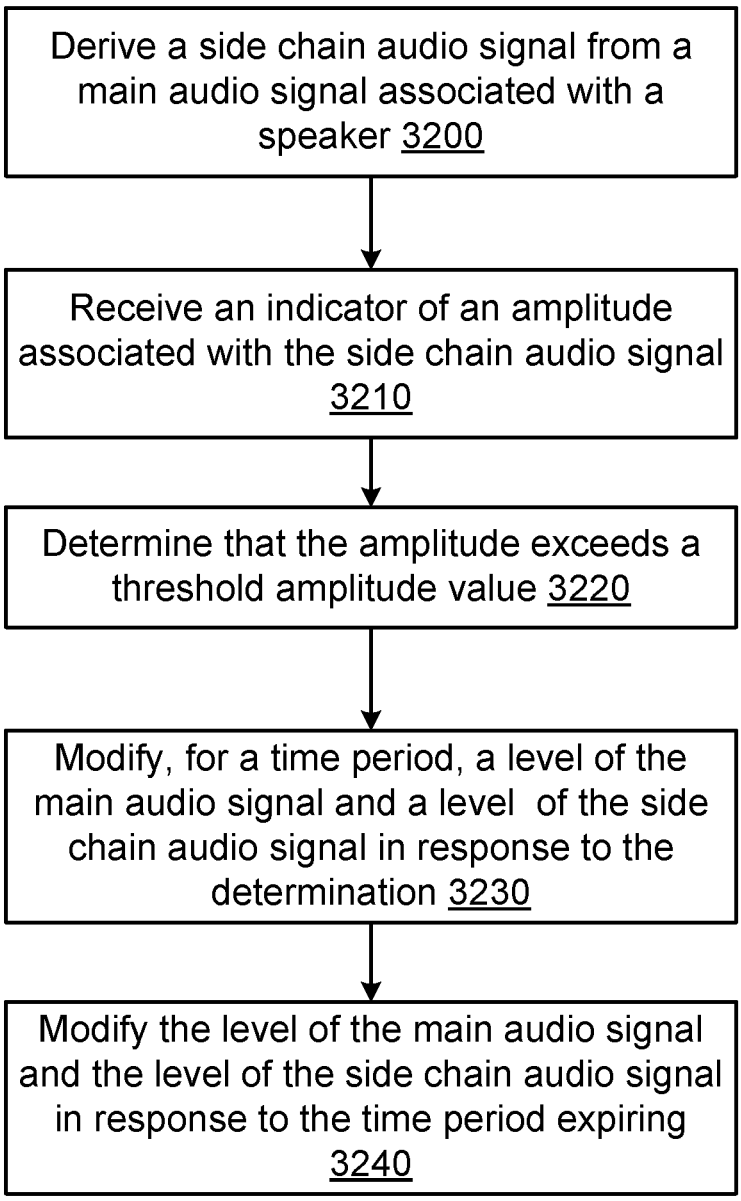
FIG. 32 is a flowchart that illustrates a method for modifying a main audio signal to a speaker based on side chain analysis.

FIG. 32 is a flowchart that illustrates a method for modifying a main audio signal to a speaker based on side chain analysis. In some embodiments, at least some portions of the method shown in FIG. 32 can be performed by, for example, the components of the detection and protection system 2700 shown in FIG. 27 and/or the components of the detection and protection system 3000 shown in FIG. 30A.

As shown in FIG. 32, a side chain audio signal is derived from a main audio signal associated with a speaker (block 3200). The side chain audio signal can include a specified range of frequencies of the main audio signal. In some embodiments, the side chain audio signal can be derived using the low-pass filter 3032 shown in FIG. 30A. In some embodiments, the low-pass filter 3032 can be an analog input filter.

An indicator of an amplitude of the side chain audio signal is received (block 3210). In some embodiments, the indicator of the amplitude can be processed at the excursion limiter 3030 after the low-pass filter 3020 shown in FIG. 30A. In some embodiments, the indicator of the amplitude can be, for example, a voltage. In some embodiments, the audio signal can be produced by the audio signal generator 2710 shown in FIG. 27.

The amplitude of the side chain audio signal is determined to exceed a threshold amplitude value (block 3220). In some embodiments, the threshold amplitude value can be set at a level to avoid, for example, physical damage to the speaker in response to the main audio signal. In some embodiments, the threshold amplitude value can be selectively defined by, for example, the level detector 3034 shown in FIG. 30A.

A level of the main audio signal and a level of the side chain audio signal are modified for a time period in response to the determination (block 3230). In some embodiments, the variable gain module 3020 and the variable gain module 3033 included in the excursion limiter 3030 can be configured to modify the level of the main audio signal and the level of the side chain audio signal, respectively, at approximately the same time as shown in FIG. 30A. In other words, the level of the main audio signal can be mirrored by the level of the side chain audio signal. In some embodiments, the period of time can be selectively defined by the timer 3036 shown in FIG. 30A. In some embodiments, the magnitude of the change of the level of the main audio signal and the level of the side chain audio signal can be from a first level to a second level that can be selectively defined by the decoder 3034 shown in FIG. 30A. In some embodiments, the main audio signal and the side chain audio signal are modified to different levels (e.g., proportionally to different levels, different levels that are correlated via a relationship).

The level of the main audio signal and the level of the side chain audio signal are modified in response to the time period expiring (block 3240). In some embodiments, the duration of time period can, in some embodiments, be selectively defined by the timer 3036 shown in FIG. 30A. In some embodiments, the level of the main audio signal and/or the level of the side chain audio signal are modified to the level associated with block 3230. In some embodiments, the main audio signal and/or the side chain audio signal are modified to different levels (e.g., proportionally to different levels, different levels that are correlated via a relationship).

Figure 33A:
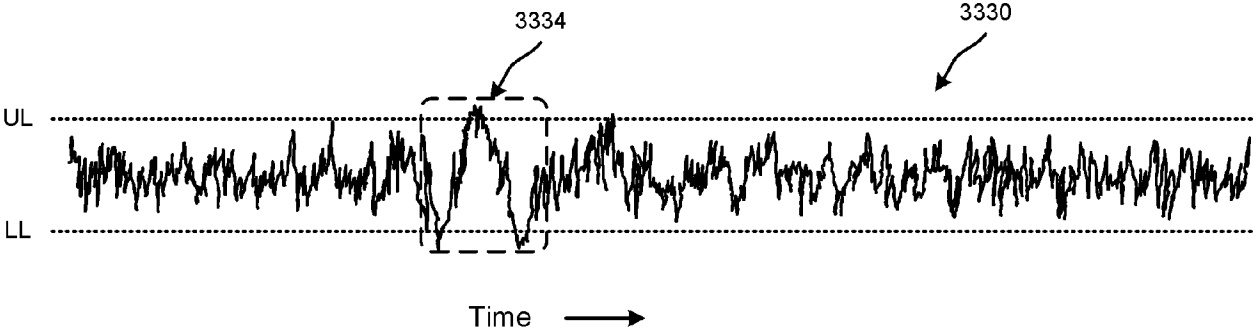
FIGS. 33A and 33B are graphs that illustrate operation of a detection and protection system, according to an embodiment.
Figure 33B:
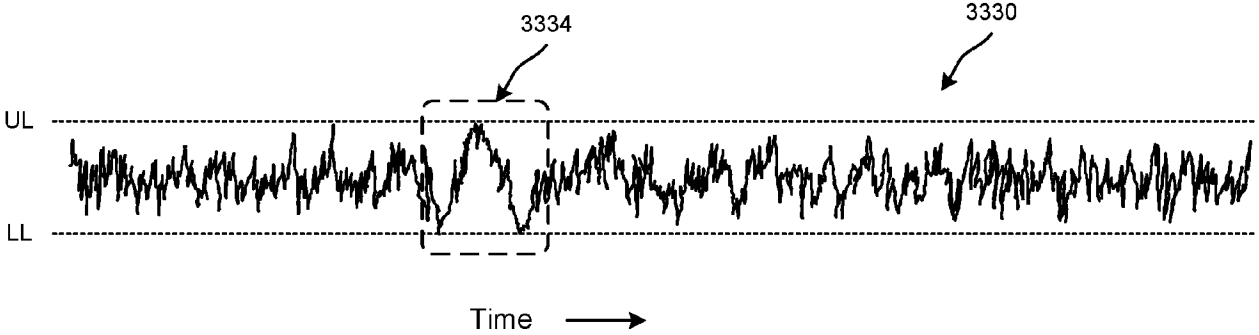

FIGS. 33A and 33B are graphs that illustrate operation of a detection and protection system, according to an embodiment. In these graphs, time is increasing to the right. Specifically, FIG. 33A is a graph that illustrates a main audio signal 3330 produced by an audio signal generator. FIG. 33B is a graph that illustrates a portion 3334 of the main audio signal 3330 being attenuated in response to side chain analysis.

As shown in FIG. 33A, the portion 3334 of the main audio signal 3330 includes a low frequency component that exceeds an upper amplitude limit UL (which can be referred to as an upper threshold amplitude limit or value) and a lower amplitude limit LL (which can be referred to as a lower threshold amplitude limit or value). In some embodiments, the main audio signal 3330 can be produced by the audio signal generator 2710 shown in FIG. 27. The portion 3334 of the main audio signal 3330 (which include both low frequency signals and high frequency signals) can be attenuated based on an analysis of a side chain audio signal (not shown) derived from the main audio signal 3330.

Although not explicitly shown in FIGS. 33A and 33B, in some embodiments, the level (e.g., an audio level, an attenuation level, a gain level, a dB level) of the main audio signal 3330 can be triggered to start decreasing at a specified rate and/or can be triggered to start increasing at a specified rate. Although not explicitly shown in FIGS. 33A and 33B, in some embodiments, the attenuation level can be triggered to start decreasing (e.g., decreasing at a release rate) only after a hold time period has expired. Specifically, the attenuation level can be triggered to start decreasing after the amplitude of the portion 3334 of the main audio signal 3330 decreases to a level between the limits (i.e., the upper threshold amplitude limit UL and the lower threshold amplitude limit LL) and after a hold time has expired. In some embodiments, the main audio signal 3330 can continue to be attenuated (e.g., can be attenuated at a constant/static level or based on a static attenuation profile) for a hold time (even though the portion 3334 of the main audio signal 3330 has decreased to a level between the limits) so that the main audio signal 3330 may not be temporarily changed if the decrease to a level between the limits is only temporary.

Figure 34:
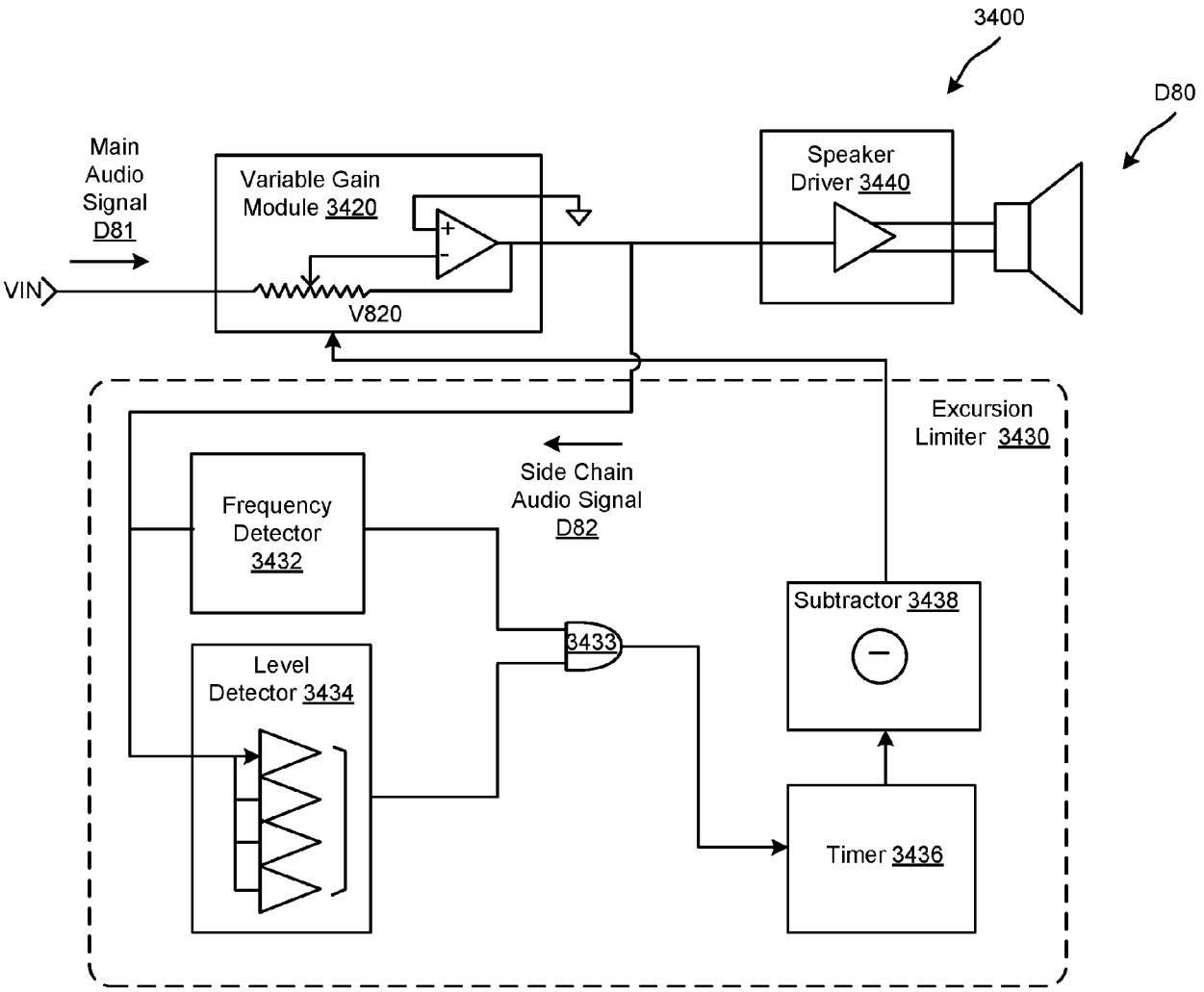
FIG. 34 is a diagram that illustrates another detection and protection system, according to an embodiment.

FIG. 34 is a diagram that illustrates another detection and protection system 3400, according to an embodiment. As shown in FIG. 34, a speaker driver 3440 is coupled to a speaker D80. The speaker driver 3440 is configured to receive a main audio signal D81 produced by an audio signal generator (not shown) from an input node VIN via a variable gain module 3420.

The detection and protection system 3400 includes an excursion limiter 3430 configured to perform side chain analysis. Specifically, the detection and protection system 3400 is configured to receive (e.g., derive) a side chain audio signal D82 at an output of the variable gain module 3420. Based on an analysis of the side chain audio signal D82, the excursion limiter 3430 can be configured to trigger the variable gain module 3420 to change (e.g., attenuate, increase) a level of the main audio signal D81. In some embodiments, the detection and protection system 3400 can be configured to receive (e.g., derive) a side chain audio signal D82 at an input of the variable gain module 3420. In such embodiments, the detection and protection system 3400 can include a mirroring variable gain module.

As shown in FIG. 34, an excursion limiter 3430 includes a frequency detector 3432, a level detector 3434, a timer 3436, and a subtractor 3438. The frequency detector 3432 and the level detector 3434 are configured to receive and analyze the side chain audio signal D82. In some embodiments, the frequency detector 3432 can be configured to determine that a frequency of the side chain audio signal D82 is within a specified frequency range, is less than a threshold frequency value, is greater than a threshold frequency value, and/or so forth. In some embodiments, the frequency detector 3432 can be configured to produce a parameter value representing the frequency of the side chain audio signal D82 as being within a specified frequency range, being less than a threshold frequency value, being greater than a threshold frequency value, and/or so forth. In some embodiments, the frequency detector 3432 can be configured to detect a frequency by measuring a duration of a cycle (or portion thereof (e.g., a peak)) of the main audio signal D81.

As shown in FIG. 34, a result value (e.g., a parameter value, a value, a binary value) produced by the frequency detector 3432 and a result value (e.g., a parameter value, a value, a binary value) produced by the level detector 3434 can be configured to trigger or not trigger a change in a level of the main audio signal D81. Specifically, a combination (e.g., an "AND" combination) of a result value (e.g., a value, a binary value) produced by the frequency detector 3432 and a result value (e.g., a value, a binary value) produced by the level detector 3434 can be configured to trigger or not trigger a change in a level of the main audio signal D81. In some embodiments, a combination of a result value produced by the frequency detector 3432 and a result value produced by the level detector 3434 can be configured to trigger or not trigger a change (e.g., an attenuation, an increase) in a level of the main audio signal D81, for example, at a specified rate, with a specified hold time, and/or so forth. In some embodiments, one or more instructions configured to trigger or not trigger a change in a level of the main audio signal D81 can be produced based on a result value produced by the frequency detector 3432 and a result value produced by the level detector 3434. As shown in FIG. 34, the combination can be via an AND gate 3433 (or other type of Boolean logic combination).

For example, if the frequency detector 3432 determines that the side chain audio signal D82 is within a target frequency range (e.g., a target low frequency range) and if a threshold level (e.g., a threshold condition) of the level detector 3434 is exceeded, the timer 3436 and the subtractor 3438 can be configured to trigger an attenuation in a level of the main audio signal D81. If the frequency detector 3432 determines that the side chain audio signal D82 is outside of a target frequency range (e.g., a target low frequency range) or if a threshold level (e.g., a threshold condition) of the level detector 3434 is not exceeded, the timer 3436 and the subtractor 3438 can be configured to not trigger (e.g., amy hold) an attenuation in a level of the main audio signal D81. In some embodiments, if the frequency detector 3432 determines that the side chain audio signal D82 is outside of a target frequency range (e.g., a target low frequency range) or if a threshold level (e.g., a threshold condition) of the level detector 3434 is not exceeded, the timer 3436 and the subtractor 3438 can be configured to not trigger an increase in a level of the main audio signal D81.

The level detector 3434 can be configured to select a threshold voltage value or limit (which can be correlated with a threshold amplitude value) associated with the side chain audio signal D82. After the main audio signal D81 has been attenuated (e.g., attenuated at a specified rate), the timer 3436 can be configured to trigger or release an attenuation or increase of the audio signal at a specified rate. The subtractor 3438 is configured to select an attenuation level of the variable gain module 3420. In some embodiments, the components of the detection and protection system 3400 (e.g., the frequency detector 3432, the timer 3436) can be triggered using one or more clock signals (e.g., clock signals produced by one or more oscillators (not shown).

In some implementations, instead of a low pass filter, a low end shelving boost can be used. In some implementations, low frequencies are boosted (pre-emphasized) to impact the limiter first.

In some implementations, the output of the gain control circuit is sent to a side chain limiter before it is sent to the speaker amp. In some implementations, two detect circuits are implemented that monitor this signal. In some implementations, a frequency threshold detect can be implemented. In some implementations, an amplitude threshold detect can be implemented. In some implementations, if it has been determined that both the amplitude of the signal is above the threshold and that there is energy below the preselected frequency, the circuit can be configured to move down on the gain. In some implementations, if either of the conditions goes away, the circuit can be configured to release back to the original gain setting.

Figure 35:
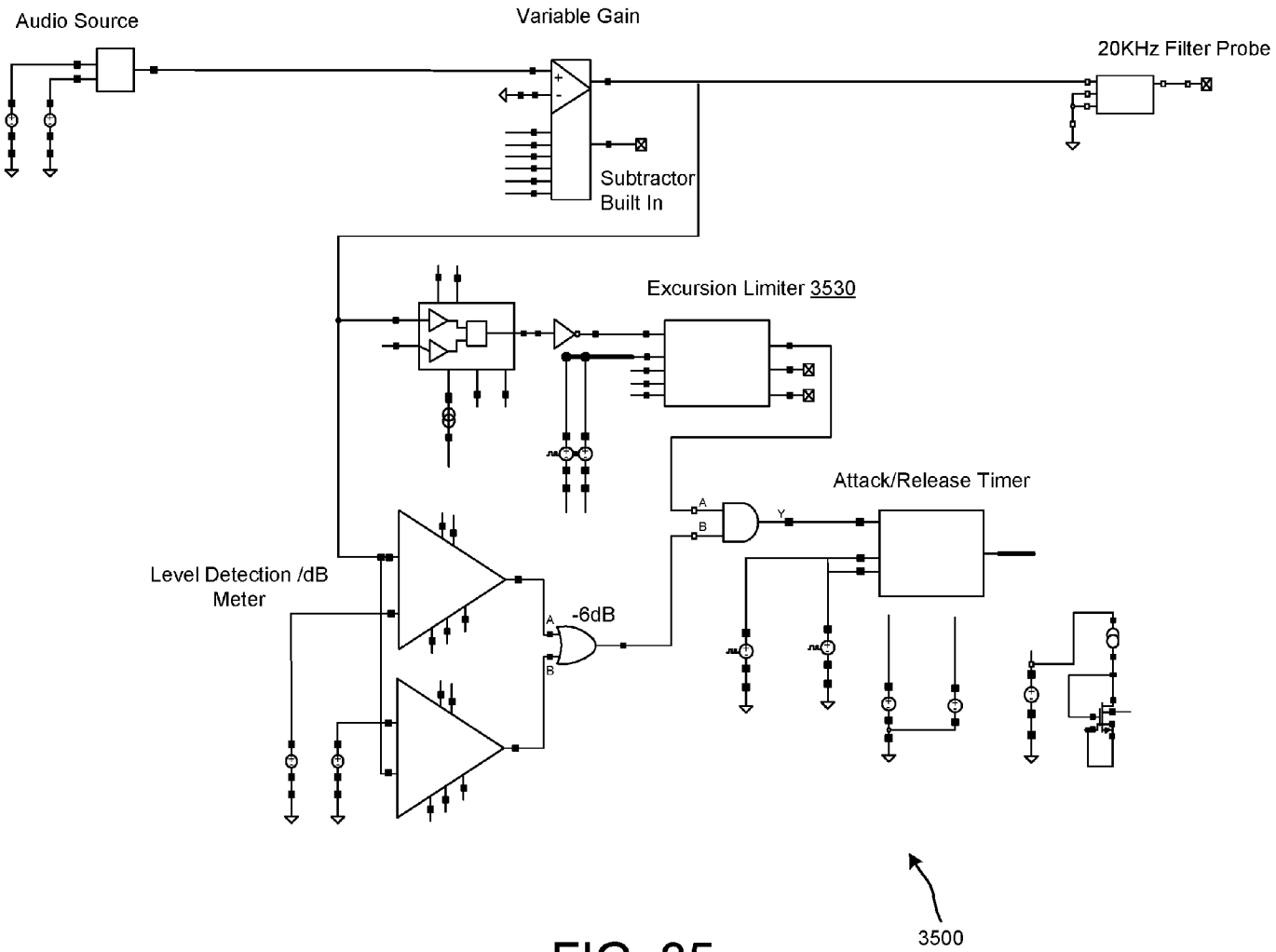
FIG. 35 is a diagram that illustrates an implementation of the detection and protection system shown in FIG. 34.

FIG. 35 is a diagram that illustrates an implementation of the detection and protection system shown in FIG. 34. The detection and protection system 3500 includes an excursion limiter 3530. The excursion limiter 3530 includes a frequency detector and a level detector configured to collectively analyze a side chain audio signal and trigger a change in a level of a main audio signal.

Figure 36:
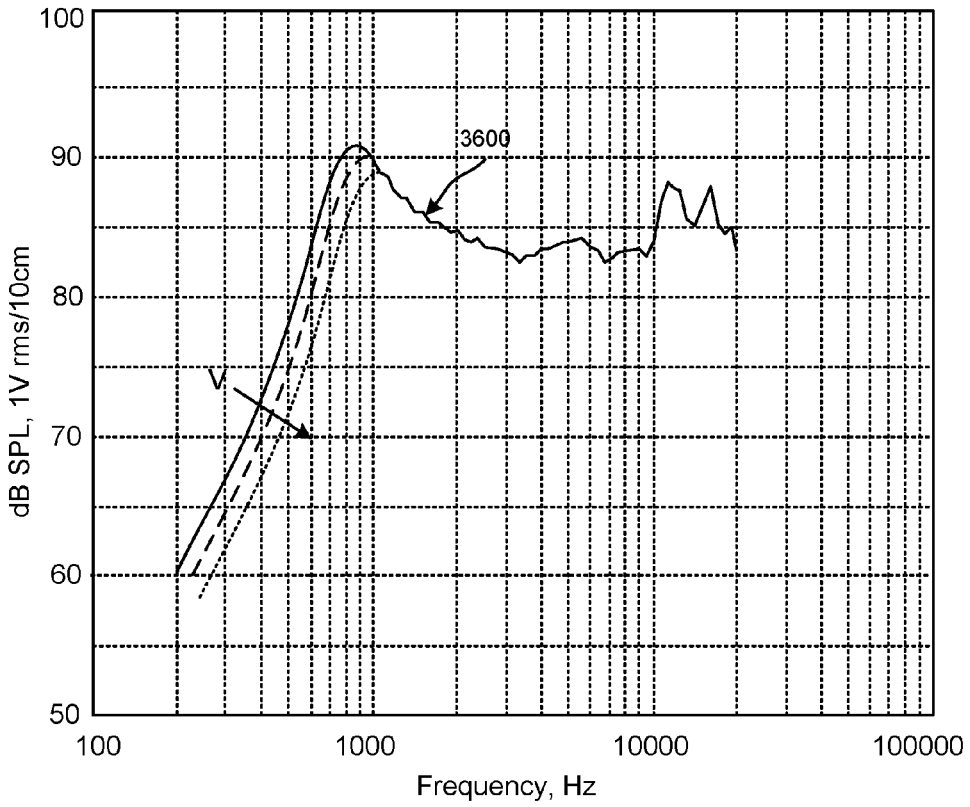
FIG. 36 is a graph that illustrates a pressure level response of a speaker based on an audio signal.

FIG. 36 is a graph that illustrates a pressure level response 3600 of a speaker based on a main audio signal. Specifically, the speaker pressure level (SPL) is illustrated along the y-axis in decibels (dB) and a frequency of the main audio signal into the speaker is illustrated along the x-axis along a logarithmic scale in Hz. In some embodiments, the pressure level response 3600 of the speaker based on the main audio signal can be referred to as or can be representative of an attenuation profile.

FIG. 36 illustrates the effects of changing a high-pass cutoff frequency of a high-pass filter configured to filter out relatively low frequencies of the main audio signal. Specifically, the pressure level response 3600 of the speaker at relatively low frequencies (e.g., at frequencies below approximately 1000 Hz) moves along direction V as the high-pass cutoff frequency of the high-pass filter is increased (e.g., increased in response to a decrease in a resistance of a variable resistor).

Figure 37:
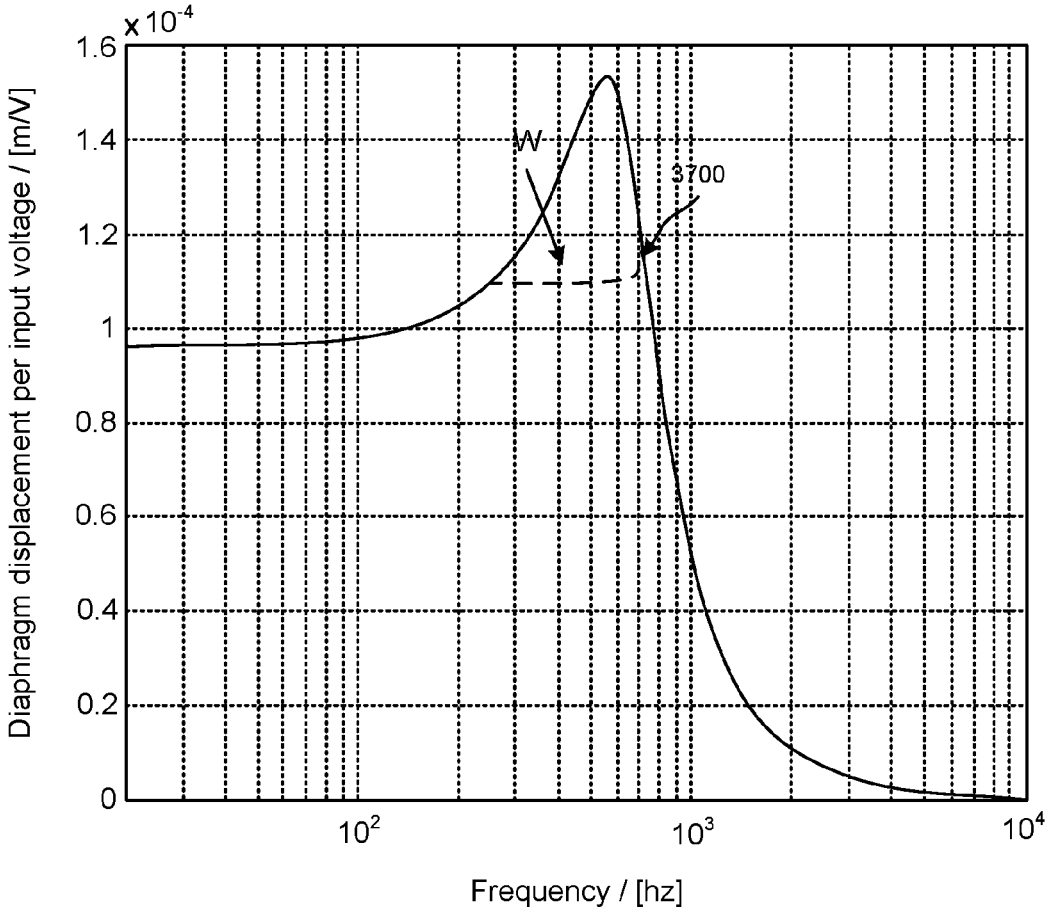
FIG. 37 is a graph that illustrates a diaphragm displacement of a speaker in response to an audio signal.

FIG. 37 is a graph that illustrates a diaphragm displacement 3700 of a speaker in response to a main audio signal. Specifically, the diaphragm displacement per input voltage is illustrated along the y-axis and a frequency of the main audio signal into the speaker is illustrated along the x-axis along a logarithmic scale in Hz. In some embodiments, the diaphragm displacement 3700 of the speaker in response to the main audio signal can be referred to as or can be representative of an attenuation profile.

FIG. 37 illustrates the effects of changing a high-pass cutoff frequency of a high-pass filter configured to filter out relatively low frequencies of the main audio signal. Specifically, the diaphragm displacement 3700 of the speaker at relatively low frequencies (e.g., at frequencies below approximately 1000 Hz) moves along direction W as the high-pass cutoff frequency of the high-pass filter is increased (e.g., increased in response to a decrease in a resistance of a variable resistor).

Figure 38:
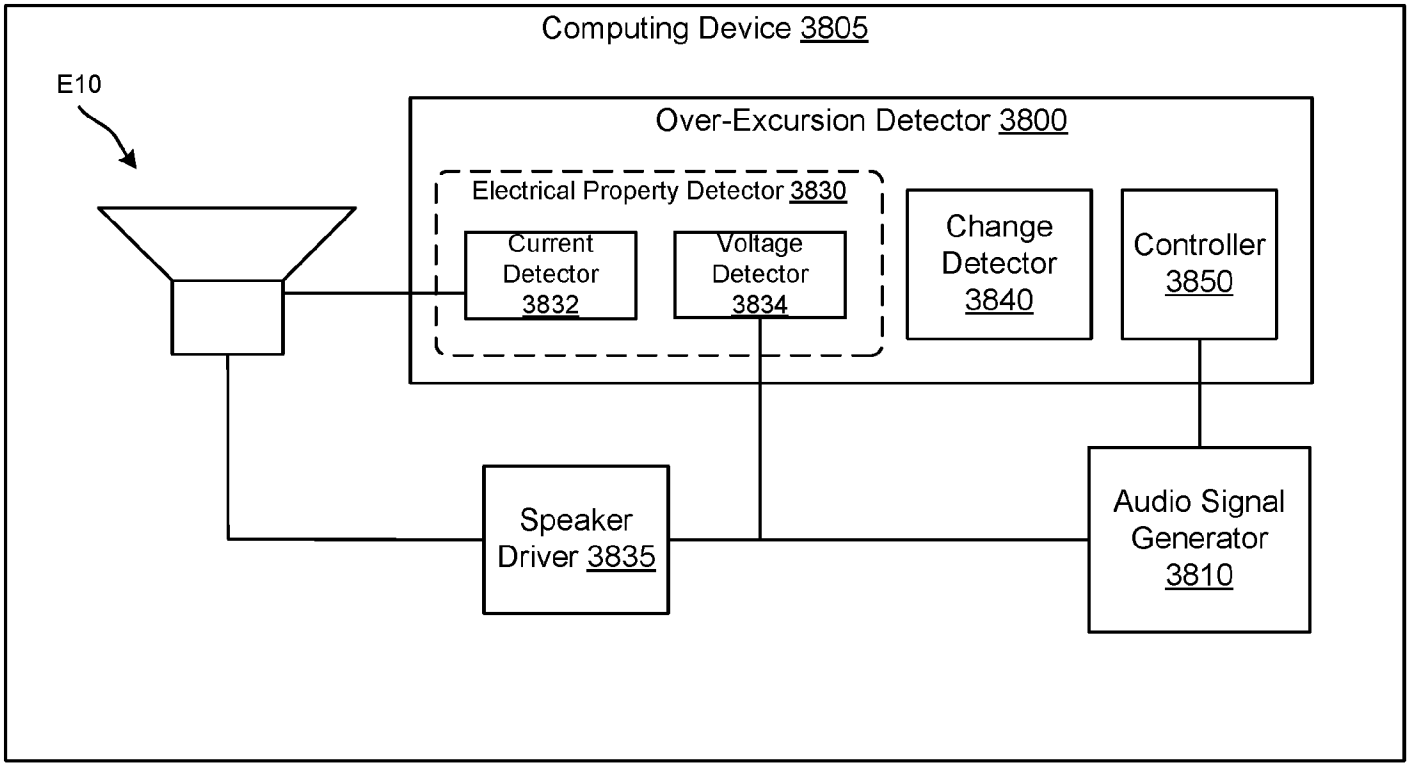
FIG. 38 is a diagram that illustrates an over-excursion module configured to detect and prevent mechanical damage to a speaker.

FIG. 38 is a diagram that illustrates an over-excursion module 3800 configured to detect and prevent mechanical damage to a speaker E10 (or a portion thereof). For example, the over-excursion module 3800 can be configured to detect a displacement of the speaker E10 and can be configured to change (e.g., modified, attenuate, increase gain of) a level (e.g., an audio level, a decibel (dB) level, a gain level, an attenuation level) of an audio signal driving the speaker E10 based on the detected displacement so that the speaker E10 may not be damaged in an undesirable fashion due to, for example, mechanical contact (which can be referred to as over-excursions) between components included in the speaker E10. In some embodiments, the speaker E10 can be permitted to be driven to the point of fullest possible physical excursion while preventing over-stress induced damage. Accordingly, the maximum possible loudness can be achieved while simultaneously steering away from audio distortion and/or damage to the speaker E10 that over-excursion (e.g., over-stressing of a suspension or deleterious impact of a diaphragm of the speaker E10 against a frame of the speaker E10) could otherwise cause.

In some implementations, a microspeaker diaphragm can be driven to the point of its fullest possible physical excursion while preventing over-stress induced damage. This can permit, for example, maximum possible loudness while simultaneously steering away from audio distortion and/or speaker damage that over-excursion (over-stressing of the suspension or deleterious impact of the diaphragm against the frame) could otherwise cause. In some implementations, continuously monitoring the relationship of speaker voltage to actual speaker current (impedance) can be implemented. Should over-excursion occur, the resulting impeded diaphragm motion (non-compliance of the suspension material or actual impact between the diaphragm and speaker frame) can cause the voice coil to exhibit a change in electrical impedance that can be sensed by circuitry. The circuitry can respond with a reduction in audio signal level in order to stop the undesirable stress from occurring.

Figure 39:
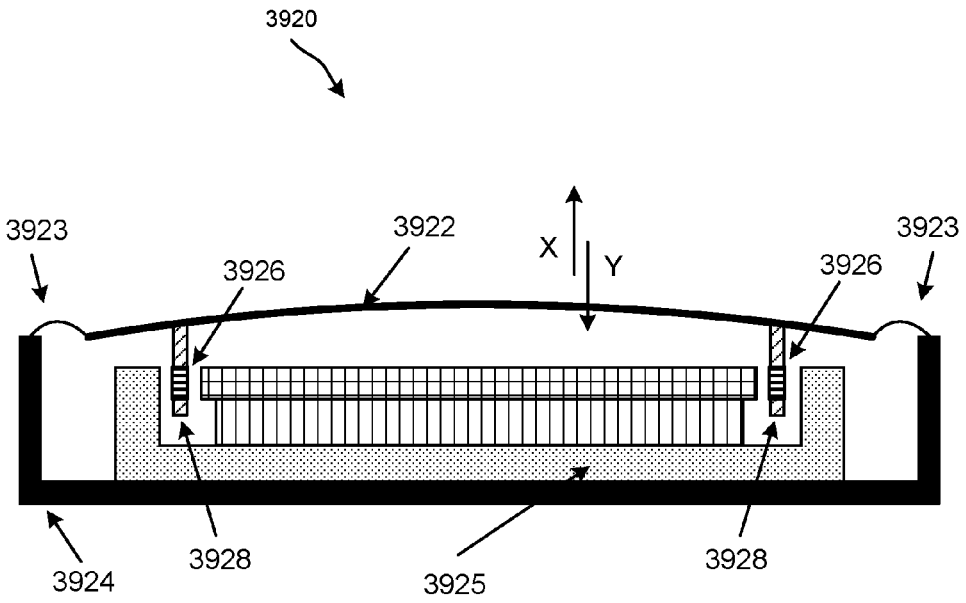
FIG. 39 is a diagram that illustrates a cross-sectional view of a speaker that can be protected using the over-excursion module shown in FIG. 38.

FIG. 39 is a diagram that illustrates a cross-sectional view of a speaker 3920 that can be protected using the over-excursion module 3800 shown in FIG. 38. As shown in FIG. 39, the speaker 3920 includes a diaphragm 3922 coupled via suspension members 3923 to a frame 3924. When current is applied to a voice coil 3926 of the speaker 3920 (in response to an audio signal), the voice coil 3926 can interact with magnetic circuitry 3925 to cause movement of the diaphragm 3922 in the X direction and the Y direction to produce sound. When a relatively large amount of current is applied to the voice coil 3926, the speaker 3920 can be mechanically damaged when the voice coil 3926 moves a relatively significant amount in the Y direction until a bottom portion 3928 of the voice coil 3926 contacts the magnetic circuitry 3925 (or frame 3924 in some embodiments). This type of movement, which can cause mechanical damage, can be referred to as an excursion.

Referring back to FIG. 38, in some embodiments, the speaker E10 can be associated with (e.g., included in) a computing device 3805 such as, for example, a mobile phone, a smartphone, a music player (e.g., an MP3 player, a stereo), a videogame player, a projector, a tablet device, laptop computer, a television, a headset, and/or so forth. The speaker E10 can be configured to produce sound (e.g., music, vocal tones) in response to audio signals produced by an audio signal generator 3810 of the computing device 3805. Specifically, a speaker driver 3835 (which can include, for example, an amplifier) can be configured to receive the audio signals produced by the audio signal generator 3810 and can be configured to trigger the speaker E10 to produce sound based on the audio signals. In some embodiments, the audio signal generator 3810 can be configured to produce audio signals associated with a music player (e.g., an MP3 player), a telephone, a videogame, and/or so forth. In some embodiments, the speaker driver 3835 can define at least a portion of a class D amplifier, a class A and/or B amplifier, and/or so forth. In some embodiments, the speaker E10 can be a micro-speaker.

As shown in FIG. 38, the over-excursion module 3800 includes an electrical property detector 3830, a change detector 3840, and a controller 3850. The over-excursion detector 3880 is configured to detect an over-excursion event based on monitoring (e.g., analyzing) of one or more electrical properties of the speaker E10 using the electrical property detector 3830. In response to one or more of the monitored electrical properties (or values (e.g., error values) derived therefrom) of the speaker E10 exceeding a threshold value or limit (which can be included in a threshold condition) as determined by the change detector 3840, the controller 3850 of the over-excursion detector 3880 can be configured to modify (e.g., attenuate) a level of one or more audio signals produced by the audio signal generator 3810 and being delivered to the speaker E10 via the speaker driver 3835 to prevent (or mitigate) damage to the speaker E10. In some embodiments, the electrical properties monitored by the over-excursion module 3800 can be targeted to relatively low-frequency portions of one or more of the audio signals, which can cause damage to the speaker E10, produced by the audio signal generator 3810.

As a specific example, the electrical property detector 3830 includes a current detector 3832 and a voltage detector 3834 configured to selectively monitor an impedance of at least a portion of the speaker E10. The current detector 3832 can be configured to measure a current through a voice coil (not shown) of the speaker E10, in response to an audio signal produced by the audio signal generator, and the voltage detector 3834 can be configured to monitor a voltage (which can correspond with an amplitude) of the audio signal produced by the audio signal generator 3810. The current through voice coil and the voltage of the audio signal can be used to calculate a value such as an impedance value, error value, and/or so forth. In response to, for example, a diaphragm of the speaker E10 impacting a surface of the speaker E10 (e.g., a speaker frame) in an undesirable fashion, the value can change in a relatively rapid fashion (e.g., can spike). If the value of the speaker E10 exceeds a threshold value as determined by the change detector 3840, the controller 3850 can be configured to attenuate (e.g., reduce) a level of the audio signal produced by the audio signal generator 3810 for specified period of time. In response to detecting the over-excursion event via the value, the over-excursion detector 3880 can prevent or mitigate an undesirable level (e.g., excessive level) of stress to the speaker E10 from occurring. In some embodiments, over-excursion events subsequent to the over-excursion event triggering attenuation for the specified period of time can be reduced and/or eliminated (e.g., prevented).

Based on electrical property analysis, the over-excursion module 3800 can be configured to change (e.g., modify, increase, decrease, attenuate) a level of a specified range of frequencies of one or more audio signals (which can be referred to as targeted audio signals). For example, the over-excursion module 3800 can be configured so that audio signals related to, for example, bass resonant frequencies, which can cause relatively large sound pressure level and displacement of the components of the speaker E10 (relative to high frequencies (e.g., treble frequencies)), can be attenuated within the audio signals. In other words, one or more threshold values associated with electrical properties can be defined to trigger attenuation by the controller 3850 of the over-excursion detector E100 of targeted amplitudes. In some embodiments, the over-excursion module 3800 can be configured so that an audio signal produced by the audio signal generator 3810 can be increased (e.g., magnified) in response to satisfying a condition related to a threshold value (which can be represented as a parameter such as a voltage value, a current value, a level value, etc.) associated with an electrical property.

In some embodiments, a timing with which the over-excursion module 3800 triggers a change (e.g., an increase, a decrease), via the controller 3850, of a level (e.g., an attenuation level, a gain level) of one or more audio signals produced by the audio signal generator 3810 based on electrical property analysis can vary. For example, the over-excursion module 3800 can be configured to trigger the controller 3850 to change a level of an audio signal produced by the audio signal generator 3810 only after one or more electrical properties (e.g., a value of one or more electrical properties (or value(s) derived therefrom)) exceed a threshold value for more than a specified time period (based on an analysis of the electrical properties). As another example, the over-excursion module 3800 can be configured to immediately trigger the controller 3850 to attenuate (e.g., attack) an audio signal produced by the audio signal generator 3810. The over-excursion module 3800 can be configured to maintain (e.g., hold) the attenuated audio signal for a specified period of time (which can be referred to as a hold time). After the hold time has expired, the over-excursion module 3800 can be configured to restore (e.g., no longer attenuate, attenuate to a lesser extent) the audio signal. In some embodiments, the audio signal can be restored to an unattenuated level or a lesser attenuated level. In some embodiments, the over-excursion module 3800 can be configured to maintain the attenuated audio signal for the hold time (even though the electrical property has dropped below a threshold value) so that the audio signal is not prematurely released to a lesser attenuated (or prior unattenuated) level or to prevent adjustment in an undesirable fashion in response to temporary drops (or aberrations) in the electrical property.

In some embodiments, the over-excursion module 3800 can be configured to trigger a specified magnitude of change (e.g., an increase, a decrease) to a level (e.g., an attenuation level, a gain level) of one or more audio signals based on electrical property analysis. For example, the over-excursion module 3800 can be configured to trigger the controller 3850 to attenuate (or increase attenuation of) an audio signal produced by the audio signal generator 3810 a specified magnitude, or increase (or scale-up) a level of an audio signal produced by the audio signal generator 3810 a specified magnitude (based on an analysis of an electrical property (or value derived therefrom)).

In some embodiments, the over-excursion module 3800 can be configured to change (e.g., increase, decrease) a level of one or more audio signals at a specified rate (e.g., a linear rate, a step-wise rate, a non-linear rate) based on electrical property analysis (or analysis of a value derived therefrom). For example, the over-excursion module 3800 can be configured to trigger the controller 3850 to immediately attenuate or increase a level of an audio signal produced by the audio signal generator 3810 (based on an analysis of an electrical property (or analysis of a value derived therefrom)). As another example, the over-excursion module 3800 can be configured to trigger the controller 3850 to slowly (e.g., gradually rather than abruptly) attenuate an audio signal at a specified rate in a continuous fashion, in discrete intervals, in non-linear fashion, and/or so forth (based on an analysis of an electrical property (or analysis of a value derived therefrom)). In some embodiments, the over-excursion module 3800 can be configured to change (e.g., increase, decrease) a level of one or more audio signals dynamically vary, at different rates between cycles, and/or so forth (based on an analysis of an electrical property (or analysis of a value derived therefrom)).

In some embodiments, the over-excursion 3800 can include any combination of analog components, digital components, active components, and/or so forth. For example, the controller 3850 can be an analog controller, a digital controller, and/or so forth. In some embodiments, the over-excursion module 3800, the speaker driver 3835, and/or the audio signal generator 3800 can be implemented as a digital signal processing (DSP) unit, an application specific integrated circuit (ASIC), a central processing unit, and/or so forth.

In some embodiments, the over-excursion module 3800 (or portions thereof), the speaker driver 3835, and/or the audio signal generator 3810 can be integrated into a single integrated circuit, a single discrete component, and/or a single semiconductor die. In some embodiments, the over-excursion module 3800 (or portions thereof) can be processed in a single semiconductor die that can be integrated into a discrete component separate from the speaker driver 3835 and/or the audio signal generator 3810.

In some implementations, the system can include two loops: (a) a slow-acting inner loop that continuously balances internal signals that represent the load voltage and current, and (b) a fast-attack, slow-decay outer loop that monitors the error signal of the inner loop and acts to reduce the amplifier gain if a sudden jump in the error signal (associated with a spike in load current caused by an over-excursion (OE) event), is sensed.

In some implementations, the output of ADC1 (I<7:0>) can be a digital representation of the sensed load current; the output of ADC2 (V<7:0>) can be a digital representation of the load voltage (in replica form).

In some implementations, under normal load conditions, I<7:0> can be proportional to V<7:0> (the two values can differ in magnitude as a function of load impedance). In some implementations, the slow-acting loop formed by a summer, a low-pass filter, and a multiplier can nominally drive the error signal, Error Value <7:0>, to zero (or very close to zero, on average).

In some implementations, should a relatively large signal at the speaker cause the diaphragm to physically bottom out, the impedance of the speaker can momentarily drop, causing a spike in the value of I<7:0> and therefore in Error Value <7:0>.

A spike detector block can issue an Over-Excursion Flag (OEF) output. This can in turn be used to moderate the gain of the amplifier to reduce/eliminate subsequent over-excursion events. When over-excursion activity ceases, the AGC loop can (e.g., can gradually) restore the SPA to normal gain status. Should the increased gain result in future OE event(s), the slow-acting loop can be reinitiated.

FIGS. 40A through 40D are graphs that collectively illustrate operation of an over-excursion module (e.g., the over-excursion module 3800 shown in FIG. 38), according to an embodiment. As shown in FIGS. 40A through 40D, time is increasing to the right. The curves illustrated in FIGS. 40A through 40D are presented by way of example only and do not necessarily represent feedback loop non-idealities that can result in delays, phase shifts, and/or so forth.

Figure 40A:
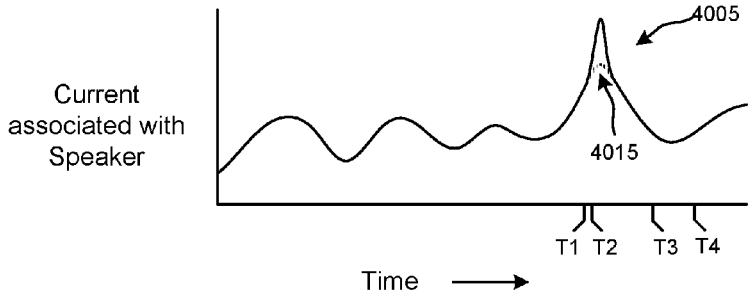
FIGS. 40A through 40D are graphs that collectively illustrate operation of an over-excursion module, according to an embodiment.
Figure 40B:
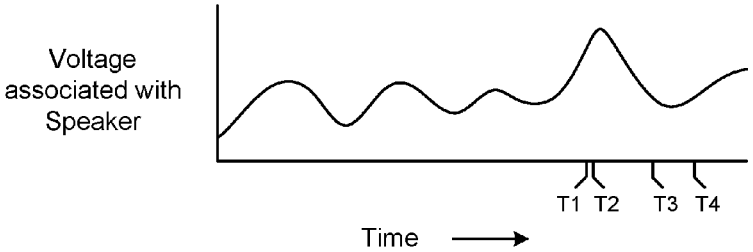

FIG. 40A is a graph that illustrates a current associated with a speaker, and FIG. 40B is a graph that illustrates a voltage associated with the speaker. In some embodiments, the current associated with the speaker shown in FIG. 40A can be a current into a voice coil of the speaker. In some embodiments, the voltage associated with the speaker shown in FIG. 40B can be a voltage associated with an amplitude of an audio signal into the speaker.

Figure 40C:
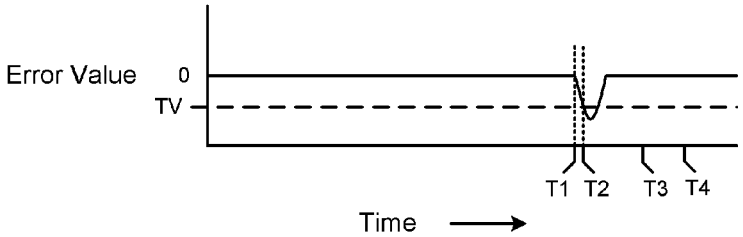

FIG. 40C is a graph that illustrates an error value (which can also be referred to as an error signal) calculated based on the current associated with the speaker (shown in FIG. 40A) and the voltage associated with the speaker (shown in FIG. 40B). In some embodiments, the error value, which can be referred to as electrical property value, can represent an impedance (or change thereof) based on the current associated with the speaker and the voltage associated with the speaker. Specifically, the error value can be calculated based on difference between the current associated with the speaker and the voltage associated with the speaker. The current associated with the speaker and/or the voltage associated with the speaker can be scaled so that the error value is calibrated to zero as shown in FIG. 40C. In some embodiments, the error value can be calibrated against a value other than zero.

In some embodiments, the error value can be calculated based on a variety of relationships (e.g., scaled relationships, logical relationships, linear or non-linear relationships, quotient relationships, multiple case relationships) between the voltage associated with the speaker and the current associated with speaker. In some embodiments, other types of measurements (e.g., voltage measurements, current measurements, impedance measurements, inductance measurements, and so forth) can be used to define an error value such as the error value shown in FIG. 40C.

In this embodiment, the current associated with the speaker shown in FIG. 40A tracks with (e.g., approximately tracks with) the voltage associated with the speaker shown in FIG. 40B so that the error value is 0 (or approximately 0) until approximately time T1. In this embodiment, at approximately time T1, an over-excursion event of the speaker commences (e.g., an impact of a diaphragm (or portion thereof) within the speaker) and causes the current associated with the speaker shown in FIG. 40A to increase at a relatively rapid rate relative to an increase in the voltage associated with the speaker shown in FIG. 40B. In other words, the current to voltage ratio can be significantly altered (beyond that used to calculate the baseline error value of 0) in response to the excursion event. The relatively rapid increase in the current associated with the speaker is shown as current spike 4005 in FIG. 40A. The current associated with the speaker, if the over-excursion event did not occur is shown as dashed line 4015 in FIG. 40A.

Figure 40D:
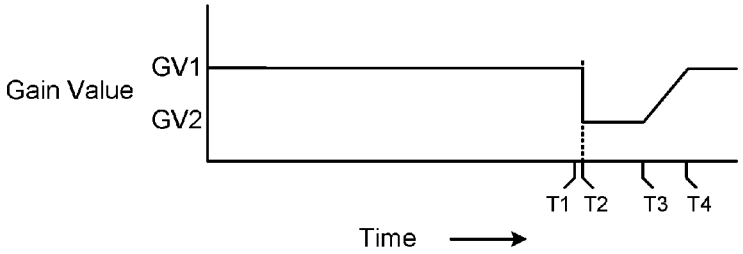

In response to the current spike 4005 shown in FIG. 40A, the error value starts to drop at approximately time T1 until the error value falls below a threshold value TV approximately time T2. In response to the error value falling below the threshold value TV, a gain value associated with (e.g., configured to increase, configured to attenuate) an audio signal into the speaker is changed at approximately time T2 from a gain value GV1 to a gain value GV2 as shown in FIG. 40D. In this embodiment, the gain value is decreased to the gain value GV2 so that a level (e.g., an audio level) of the audio signal into the speaker is decreased at approximately time T2. In some embodiments, the gain value GV1 can be a baseline gain value or can be a gain value at a normal operating status of a computing device.

As shown in FIG. 40D, the gain value is held at gain value GV2 between times T2 and T3 until the gain value gradually increases at a specified rate (which can be referred to as a release rate) between times T3 and T4 back to the gain value GV1. In some embodiments, the hold time (e.g., hold time period) of the gain value can be a predefined (or default) hold time period. In this embodiment, after the hold time has expired, the gain value is configured to gradually increase in a stepwise fashion at set gain value intervals per unit time (e.g., 0.1 dB/ms, 1 dB/second) between times T3 and T4 from approximately. In some embodiments, the rate of change of the cutoff frequency can vary (e.g., dynamically vary, can be varied between cycles) after a hold time period has expired. Accordingly, the gain value can be triggered to start increasing after the error value has crossed a threshold value (e.g., threshold value TV) and after a hold time has expired. In some embodiments, an audio signal can continue to be attenuated (e.g., can be attenuated at a constant/static level or based on a static attenuation profile) for a hold time (even though the error signal has dropped below the threshold value) so that the gain value may not be temporarily changed if subsiding of an over-excursion event is only temporary.

Although not shown in FIG. 40D, in some embodiment, the gain value can be triggered to decrease at a specified rate (e.g., decrease at a specified attenuation rate, decrease in a linear or non-linear fashion, a step-wise fashion, etc.). In other words, in some embodiments, the gain value can be triggered to decrease at a specified rate (rather than immediately) in response to the error value falling below the threshold value TV at approximately time T2. Although not shown in FIG. 40D, in some embodiment, the gain value can be triggered to increase (e.g., increase starting at time T3) abruptly rather than at a relatively gradual rate.

In some embodiments, a hold time period, a magnitude of the gain value change, a rate of change of the gain value, and/or so forth can vary based on a magnitude or profile of the error value. In other words, the hold time period, the magnitude of the gain value change, the rate of change of the gain value, and/or so forth can vary based on relationship. For example, a magnitude of a change in the gain value, a hold time of the gain value, and/or a rate of change of the gain value be greater in cases where the error value exceeds the threshold value TV by a relatively large amount than in cases where the error value exceeds the threshold value TV by relatively small amount.

Figure 41:
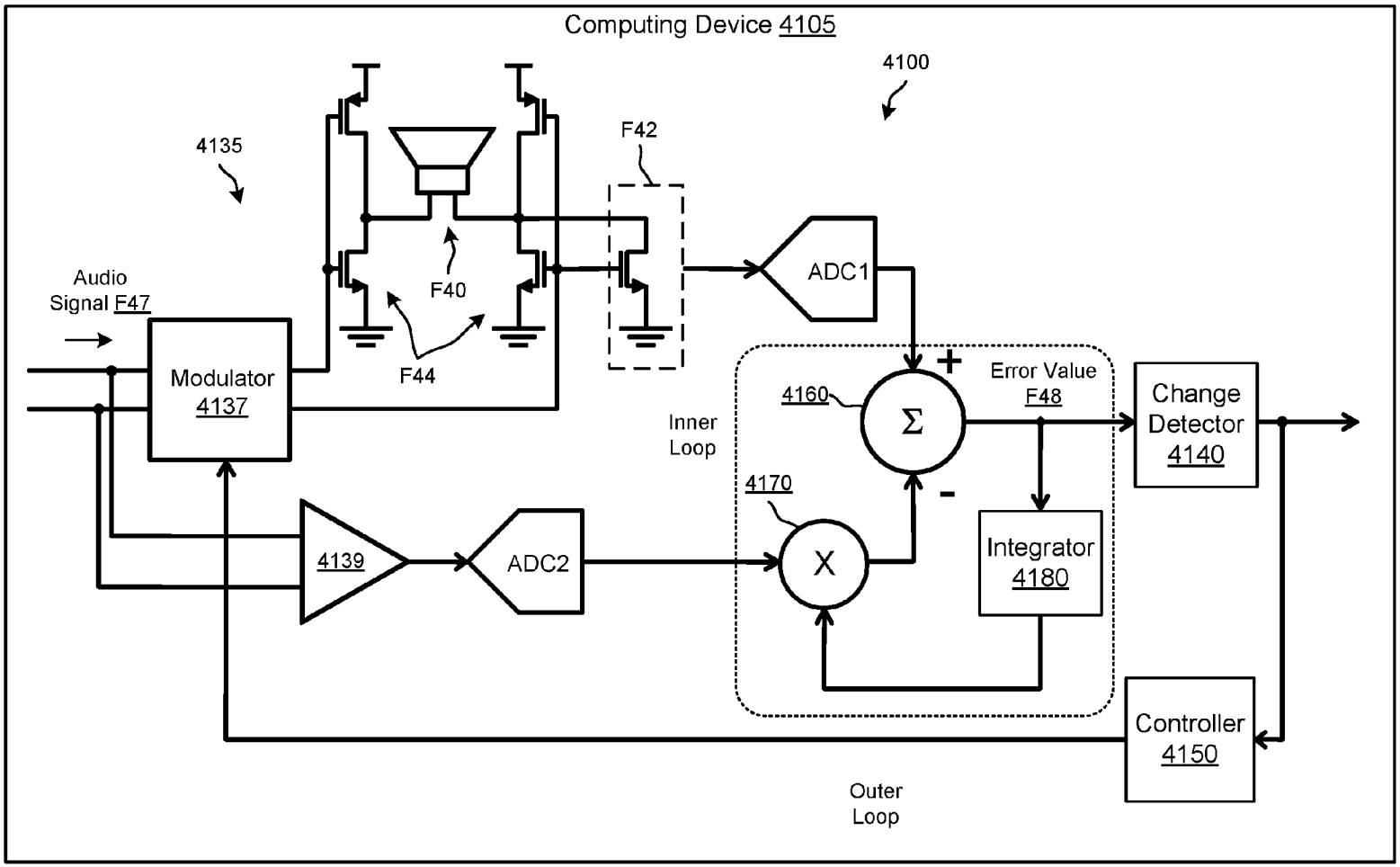
FIG. 41 is a block diagram that illustrates an over-excursion module, according to an embodiment.

FIG. 41 is a block diagram that illustrates an over-excursion module 4100, according to an embodiment. As shown in FIG. 41, a speaker driver 4135 includes output stages F44 coupled to a modulator 4137. The output stages F44 include metal oxide semiconductor field effect transistor (MOSFET) devices. The modulator 4137 is coupled to a controller 4150. The speaker driver 4135 is configured to receive and drive the speaker F40 based on an audio signal F47 produced by an audio signal generator (not shown).

In this embodiment, one of the output stages F44 is coupled to a current sense MOSFET device F42 (which can be configured to mirror current flow through one or more of the output stage is F44) that can be used by an analog-to-digital converter ADC1 to measure (e.g., detect, receive) a current associated with the speaker F40 (e.g., into a coil of the speaker F40). The analog-to-digital converter ADC1 can be configured to produce an output value that is a digital representation of a current value associated with the speaker F40. In some embodiments, multiple current sense MOSFET devices F42 can be used to measure a current associated with the speaker F40.

Also as shown in FIG. 41, an analog-to-digital converter ADC2 is configured to measure (e.g., detect, receive) a voltage associated with the audio signal F47 via a replica amplifier 4139. The replica amplifier 4139, in this embodiment, can be configured to mirror (e.g., substantially mirror) processing or signal manipulation performed by the speaker driver 4135 so that the voltage of signals used to directly drive the speaker F40 are substantially the same as the voltage measured by the analog-to-digital converter ADC2. The analog-to-digital converter ADC2 can be configured to produce an output value that is a digital representation of a voltage value associated with the audio signal F47 driving the speaker F40.

Although not shown in FIG. 41, in some embodiments, the functionality of the analog-to-digital converter ADC1 and the functionality of the analog-to-digital converter ADC2 can be combined into a single analog-to-digital converter that is multiplexed. In some embodiments, voltages and/or currents measured by the analog-to-digital converters ADC1, ADC2 can be performed at different nodes, or by different circuit or configurations, than those shown in FIG. 41.

As shown in FIG. 41, an error value F48 can be defined by a summation circuit 4160 based on the output value (e.g., a current value represented in voltage) from the analog-to-digital converter ADC1 and on an output value (e.g., a voltage value represented in voltage) from the analog-to-digital converter ADC2 after the output value from the analog-to-digital converter ADC2 is scaled using a scaling factor (or gain value) by a scaling circuit 4170. In some embodiments, the output value of the analog-to-digital converter ADC1 can also be scaled in addition to, or may be scaled in lieu of, the scaling of the output value of the analog-to-digital converter ADC2.

A change detector 4140 is configured to determine (e.g., calculate) whether or not the error value F48 exceeds a threshold value. In response to the error value F48 exceeding a threshold value, the change detector 4140 can be configured to send an indicator to the controller 4150. In some embodiments, the indicator can be referred to as an over-excursion indicator or as an over-excursion flag. As shown in FIG. 41, the over-excursion indicator can be sent to a circuit or device external to the over-excursion module 4100. In some embodiments, the indicator may be produced and sent only after an error value has exceeded a threshold value a specified number of times (e.g., counts) within a specified time period (e.g., at a specified rate).

The controller 4150, in response to the indicator, can be configured to trigger the modulator 4137 to, for example, attenuate a level of the audio signal F47 being provided via the speaker driver 4135 to the speaker F40. The controller 4150 can be configured to produce a signal (e.g., an instruction (e.g., a gain reduction control instruction), an indicator, a value) configured to trigger a specified magnitude of the change in a level of the audio signal F47, a specified hold time for a change in the level of the audio signal F47, a specified rate of change (e.g., attenuation, increase) in the level of the audio signal F47, and/or so forth. Accordingly, in some embodiments, subsequent over-excursion events can be reduced and/or eliminated (e.g., prevented).

As shown in FIG. 41, an integrator 4180 can be configured to receive the error value F48. The integrator 4180 can be configured to adjust a scaling factor applied by the scaling circuit 4170 in response to, for example, drifting operation of the over-excursion module 4100 due to, for example, changes in temperature, reference voltages, operating conditions, device characteristics, and/or so forth. Specifically, the integrator 4180 can be configured to adjust, without being influenced in an undesirable fashion by over-excursion events that can periodically occur and cause spikes in the error value F48, the scaling factor applied by the scaling circuit 4170 so that the error value F48 is calibrated in a desirable fashion (e.g., calibrated against a zero error value or another value).

As shown in FIG. 41, the over-excursion module 4100 is defined by two loops—an inner loop and an outer loop. The inner loop can function as a relatively slow-acting inner loop that continuously balances internal signals (from the analog-to-digital converters ADC1 and ADC2) that represent the voltage and/or current associated with the speaker F40 (i.e., load), and the outer loop can function as a relatively fast-attack and/or slow-decay outer loop that monitors the error value F48 produced by the inner loop to reduce the gain of the speaker driver 4135 if the error value F48 exceeds a threshold value (e.g., abruptly increases beyond a threshold value), which can be, for example, associated with a spike in load current caused by an over-excursion event. In some embodiments, the inner loop can be unconditionally stable and can have zero error at infinity.

In some embodiments, one or more components included in the outer loop and/or the inner loop can be different than those shown in FIG. 41. For example, the integrator 4180 may not be included in some embodiments of the inner loop. Although many of the components shown in FIG. 41 are digital components, in some embodiments, at least some of the components can be implemented using analog implementations. For example, the change detector 4140 can be implemented as an analog component rather than as a digital component.

Figure 42:
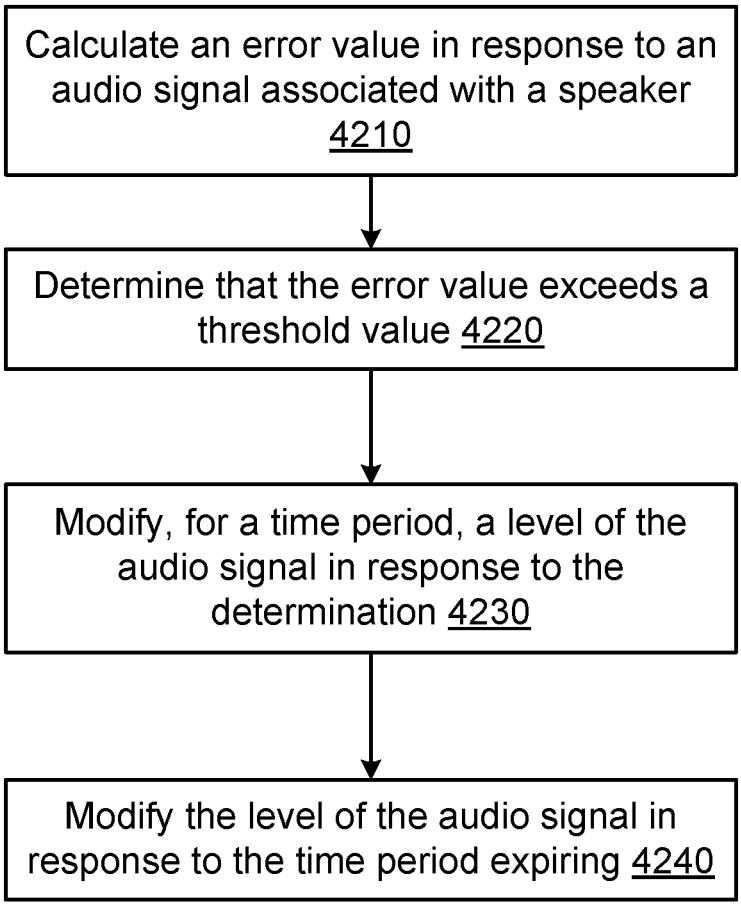
FIG. 42 is a flowchart that illustrates a method for modifying an audio signal to a speaker based on electrical property analysis.

FIG. 42 is a flowchart that illustrates a method for modifying an audio signal to a speaker based on electrical property analysis. In some embodiments, at least some portions of the method shown in FIG. 42 can be performed by, for example, the components of the over-excursion module 3800 shown in FIG. 38 and/or the components of the over-excursion module 4100 shown in FIG. 41.

As shown in FIG. 42, an error value is calculated in response to an audio signal associated with a speaker (block 4210). The error value can be associated with (e.g., can represent, can be correlated with) an electrical property of the speaker (e.g., an impedance of the speaker). In some embodiments, the error value can be influenced by a change in an impedance associated with the speaker that is calculated based on current of the speaker (e.g., a current through a voice coil of the speaker) in response to the audio signal and based on a voltage (e.g., an amplitude) of the audio signal. In some embodiments, the electrical property can be derived the electrical property detector 3830 shown in FIG. 38. In some embodiments, the error value can be calculated based on an inner loop associated with the over-excursion module 3800 shown in FIG. 38.

The error value is determined to exceed a threshold value (block 4220). In some embodiments, the threshold value can be set at a level to avoid or mitigate, for example, physical damage to the speaker in response to the audio signal. In some embodiments, the error value can be determined to exceed the threshold value by the change detector 3840 shown in FIG. 38.

A level of the audio signal is modified for a time period in response to the determination (block 4230). In some embodiments, the controller 3850 included in the over-excursion module 3800 shown in FIG. 38 can be configured to modify (e.g., attenuate) the level of the audio signal. In some embodiments, the magnitude of the change of the level of the audio signal, the period of time, and/or so forth can be selectively defined by the controller 3850 shown in FIG. 38. In some embodiments, the level of the audio signal can be immediately modified or modified at a specified rate.

The level of the audio signal is modified in response to the time period expiring (block 4240). In some embodiments, the duration of time period can, in some embodiments, be selectively defined by the controller 3850 shown in FIG. 38. In some embodiments, the level of the audio signal is modified to the level associated with block 4230 or a different level (e.g., a higher lever, a lower level). In some embodiments, at least some portions of blocks 4220 through 4240 can be performed by an outer loop of the over-excursion module 3800 shown in FIG. 38. In some embodiments, the level of the audio signal can be immediately modified or modified at a specified rate.

Figure 43:
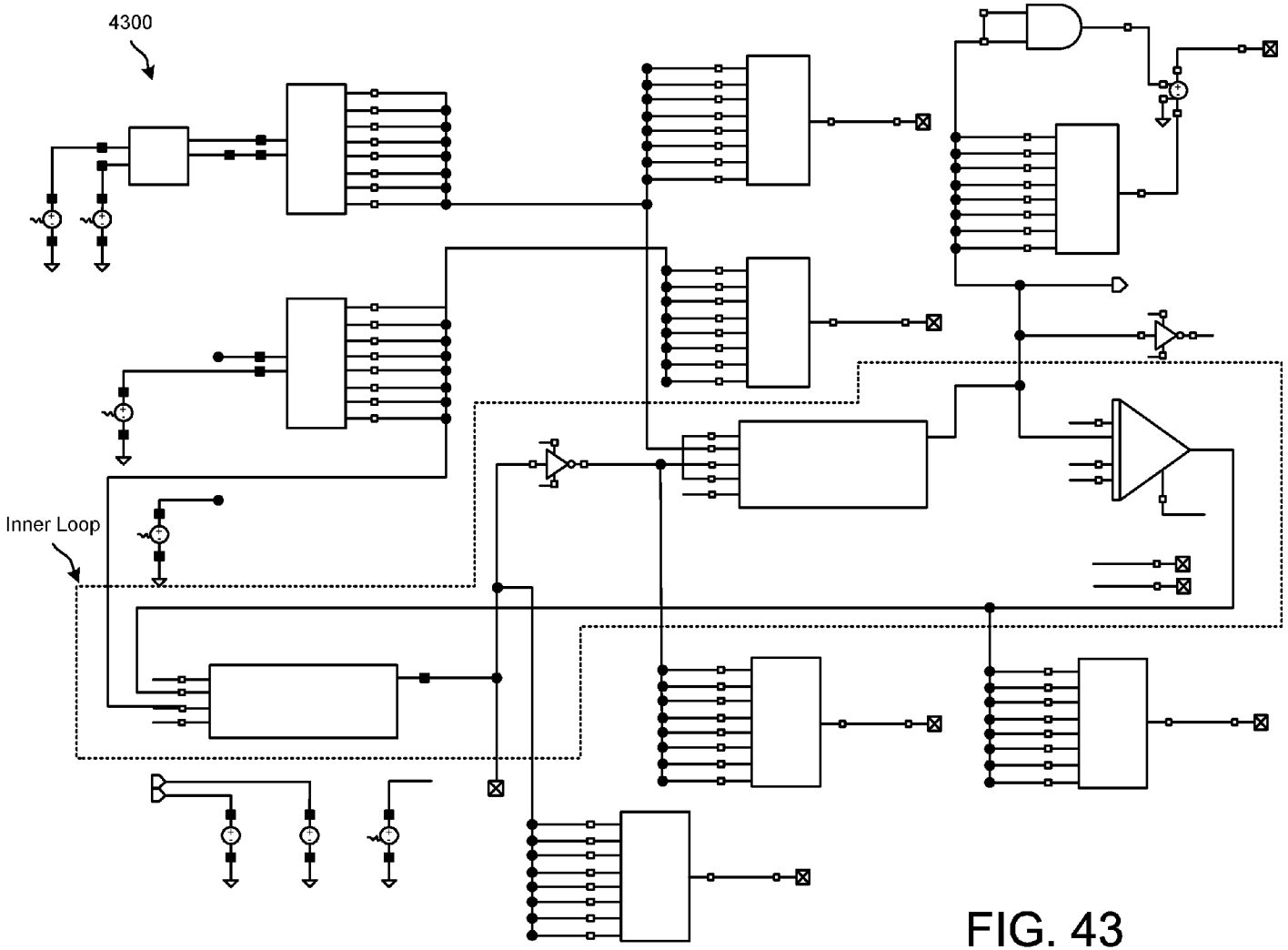
FIG. 43 is a diagram that illustrates an implementation of the over-excursion module shown in FIG. 41.

FIG. 43 is a diagram that illustrates an implementation of the over-excursion module shown in FIG. 41. As shown in FIG. 43, the over-excursion module 4300 includes an inner loop. The over-excursion module 4300 is configured to modify a level of an input audio signal based on an analysis of an electrical property.

Implementations of the various techniques described herein may be implemented in electronic circuitry, on electronic circuit boards, in discrete components, in connectors, in modules, in electromechanical structures, or in combinations of them. Portions of methods also may be performed by, and an apparatus may be implemented as, or integrated into special purpose semiconductor circuitry (e.g., an FPGA (field programmable gate array) or an ASIC (application-specific integrated circuit)).

Implementations may be implemented in an electrical system that including computers, automotive electronics, industrial electronics, portable electronics, telecom systems, mobile devices, and/or consumer electronics. Components may be interconnected by any form or medium of electronic communication (e.g., a communication network). Examples of communication networks include a local area network (LAN) and a wide area network (WAN), e.g., the Internet.

Some implementations of devices under test may include various semiconductor processing and/or packaging techniques. Some embodiments (e.g., devices under test and/or test system components) may be implemented using various types of semiconductor processing techniques associated with semiconductor substrates including, but not limited to, for example, Silicon (Si), Galium Arsenide (GaAs), Silicon Carbide (SiC), and/or so forth.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the embodiments. It should be understood that they have been presented by way of example only, not limitation, and various changes in form and details may be made. Any portion of the apparatus and/or methods described herein may be combined in any combination, except mutually exclusive combinations. The embodiments described herein can include various combinations and/or sub-combinations of the functions, components and/or features of the different embodiments described.

What is claimed is:

1. A speaker drive circuit comprising:

a modulator configured to drive a speaker based on an audio signal;

a first circuit configured to generate an error signal based on a current used to drive the speaker; and a second circuit configured to monitor the error signal;

a change detector configured to:

determine a displacement of the speaker based on a change in the error signal, determine that the displacement of the speaker exceeds an over-excursion threshold value, and upon determining the displacement of the speaker exceeds the over-excursion threshold value, generate a control signal to cause a reduction in an amplifier gain; and a controller configured to:

generate an instruction based on the control signal, the instruction being configured to cause the reduction in the amplifier gain, and communicate the instruction to the modulator, the modulator including an amplifier configured to attenuate the audio signal based on the instruction.

2. The speaker drive circuit of claim 1, further comprising:

a current sense device configured to mirror a current output of the modulator;

an amplifier configured to mirror a voltage input to the modulator;

a first analog-to-digital converter (ADC) configured to generate a digital representation of the current; and a second ADC configured to generate a digital representation of the voltage.

3. The speaker drive circuit of claim 1, wherein the first circuit includes:

a summation circuit configured to generate the error signal based on a digital representation of the current and a digital representation of a voltage, a scaling circuit scale the digital representation of the voltage based on a scaling factor, and an integrator configured to generate the scaling factor based on operational conditions of the first circuit and the second circuit.

4. The speaker drive circuit of claim 1, wherein the current is associated with a low-frequency portion of the audio signal, and the second circuit generates the control signal to cause the low-frequency portion of the audio signal to be attenuated.

5. The speaker drive circuit of claim 1, wherein the current is sensed using a device configured to mirror the current through a coil of the speaker.

6. The speaker drive circuit of claim 1, wherein the second circuit is further configured to generate a control signal to cause an increase in the amplifier gain.

7. The speaker drive circuit of claim 1, wherein if the over-excursion threshold value associated with the error signal is exceeded for more than a period of time the control signal is generated to cause reduction in an amplifier gain.

8. The speaker drive circuit of claim 1, wherein the amplifier gain is reduced for a period of time, and after the period of time has expired, the amplifier gain is restored to original value.

9. A method comprising: generating an error signal based on a current used to drive a speaker; monitoring the error signal; determining a displacement of the speaker based on a change in the error signal, determining that the displacement of the speaker exceeds an over-excursion threshold value, and in response to determining the displacement of the speaker exceeds the over-excursion threshold value, generating an instruction configured to cause a reduction in an amplifier gain; and communicating the instruction to a modulator, the modulator including an amplifier configured to attenuate the audio signal based on the instruction.

10. The method of claim 9, wherein the error signal is generated based on a digital representation of the current and a digital representation of a voltage, the method further comprising: scaling the digital representation of the voltage based on a scaling factor.

11. The method of claim 9, wherein the current is sensed using a device configured to mirror the current through a coil of the speaker.

12. The method of claim 9, method further comprising generating a control signal to cause an increase in an amplifier gain.

13. The method of claim 9, wherein if the over-excursion threshold value associated with the error signal is exceeded for more than a period of time the control signal is generated to cause reduction in an amplifier gain.

14. The method of claim 9, wherein the amplifier gain is reduced for a period of time, and after the period of time has expired, the amplifier gain is restored to original value.

15. A non-transitory computer-readable storage medium having stored thereon computer executable program code which, when executed on a computer system, causes the computer system to perform steps comprising:

generating an error signal based on a current used to drive a speaker;

monitoring the error signal; determining a displacement of the speaker based on a change in the error signal; determining that the displacement of the speaker exceeds an over-excursion threshold value; in response to determining the displacement of the speaker exceeds the over-excursion threshold value, generating an instruction configured to cause a reduction in an amplifier gain; and communicating the instruction to a modulator, the modulator including an amplifier configured to attenuate the audio signal based on the instruction.

16. The non-transitory computer-readable storage medium of claim 15, wherein the error signal is generated based on a digital representation of the current and a digital representation of a voltage, the steps further comprising:

scaling the digital representation of the voltage based on a scaling factor.

17. The non-transitory computer-readable storage medium of claim 15, wherein the current is sensed using a device configured to mirror the current through a coil of the speaker.

18. The non-transitory computer-readable storage medium of claim 15, the steps further comprising generating a control signal to cause an increase in an amplifier gain.

19. The non-transitory computer-readable storage medium of claim 15, wherein if the over-excursion threshold value associated with the error signal is exceeded for more than a period of time the control signal is generated to cause reduction in an amplifier gain.

20. The non-transitory computer-readable storage medium of claim 15, wherein the amplifier gain is reduced for a period of time, and after the period of time has expired, the amplifier gain is restored to original value.

* * * * *